US012305304B2

(12) United States Patent
Zhao et al.

(10) Patent No.: US 12,305,304 B2
(45) Date of Patent: May 20, 2025

(54) INTERFACE FOR CARBON OXIDE ELECTROLYZER BIPOLAR MEMBRANE

(71) Applicant: Twelve Benefit Corporation, Berkeley, CA (US)

(72) Inventors: Shuai Zhao, Santa Clara, CA (US); Edward Izett, Berkeley, CA (US)

(73) Assignee: Twelve Benefit Corporation, Berkeley, CA (US)

( * ) Notice: Subject to any disclaimer, the term of this patent is extended or adjusted under 35 U.S.C. 154(b) by 0 days.

(21) Appl. No.: 18/327,835

(22) Filed: Jun. 1, 2023

(65) Prior Publication Data

US 2024/0141514 A1 May 2, 2024

Related U.S. Application Data

(60) Provisional application No. 63/379,374, filed on Oct. 13, 2022.

(51) Int. Cl.

| | |
|---|---|
| ***C25B 9/40*** | (2021.01) |
| ***C25B 1/23*** | (2021.01) |
| ***C25B 3/25*** | (2021.01) |
| ***C25B 9/23*** | (2021.01) |
| ***C25B 11/093*** | (2021.01) |
| ***C25B 15/06*** | (2006.01) |

(52) U.S. Cl.

CPC ..... *C25B 9/40* (2021.01); *C25B 1/23* (2021.01); *C25B 3/25* (2021.01); *C25B 9/23* (2021.01); *C25B 11/093* (2021.01); *C25B 15/06* (2013.01)

(58) Field of Classification Search

None

See application file for complete search history.

(56) References Cited

U.S. PATENT DOCUMENTS

| | | | |
|---|---|---|---|
| 4,042,496 | A | 8/1977 | Tsushima et al. |
| 4,089,758 | A | 5/1978 | McAloon |
| 4,116,889 | A | 9/1978 | Chlanda et al. |
| 4,176,215 | A | 11/1979 | Molnar et al. |
| 4,253,900 | A | 3/1981 | Dege et al. |
| 4,355,116 | A | 10/1982 | Lee et al. |
| 4,655,886 | A | 4/1987 | Oda et al. |

(Continued)

FOREIGN PATENT DOCUMENTS

| | | | |
|---|---|---|---|
| CA | 1071143 | A | 2/1980 |
| CA | 2960595 | A1 | 3/2016 |

(Continued)

OTHER PUBLICATIONS

Machine translation of Kang et al KR 2015-0073651 A (Year: 2015).*

(Continued)

*Primary Examiner* — Harry D Wilkins, III

(74) *Attorney, Agent, or Firm* — Weaver Austin Villeneuve & Sampson LLP

(57) ABSTRACT

Provided herein are membrane electrode assemblies (MEAs) for carbon oxide reduction. According to various embodiments, the MEAs are configured to address challenges particular to $CO_x$ including mitigating the deleterious effects of electrical current fluctuations on the MEA. Bipolar membrane MEAs equipped with an interface composed of nanoparticles are described.

19 Claims, 6 Drawing Sheets

(56) References Cited

U.S. PATENT DOCUMENTS 4,766,161 A 8/1988 Chlanda et al.
4,828,941 A 5/1989 Sterzel
5,039,389 A 8/1991 McMichael
6,358,651 B1 3/2002 Chen et al.
7,704,369 B2 4/2010 Olah et al.
7,883,817 B2 2/2011 Hori et al.
8,137,859 B2 3/2012 Shin et al.
8,268,026 B2 9/2012 Norbeck et al.
8,277,631 B2 10/2012 Eastman et al.
8,652,104 B2 2/2014 Goral et al.
8,652,704 B2 2/2014 Sano et al.
8,697,129 B2 4/2014 Qian et al.
9,012,345 B2 4/2015 Masel et al.
9,486,480 B2 11/2016 Ayoub et al.
9,587,071 B2 3/2017 Sun et al.
10,092,661 B2 10/2018 Qian et al.
10,648,091 B2 5/2020 Kuhl et al.
10,822,709 B2 11/2020 Kuhl et al.
10,865,490 B2 12/2020 Ono et al.
10,961,632 B2 3/2021 Ono et al.
10,975,480 B2 4/2021 Masel
10,975,481 B2 4/2021 Guo et al.
11,011,756 B2 5/2021 Pintauro et al.
11,124,886 B2 9/2021 Kuhl et al.
11,221,330 B2 1/2022 Alocilja et al.
11,268,200 B2 3/2022 Oener et al.
11,271,220 B2 3/2022 Morin et al.
11,299,810 B2 4/2022 Suchsland et al.
11,417,901 B2 8/2022 Ma et al.
11,578,415 B2 2/2023 Cave et al.
11,680,327 B2 6/2023 Kuhl et al.
11,680,328 B2 6/2023 Huo et al.
11,888,191 B2 1/2024 Ma et al.
12,043,912 B2 7/2024 Cave et al.
2003/0059658 A1 3/2003 Kohler et al.
2004/0028992 A1 2/2004 Jaouen
2005/0147859 A1 7/2005 Kiefer et al.
2005/0239912 A1 10/2005 Arcella et al.
2006/0016685 A1 1/2006 Hawkins et al.
2008/0045401 A1 2/2008 Zhou et al.
2008/0318093 A1 12/2008 Lee et al.
2009/0117436 A1 5/2009 Choi et al.
2009/0155102 A1 6/2009 Park et al.
2010/0028736 A1 2/2010 Unlu et al.
2010/0142123 A1* 6/2010 Smith ..... H01G 11/62 361/504
2010/0159347 A1 6/2010 Choi et al.
2010/0193370 A1 8/2010 Olah et al.
2010/0273087 A1 10/2010 Choi et al.
2011/0237830 A1 9/2011 Masel
2012/0171583 A1 7/2012 Bocarsly et al.
2012/0252091 A1 10/2012 Rasmussen et al.
2012/0328942 A1 12/2012 Thomas-Alyea et al.
2013/0098772 A1 4/2013 Bocarsly et al.
2013/0105304 A1 5/2013 Kaczur et al.
2013/0118911 A1 5/2013 Sivasankar et al.
2013/0345325 A1 12/2013 Lecomte et al.
2014/0093799 A1 4/2014 Masel et al.
2014/0202875 A1 7/2014 Mofakhami
2014/0206894 A1 7/2014 Cole et al.
2014/0287347 A1 9/2014 Vincent et al.
2014/0291163 A1 10/2014 Kanan et al.
2015/0010804 A1 1/2015 Laramie et al.
2015/0030888 A1 1/2015 Popat et al.
2015/0064602 A1 3/2015 Lee et al.
2015/0068915 A1* 3/2015 Hoch ..... C25B 9/19 204/252
2015/0136613 A1 5/2015 Li et al.
2016/0107154 A1 4/2016 Masel et al.
2016/0151739 A1 6/2016 Jakobsson et al.
2016/0161869 A1 6/2016 Avneri et al.
2016/0194766 A1 7/2016 Eastman et al.
2016/0369415 A1 12/2016 Masel et al.
2017/0183789 A1 6/2017 Matthews et al.
2017/0259206 A1 9/2017 Masel et al.
2017/0321333 A1 11/2017 Kuhl et al.
2017/0321334 A1 11/2017 Kuhl et al.
2018/0111083 A1 4/2018 Masel
2018/0151890 A1 5/2018 Ishida et al.
2018/0265440 A1 9/2018 Kudo et al.
2018/0274109 A1 9/2018 Kudo et al.
2019/0036143 A1 1/2019 Yan et al.
2019/0062931 A1 2/2019 Stark et al.
2019/0085477 A1 3/2019 Ono et al.
2019/0127865 A1 5/2019 Li et al.
2019/0134570 A1 5/2019 Pintauro et al.
2019/0211463 A1 7/2019 Masel
2019/0226103 A1 7/2019 Kuhl et al.
2019/0233954 A1 8/2019 Tacconi et al.
2020/0080211 A1 3/2020 Schmid et al.
2020/0087233 A1 3/2020 Ono et al.
2020/0087805 A1 3/2020 Ono et al.
2020/0216968 A1* 7/2020 Hunegnaw ..... C25B 13/08
2020/0220185 A1 7/2020 Ma et al.
2020/0240023 A1 7/2020 Cave et al.
2020/0270756 A1 8/2020 Kofuji et al.
2020/0308718 A1 10/2020 Patru et al.
2020/0318247 A1 10/2020 Fernandez et al.
2020/0325587 A1 10/2020 Fernandez et al.
2020/0354843 A1 11/2020 Kuhl et al.
2020/0370188 A1* 11/2020 Oener ..... C25B 13/08
2020/0376479 A1 12/2020 Masel
2021/0002775 A1 1/2021 Matsumoto et al.
2021/0079537 A1 3/2021 Spurgeon
2021/0164116 A1 6/2021 Kuhl et al.
2021/0207275 A1 7/2021 Huo et al.
2021/0292924 A1 9/2021 Sargent et al.
2021/0381116 A1 12/2021 Kashi et al.
2021/0387139 A1 12/2021 Voskian et al.
2021/0395908 A1 12/2021 Kuhl et al.
2022/0010437 A1 1/2022 Kuhl et al.
2022/0119636 A1 4/2022 Wang et al.
2022/0119641 A1 4/2022 Wang et al.
2022/0136119 A1 5/2022 Flanders et al.
2022/0267916 A1* 8/2022 Zhao ..... C25B 9/19
2022/0393203 A1 12/2022 Ma et al.
2023/0136397 A1 5/2023 Cave et al.
2023/0155153 A1 5/2023 Huo et al.
2023/0175146 A1 6/2023 Kashi et al.
2023/0264148 A1* 8/2023 Boettcher ..... C25B 13/07 205/344
2023/0265568 A1 8/2023 Kuhl et al.
2023/0366110 A1 11/2023 Kuhl et al.
2024/0133058 A1 4/2024 Huo et al.
2024/0145745 A1 5/2024 Ma et al.
2024/0254641 A1 8/2024 Wu et al.
2024/0327999 A1 10/2024 Cave et al.

FOREIGN PATENT DOCUMENTS

CN 1471740 A 1/2004
CN 101981744 A 2/2011
CN 102576902 A 7/2012
CN 102912374 A 2/2013
CN 104247118 A 12/2014
CN 104619886 A 5/2015
CN 104919088 A 9/2015
CN 106715760 A 5/2017
CN 107735512 A 2/2018
CN 108884578 A 11/2018
CN 109417181 A 3/2019
DE 102016211155 A1 12/2017
DE 102016211151 A1 1/2018
DE 102018210303 A1 1/2020
EP 1038993 A1 9/2000
EP 1193329 A1 4/2002
EP 1261058 A2 11/2002
EP 3378968 A1 9/2018
IN 201817041221 A 3/2019
JP H06145379 A 5/1994
JP H08296077 A 11/1996
JP H10507305 A 7/1998
JP 2002352810 A 12/2002
JP 2003213472 A 7/2003

(56) References Cited

FOREIGN PATENT DOCUMENTS

| | | | | | |
|---|---|---|---|---|---|
| JP | 2012050531 | A | | 3/2012 | |
| JP | 2013520779 | A | | 6/2013 | |
| JP | 2014022249 | A | | 2/2014 | |
| JP | 2014525115 | A | | 9/2014 | |
| JP | 2014194079 | A | | 10/2014 | |
| JP | 2014532119 | A | | 12/2014 | |
| JP | 2015533944 | A | | 11/2015 | |
| JP | 2018154898 | A | | 10/2018 | |
| JP | 2018154899 | A | | 10/2018 | |
| JP | 2018184655 | A | | 11/2018 | |
| JP | 2021059788 | A | | 4/2021 | |
| KR | 100962903 | B1 | | 6/2010 | |
| KR | 20140142185 | A | | 12/2014 | |
| KR | 2015-0073651 | A | * | 7/2015 | ..... B01J 23/745 |
| WO | WO-9611507 | A1 | | 4/1996 | |
| WO | WO-2008124538 | A1 | | 10/2008 | |
| WO | WO-2011104542 | A1 | | 9/2011 | |
| WO | WO-2012174463 | A1 | | 12/2012 | |
| WO | WO-2016039999 | A1 | | 3/2016 | |
| WO | WO 2016/108603 | A1 | * | 7/2016 | ..... C25B 3/04 |
| WO | WO-2017144395 | A1 | | 8/2017 | |
| WO | WO-2017169682 | A1 | | 10/2017 | |
| WO | WO-2017176306 | A1 | | 10/2017 | |
| WO | WO-2017190234 | A1 | | 11/2017 | |
| WO | WO-2018195045 | A1 | | 10/2018 | |
| WO | WO-2019020239 | A1 | | 1/2019 | |
| WO | WO-2019120812 | A1 | | 6/2019 | |
| WO | WO-2019136018 | A2 | | 7/2019 | |
| WO | WO-2019206882 | A1 | | 10/2019 | |
| WO | WO-2020020691 | A1 | | 1/2020 | |
| WO | WO-2020112919 | A1 | | 6/2020 | |
| WO | WO-2020143970 | A1 | | 7/2020 | |
| WO | WO-2020212139 | A1 | | 10/2020 | |
| WO | WO-2021007508 | A1 | | 1/2021 | |
| WO | WO-2021252535 | A2 | | 12/2021 | |

OTHER PUBLICATIONS

Machine translation of Shin et al WO 2016/108603 A1 (Year: 2016).*

Chen et al, Design principles for water dissociation catalysts in high-performance bipolar membranes, Nature Communications, vol. 13, Article No. 3846, Jul. 2022, pp. 1-10 (Year: 2022).*

Aeshala, L.M. et al., "Effect of Cationic and Anionic Solid Polymer Electrolyte on Direct Electrochemical Reduction of Gaseous $CO_2$ to Fuel", Journal of $CO_2$ Utilization, Dec. 1, 2013, vol. 3-4, pp. 49-55.

Aeshala, L.M. et al., "Effect of solid polymer electrolyte on electrochemical reduction of CO2, Separation and Purification Technology," 94, (2012), pp. 131-137.

Ahlfield J., et al., "PEM/AEM Junction Design for Bipolar Membrane Fuel Cells," Journal of The Electrochemical Society, 2017, vol. 164 (12), pp. F1165-F1171.

Badami, M. "Leakage effects on the performance characteristics of a regenerative blower for the hydrogen recirculation of a PEM fuel cell," Energy Conversion and Management, vol. 55, Mar. 2012, pp. 20-25.

Badami, M., "Theoretical model with experimental validation of a regenerative blower for hydrogen recirculation in a PEM fuel cell system," Energy Conversion and Management, vol. 51, Issue 3, Mar. 2010, pp. 553-560.

Bakshi M., et al., "How Surfactants Control Crystal Growth of Nanomaterials," ACS Crystal Growth & Design, 2016, vol. 16, pp. 1104-1133.

Balster, J. et al., "Tailoring the Interface Layer of the Bipolar Membrane", Journal of Membrane Science, vol. 365, No. 1-2, Dec. 2010, pp. 389-398.

Blaszczyk, J., "In-Situ Anode Recirculation Rate Measurement Method (Draft)," Ogura Industrial Corporation, Ballard Power Systems, Full Cell Seminar & Exposition 2011, Oct. 31-Nov. 3, 2011, 22 pages.

CA First Office Action issued on Oct. 15, 2019, in Application No. 3,022,807.

CA First Office Action issued on Sep. 30, 2019, in Application No. 3,022,812.

CA Office Action dated Jan. 9, 2023 in Application No. CA20173022812.

CA Office Action dated Jun. 21, 2023, in Application No. CA20173124239.

CA Office Action dated May 3, 2022 in Application No. CA20173124239.

CA Second Office Action issued on Aug. 28, 2020, in Application No. 3,022,812.

CA Second Office Action issued on Oct. 14, 2020, in Application No. 3,022,807.

Choo et al. Modulated Ionomer Distribution in the Catalyst Layer of Polymer Electrolyte Membrane Fuel Cells for High Temperature Operation, Chemsuschem, vol. 7, Issue 8, Aug. 2014, pp. 2335-2341.

CN First Office Action issued on Jul. 28, 2021, in Application No. 201780036099.2.

CN First Office Action issued on Jul. 7, 2021, in Application No. 201780035746.8.

CN Office Action dated Feb. 7, 2022, in Application No. CN201780357468.

CN Office Action dated Jul. 5, 2022 in Application No. CN20178035746 With English translation.

Co-pending U.S. Appl. No. 18/300,380, inventors Ziyang; Huo et al., filed Apr. 13, 2023.

Delacourt, C., "Electrochemical reduction of carbon dioxide and water to syngas (CO + H2) at room temperature," Manuscript, Environmental Energy Technologies Division, Lawrence Berkeley National Laboratory and Department of Chemical Engineering, University of California Berkeley, 2006-2007, 171 pages.

Delacourt et al., "Design of an Electrochemical Cell Making Syngas (CO + H2) from CO2 and H2O Reduction at Room Temperature," Journal of The Electrochemical Society, 155 (1), (2008), pp. B42-B49.

Endrodi, B., "Multilayer Electrolyzer Stack Converts Carbon Dioxide to Gas Products at High Pressure with Multilayer Electrolyzer Stack Converts Carbon," acs Energy Lett. 2019, 4, 1770-1777.

EP Office Action issued on Sep. 4, 2020, in Application No. 17793299.3.

EP Search Report issued on Apr. 20, 2021, in Application No. 21152137.2.

EP Search Report issued on Dec. 2, 2019, in Application No. 17793299.3.

EP Search Report issued on Dec. 4, 2019, in Application No. 17793300.9.

Extended European search report dated May 27, 2022, in Application No. EP21181985.9.

Final Office Action issued in issued on Apr. 2, 2019, in U.S. Appl. No. 15/586,182.

Final Office Action issued in issued on Jan. 8, 2020, in U.S. Appl. No. 15/586,173.

Gangeri, M et al., "Fe and Pt Carbon Nanotubes for the Electrocatalytic Conversion of Carbon Dioxide to Oxygenates", Catalysis Today, May 2009, vol. 143, pp. 57-63.

Hao, J.H. et al., "Preparation of Solvent-resistant Anion-exchange Membranes", Desalination, Jun. 2000, vol. 129, No. 1, pp. 15-22.

Hori, Y., "Chapter 48: Co2-reduction, catalyzed by metal electrodes," Handbook of Fuel Cells—Fundamentals, Technology and Applications, vol. 2, Electrocatalysis, 2003. pp. 720-733.

Hori, Y., et al., "Electroreduction of CO to CH4 and C2H4 at a Copper Electrode in Aqueous Solutions at Ambient Temperature and Pressure", Journal of the American Chemical Society, Aug. 5, 1987, vol. 109, pp. 5022-5023.

Hori, Y. et al., "Silver-coated Ion Exchange Membrane Electrode Applied to Electrochemical Reduction of Carbon Dioxide", Electrochimica Acta, Aug. 2003, vol. 48, pp. 2651-2657.

IN Office Action dated Feb. 2, 2022 in Application No. IN202118009885.

IN Office Action dated Feb. 7, 2022 in Application No. IN202118007175.

(56) References Cited

OTHER PUBLICATIONS

IN Office Action issued on Aug. 10, 2020, in Application No. 201817041221.
IN Office Action issued on Aug. 19, 2020, in Application No. 201817041222.
International Preliminary Report on Patentability and Written opinion dated Jun. 9, 2022 in Application No. PCT/US2020/062080.
International Preliminary Report on Patentability dated Dec. 22, 2022, in PCT Application No. PCT/US2021/036475.
International Search Report and Written Opinion dated Feb. 23, 2022, in Application No. PCT/US2021/55902.
International Preliminary Report on Patentability issued on Jun. 10, 2021, in PCT Application No. PCT/US2019/063471.
International Preliminary Report on Patentability issued on Nov. 15, 2018, in PCT Application No. PCT/US2017/030935.
International Search Report and Written Opinion dated Feb. 24, 2022, in Application No. PCT/US2021/055900.
International Search Report and Written Opinion dated Jan. 10, 2022, in Application No. PCT/US2021/036475.
International Search Report and Written Opinion dated Mar. 10, 2023 in PCT Application No. PCT/US2022/079570.
International Search Report and Written Opinion issued in PCT Application No. PCT/US2020/062080 on Mar. 16, 2021.
International Search Report and Written Opinion issued on Aug. 7, 2017, in PCT Application No. PCT/US2017/030935.
International Search Report and Written Opinion issued on Sep. 13, 2017, in PCT Application No. PCT/US2017/030936.
James, B.D., et al. 2017 DOE Hydrogen and Fuel Cells Program Review, Fuel Cell Systems Analysis, Strategic Analysis, Project IDI FC163, Jun. 8, 2017, 34 pages.
JP Office Action dated Dec. 7, 2021, in Application No. JP2020-213422 with English translation.
JP Office Action issued on Jan. 28, 2020, in Application No. 2018-558130.
JP Office Action issued on Jan. 28, 2020, in Application No. 2018-558138.
Li, et al., "Electrolysis of Co2 to Syngas in Bipolar Membrane-Based Electrochemical Cells," ACS Publications, ACS Energy Letters, 2016, 1, pp. 1149-1153.
Li, et al., "Electrolytic Conversion of Bicarbonate into CO in a Flow Cell," Cell Press, Joule 3, Jun. 19, 2019, pp. 1487-1497.
Li, W., "Electrocatalytic Reduction of $CO_2$ to Small Organic Molecule Fuels on Metal Catalysts," Chapter 5, Department of Chemical Engineering, Michigan Technological University, American Chemical Society, 2010, pp. 55-76.
Lin, B. et al., "Alkaline Stable C2-Substituted Imidazolium-Based Anion-Exchange Membranes," Chemistry of Material, 2013, vol. 25, pp. 1858-1867.
Liu C., et al., "Constructing a Multifunctional Interface Between Membrane and Porous Transport Layer for Water Electrolyzers," ACS Applied Materials & Interfaces, 2021, vol. 13, pp. 16182-16196.
Lobato, J. et al., "Study of the influence of the amount of PBI-H3PO4 in the catalytic layer of a high temperature PEMFC", International Journal of Hydrogen Energy, 2010, vol. 35, pp. 1347-1355.
Lu et al. "A selective and efficient electrocatalyst for carbon dioxide reduction," Nature communication, Jan. 30, 2014.
Ma, M., et al., "Insights into the Carbon Balance for C02 Electroreduction on Cu using Gas Diffusion Electrode Reactor Designs", Energy & Environmental Science, Feb. 12, 2020, vol. 13, pp. 977-985.
Maheswari, S. et al., "Oxygen Reduction Catalysts for Alkaline Polymer Electrolyte Fuel Cells", ECS Transactions, 2010, vol. 33, No. 1, pp. 1795-1807.
Mandal M., et al., "Improved Polymer Electrolyte Membrane Water Electrolyzer Performance by Using Carbon Black as a Pore Former in the Anode Catalyst Layer," Journal of Power Sources, 2022, vol. 541, pp. 1-13.
Mayerhofer B., et al., "Bipolar Membrane Electrode Assemblies for Water Electrolysis," ACS Applied Energy Materials, 2020, vol. 3, pp. 9635-9644.
McDonald M., et al., "Graphene Oxide as a Water Dissociation Catalyst in the Bipolar Membrane Interfacial Layer," ACS Applied Materials & Interfaces, 2014, vol. 6, pp. 13790-13797.
Morsy S., et al., "Role of Surfactants in Nanotechnology and Their Applications," International Journal of current Microbiology and Applied Sciences, 2014, vol. 3(5), pp. 237-260.
Narayanan, S.R., et al., "Electrochemical Conversion of Carbon Dioxide to Formate in Alkaline Polymer Electrolyte Membrane Cells," Journal of The Electrochemical Society, 2011, vol. 158, No. 2, pp. A167-A173.
Notice of Allowance dated Aug. 16, 2021, in U.S. Appl. No. 16/842,659.
Notice of Allowance issued in issued on Apr. 13, 2021, in U.S. Appl. No. 16/842,659.
Notice of Allowance issued in issued on Jan. 29, 2020, in U.S. Appl. No. 15/586,173.
Notice of Allowance issued on Sep. 16, 2020, in U.S. Appl. No. 15/586,182.
O'Brien, C.P. et al., Single Pass CO2 Conversion exceeding 85% in the Electrosynthesis of Multicarbon Products via Local CO2 Regeneration, ACS Energy Let., 2021, vol. 6, 21 pages.
Office Action issued in issued on Apr. 2, 2019, in U.S. Appl. No. 15/586,173.
Office Action issued in issued on Nov. 1, 2018, in U.S. Appl. No. 15/586,173.
Office Action issued in issued on Nov. 1, 2018, in U.S. Appl. No. 15/586,182.
Office Action issued in issued on Sep. 16, 2020, in U.S. Appl. No. 16/842,659.
Office Action issued on Dec. 30, 2019, in U.S. Appl. No. 15/586,182.
Office Action issued on Jul. 2, 2020, in U.S. Appl. No. 15/586,182.
Parrondo, J. et al., "Degradation of Anion Exchange Membranes Used for Hydrogen Production by Ultrapure Water Electrolysis," Including Supplemental Material, RSC Advances, 2014, vol. 4, 17 Pages.
Patru, A., et al., "Design Principles of Bipolar Electrochemical Co-Electrolysis Cells for Efficient Reduction of Carbon Dioxide from Gas Phase at Low Temperature," Journal of The Electrochemical Society, 166 (2), (2019), pp. F34-F43.
Phan C., et al., "Role of Capping Agent in Wet Synthesis of Nanoparticles," The Journal of Physical Chemistry A, 2017, vol. 121, pp. 3213-3219.
Pickup, P. et al., "Electronically Conducting Cation-exchange Polymer Powders: Synthesis, Characterization and Applications in PEM Fuel Cells and Supercapacitors", Journal of New Materials for Electrochemical Systems, 2000, vol. 3. pp. 21-26.
Preliminary Report on Patentability issued on Nov. 6, 2018, in PCT Application No. PCT/US2017/030936.
Sharma, et al., "Electrocatalytic conversion of carbon dioxide to fuels: a review on the interaction between CO2 and the liquid electrolyte," WIREs Energy Environ 2017, 6:e239. doi: 10.1002/wene.239, pp. 1-21.
Shi, L. et al., "A shorted membrane electrochemical cell powered by hydrogen to remove CO2 from the air feed of hydroxide exchange membrane fuel cells", Nature Energy, Mar. 2022, vol. 7, 36 pages.
U.S. Final office Action dated Nov. 21, 2022 in U.S. Appl. No. 17/247,036.
U.S. Non-Final office Action dated Jan. 20, 2023 in U.S. Appl. No. 16/949,538.
U.S. Non-Final Office Action dated Mar. 14, 2023 in U.S. Appl. No. 17/342,406.
U.S. Non-Final Office Action dated May 24, 2022, in U.S. Appl. No. 17/247,036.
U.S. Notice of Allowance dated Feb. 10, 2023 in U.S. Appl. No. 17/247,036.
U.S. Notice of Allowance dated Mar. 2, 2023 in U.S. Appl. No. 17/247,036.
U.S. Notice of Allowance dated Mar. 8, 2023 in U.S. Appl. No. 16/949,538.

(56) References Cited

OTHER PUBLICATIONS

U.S. Notice of Allowance dated May 22, 2023 in U.S. Appl. No. 16/949,538.
U.S. Appl. No. 17/030,172, inventors Kuhl et al., filed Sep. 23, 2020 .
U.S. Appl. No. 18/053,945, inventors Huo et al., filed Nov. 9, 2022.
U.S. Appl. No. 18/299,672, inventors Kuhl et al., filed Apr. 12, 2023.
U.S. Appl. No. 18/300,380, inventors Ziyang Huo et al., filed Apr. 13, 2023.
Varcoe, J.R., "Anion-exchange Membranes in Electrochemical Energy Systems," Energy & Environmental Science, 2014, vol. 7, pp. 3135-3191.
Verma, et al., "The effect of electrolyte composition on the electroreduction of CO2 to CO on Ag based gas diffusion electrodes," Phys. Chem. Chem. Phys., 2016, 18, pp. 7075—7084.
Voskian, S. et al., "Faradaic electro-swing reactive adsorption for $CO_2$ capture", Energy & Environmental Science, 2019, vol. 12, pp. 3530-3547.
Wang, et al., "Approaches for the preparation of non-linear amphiphilic polymers and their applications to drug delivery", Advanced Drug Delivery Reviews, 2012, vol. 64, pp. 852-865.
Xia, Chuan, et al., "Continuous production of pure liquid fuel solutions via electrocatalytic CO2 reduction using solid electrolyte devices," Nature Energy, http://www.nature.com/natureenergy ; https://doi.org/10.1038/s41560-019-0451-x.
Xu, C. et al., Preparation of PVA-GA-CS/PVA-Fe-SA Bipolar Membrane and Its Application in Electro-generation of 2,2-dimethyl-3-hydroxypropionic Acid, Journal of Membrane Science, vol. 307, No. 2, Jan. 2008, pp. 218-224.
Yang, B. et al., "Preparation of a Bipolar Membrane by Photografting Polymerization", Frontiers of Chemistry in China, vol. 3, No. 1, Jan. 2008, pp. 10-13.
Zhan, et al., "Multiarm Star Poly(epsilon-caprolactone) with Hyperbranched Polyamidoamine as Core Capable of Selective Accommodating Cationic or Anionic Guests", Chinese Journal of Polymer Science, 2015. vol. 33, No. 6, pp. 920-930.
Zheng, et al., "Hyperbranched polymers: advances from synthesis to applications", Chemical Society Reviews, 2015, vol. 44, pp. 4091-4130.
Zhu, Wenlei et al., "Active and Selective Conversion of CO2 to CO on Ultrathin Au Nanowires," Journal of American Chemical Society, 2014, 136, pp. 16132-16135.
EP office action dated May 23, 2023, in application No. EP21152137.2.
Gao, M., et al., "The Role of Adsorbed Oleylamine on Gold Catalysts During Synthesis for Highly Selective Electrocatalytic Reduction of CO2 to CO," The Royal Society of Chemistry, 2020, vol. 56, pp. 7021-7024.
Kortlever R., et al., "Catalysts and Reaction Pathways for the Electrochemical Reduction of Carbon Dioxide," The Journal of Physical Chemistry Letters, 2015, vol. 6(20), pp. 4073-4082.
SA Office Action dated Sep. 26, 2023, in application No. SA522441684 with English Translation.
Shironita S., et al., "Methanol Generation by Co2 Reduction at a Pt-ru/c Electrocatalyst Using a Membrane Electrode Assembly," Journal of Power Sources, Oct. 2013, vol. 240(15), pp. 404-410.
U.S. Final Office Action dated Aug. 30, 2023, in U.S. Appl. No. 17/342,406.
U.S. Non-Final Office Action dated Aug. 15, 2023, in U.S. Appl. No. 18/328,524.
U.S. Appl. No. 18/306,928, inventors Kendra P. Kuhl et al., filed Apr. 25, 2023.
U.S. Appl. No. 18/328,524, inventors Wu, Y., et al., filed Jun. 2, 2023.
Li, X. et al., "Impact of Alkali Metal Cations and Iron Impurities on the Evolution of Hydrogen on Cu Electrodes in Alkaline Electrolytes," J. Electrochem. Soci., 2020 167 106505, 8 pages.
Staerz, A. F., et al., "Effects of Iron Species on Low Temperature CO2 Electrolyzers," Angew. Chem. Int. Ed. 2023, e202306503, doi.org/10.1002/anie.202306503, 22 pages.
Kim, C., et al. "Turning Harmful Deposition of Metal Impurities into Activation of Nitrogen-Doped Carbon Catalyst toward Durable Electrochemical $CO_2$ Reduction," ACS Energy Lett. 2019, vol. 4, pp. 2343-2350.
International Preliminary Report on Patentability and Written Opinion dated May 23, 2024 in PCT Application No. PCT/US2022/079570.
International Search Report and Written Opinion dated Apr. 26, 2024 in PCT Application No. PCT/US2023/075864.
International Search Report and Written Opinion dated May 6, 2024 in PCT Application No. PCT/US2022/081209.
Invitation to Pay Additional Fees dated May 28, 2024 in PCT Application No. PCT/US2023/085244.
JP Office Action dated Feb. 6, 2024 in JP Application No. 2022-187975, with English Translation.
Pappijn, C., et al., "Challenges and Opportunities of Carbon Capture and Utilization: Electrochemical Conversion of CO2 to Ethylene," Original research, 2020, vol. 8, pp. 1-12.
Rucareanu S., et al., 4-(N,N-Dimethylamino)pyridine-Protected Au Nanoparticles: Versatile Precursors for Water and Organic-Soluble Gold Nanoparticles, Chem. Mater, 2006, vol. 18, pp. 4674-4680.
Seo M.H., et al., "Synthesis, Characterization, and Electrocatalytic Properties of a Polypyrrole-composited Pd/C Catalyst," International Journal of Hydrogen Energy, 2011, vol. 36(18), pp. 11545-11553.
Sturman, M., et al., "Process Parameters in the Electrochemical Reduction of Carbon Dioxide to Ethylene," ChemBioEng, 2021, vol. 8(3), pp. 149-188.
U.S. Final Office Action dated Mar. 12, 2024 in U.S. Appl. No. 18/328,524.
U.S. Final Office Action dated Mar. 21, 2024 in U.S. Appl. No. 18/300,380.
U.S. Non-Final Office Action dated Jan. 19, 2024 in U.S. Appl. No. 17/303,329.
U.S. Non-Final Office Action dated Jan. 19, 2024 in U.S. Appl. No. 18/306,928.
U.S. Non-Final Office Action dated Jan. 22, 2024 in U.S. Appl. No. 17/369,952.
U.S. Non-Final Office Action dated Jan. 23, 2024 in U.S. Appl. No. 18/299,672.
Xie K., et al., "Bipolar Membrane Electrolyzers Enable High Single Pass $CO_2$ Electroreduction to Multicarbon Products," Nature Communications 2022, vol. 13 (1), pp. 1-13.
AE Examination Report dated Sep. 3, 2024 in AE Application No. P6001035/2021.
AE Search Report and Examination Report dated Jun. 20, 2024 in AE Application No. P6000880 /2021.
AU Examination Report dated Nov. 14, 2024, in AU Application No. 20190401616.
Australian Examination Report dated Oct. 22, 2024, in AU Application No. 2019386085.
BR Office Action and Search Report dated Sep. 11, 2024 in BR Application No. 112022010144-9, with English Translation.
BR Office Action dated Aug. 15, 2023, in Application No. BR1120210103686 with English translation.
BR Office Action dated Jul. 7, 2023, in Application No. BR112021011768-7 with English Translation.
Bui, J., et al., "Engineering Catalyst-electrolyte Microenvironments to Optimize the Activity and Selectivity for the Electrochemical Reduction of Co2 on Cu and Ag," Accounts of Chemical Research, 2022, vol. 55(4), pp. 484-494.
CA Office Action dated Feb. 28, 2024 in CA Application No. 3120748.
Casebolt, R., et al., "Effect of Electrolyte Composition and Concentration on Pulsed Potential Electrochemical CO2 Reduction," ChemElectroChem, Chemistry Europe, Accepted Manuscript, 25 pp.
CN Notice of Allowance dated Jun. 28, 2024 in CN Application No. 201980090689.2 with English Translation.

(56) References Cited

OTHER PUBLICATIONS

CN Office Action dated Jun. 27, 2024 in CN Application No. 201980086718.8 with English translation.
IN Examination Report dated Dec. 5, 2022, in Application No. 202117030935 with English Translation.
IN Office Action dated Jan. 31, 2023 in Application No. IN202117028812.
International Preliminary Report on Patentability and Written Opinion dated Jun. 20, 2024 in PCT Application No. PCT/US2022/081209.
International Preliminary Report on Patentability dated Jun. 10, 2021 in Application No. PCT/US2019/063471.
International Preliminary Report on Patentability dated Sep. 7, 2023, in PCT Application No. PCT/US2022/070797.
International Search Report and Written Opinion dated Jul. 19, 2024 in PCT Application No. PCT/US2023/085244.
International Search Report and Written Opinion dated Jun. 29, 2022, in PCT Application No. PCT/US2022/070797.
International Search Report and Written Opinion issued on Apr. 8, 2020, in PCT Application No. PCT/US2019/067169.
International Search Report and Written Opinion issued on Mar. 19, 2020, in PCT Application No. PCT/US2019/063471.
JP Office Action dated Dec. 5, 2023 in JP Application No. 2021-528976 with English translation.
JP Office Action dated Feb. 27, 2024, in JP Application No. 2021-534155, with English Translation.
JP Office Action dated Nov. 5, 2024 in JP Application No. 2021-534155 with English translation.
JP Office Action dated Oct. 29, 2024 in JP Application No. 2022-187975 with English translation.
JP Office Action dated Sep. 5, 2023, in Application No. JP2021-528976 with English translation.
JP Office Action dated Sep. 5, 2023, in Application No. JP2021-534155 with English translation.
Kaczur, J., et al., "A Review of the Use of Immobilized Ionic Liquids in the Electrochemical conversion of CO2," Journal of Carbon Research, ,2020 6, 33, 12 pages.
Kim, C., et al., "Impact of Pulsed Electrochemical Reduction of CO2 on the formation of C2+ Products over Cu," ACS Catal., 2020, 10, 12403-12413.
Kimura, K.W., et al., "Selective Electrochemical CO2 Reduction During Pulsed Potential Stems From Dynamic Interface," ACS Catalysis, ACS Paragon Plus Environment, University of Illinois at Urbana-Champaign, Downloaded from pubs.acs.org on Jun. 30, 2020, 31 pages.
KR Office Action dated Oct. 16, 2024 in KR Application No. 10-2021-7019873 with English Translation.
KR Office Action dated Sep. 26, 2024 in KR Application No. 10-2021-7022695 with English Translation.
Kutz, R. et al., Sustainion Imidazolium-Functionalized Polymers for Carbon Dioxide Electrolysis, Energy Technology, 2017, 5, pp. 929-936.
Nakashima T., et al., "Preparation of Fusion Materials Based on Ionic Liquids and Cationic Gold Nanoparticles", Polymer Journal, 2015, vol. 47, pp. 171-176.
Ren, D., et al., "Selective Electrochemical Reduction of Carbon Dioxide to Ethylene and Ethanol on Copper(I) Oxide Catalysts," ACS Catal., 2015, 5, pp. 2814-2821.
Ren D., et al., "The Effects of Currents and Potentials on the Selectivities of Copper Toward Carbon Dioxide Electroreduction," Nature Communication, 2018, 9:925, pp. 1-8.
SA Examination Report dated Aug. 8, 2023, in Application No. 521422124 with English Translation.
SA Examination Report dated Feb. 6, 2024, in SA Application No. 521422124, with English Translation.
SA Examination Report dated Jun. 22, 2023, in Application No. 521422291 with English Translation.
SA Office Action dated Sep. 16, 2024 in SA Application No. 524452150 with English translation.
Salvatore, D., et al. "Electrolysis of Gaseous Co2 to CO in a Flow Cell with a Bipolar Memberane," ACS Energy Letters, 2018, 3, pp. 149-154.
Sharretts Plating Company. "What is Electrocleaning?" . . . Https://www.sharrettsplating.com/blog/what-is-electrocleaning/. Jul. 12, 2017, 3 pages.
U.S. Notice of Allowance dated Jul. 7, 2022 in U.S. Appl. No. 16/719,359.
U.S. Corrected Notice of Allowability dated Dec. 30, 2021, in U.S. Appl. No. 16/719,359.
U.S. Corrected Notice of Allowance dated Jan. 9, 2023 in U.S. Appl. No. 16/697,066.
U.S. Corrected Notice of Allowance dated Mar. 19, 2024 in U.S. Appl. No. 18/145,702.
U.S. Final Office Action dated Jul. 17, 2024 in U.S. Appl. No. 17/303,329.
U.S. Final Office Action dated Jul. 18, 2024 in U.S. Appl. No. 18/306,928.
U.S. Final Office Action dated Sep. 10, 2024 in U.S. Appl. No. 18/299,672.
U.S. Non Final Office Action dated Feb. 23, 2022 in U.S. Appl. No. 16/697,066.
U.S. Non Final Office Action dated Mar. 30, 2023 for U.S. Appl. No. 17/662,225.
U.S. Non-Final Office Action dated Jul. 5, 2024 in U.S. Appl. No. 17/369,952.
U.S. Non-Final Office Action dated Jul. 25, 2024 in U.S. Appl. No. 18/328,524.
U.S. Non-Final Office Action dated Jun. 17, 2024 in U.S. Appl. No. 17/342,406.
U.S. Non-Final Office Action dated Nov. 5, 2024 in U.S. Appl. No. 17/652,255.
U.S. Non-Final Office Action dated Nov. 8, 2023 in U.S. Appl. No. 18/145,702.
U.S. Non-Final Office Action dated Oct. 31, 2024 in U.S. Appl. No. 18/300,380.
U.S Notice of Allowance dated Dec. 21, 2021, in U.S. Appl. No. 16/719,359.
U.S. Notice of Allowance dated Mar. 6, 2024 in U.S. Appl. No. 18/145,702.
U.S. Notice of Allowance dated Mar. 25, 2022 in U.S. Appl. No. 16/719,359.
U.S. Notice of Allowance dated May 17, 2023 in U.S. Appl. No. 17/662,225.
U.S. Notice of Allowance dated Nov. 14, 2024 in U.S. Appl. No. 17/303,329.
U.S. Notice of Allowance dated Sep. 18, 2023, in U.S. Appl. No. 17/662,225.
U.S. Notice of Allowance dated Sep. 29, 2022 in U.S. Appl. No. 16/697,066.
U.S. Restriction Requirement dated Apr. 26, 2024 in U.S. Appl. No. 17/652,255.
U.S. Restriction Requirement dated Oct. 29, 2021, in U.S. Appl. No. 16/697,066.
Weekes, D.M., et al., "Electrolytic CO2 Reduction in a Flow Cell", Accounts of Chemical Research, 2018, vol. 51, No. 4, pp. 910-918.
Xu, Y., et al., "Self-Cleaning CO2 Reduction Systems: Unsteady Electrochemical Forcing Enables Stability," ACS Energy Letters, 2021, 6, pp. 809-815.

* cited by examiner

INTERFACE FOR CARBON OXIDE ELECTROLYZER BIPOLAR MEMBRANE

INCORPORATION BY REFERENCE

An Application Data Sheet is filed concurrently with this specification as part of the present application. Each application that the present application claims benefit of or priority to as identified in the concurrently filed Application Data Sheet is incorporated by reference herein in their entireties and for all purposes.

BACKGROUND

Anthropogenic carbon dioxide emissions have been linked to climate change. In response to increasing concerns about global greenhouse gas emissions, technologies that can recycle $CO_2$ into high-value products have received growing interest.

Electrochemical reduction of $CO_x$ (such as $CO_2$, CO, or combinations thereof) combines just three inputs: $CO_x$, a source of protons and electricity. These inputs are converted into fuels, chemicals and other products such as methanol, ethanol, carbon monoxide and acetic acid. However, industrial scale electrochemical reactions have been difficult to achieve, in part due to lack of suitable reactors. One issue to be addressed is the potential variability or unreliability of a power source. Interruptions due to power outages or planned shutdowns for maintenance and recovery processes may lead to deterioration of an electrochemical reactor's components. A robust electrochemical reactor that can withstand electrical fluctuations would therefore be advantageous.

The background description provided herein is for the purpose of generally presenting the context of the disclosure. Work of the presently named inventors, to the extent it is described in this background section, as well as aspects of the description that may not otherwise qualify as art at the time of filing, are neither expressly or impliedly admitted as prior art against the present disclosure.

SUMMARY

Provided herein are membrane electrode assemblies (MEAs) for carbon oxide reduction. According to various embodiments, the MEAs are configured to address challenges particular to $CO_x$ including mitigating the deleterious effects of electrical current fluctuations on the MEA. Bipolar membrane MEAs equipped with an interface region that reduces or prevents these effects are described.

Accordingly, in a first aspect, the present disclosure encompasses a membrane electrode assembly. In some embodiments, the membrane electrode assembly includes a cathode catalyst layer; an anode catalyst layer; and a bipolar membrane disposed between the cathode catalyst layer and the anode catalyst layer, where the bipolar membrane includes an anion-conducting polymer layer, a cation-conducting polymer layer, and an interface region between the anion-conducting polymer layer and the cation-conducting polymer layer, and where the interface region includes nanoparticles.

In some embodiments, the interface region is from about 1 to 10 micrometers thick.

In some embodiments, the interface region is from about 1 to about 5 micrometers thick.

In some embodiments, a ratio of a thickness of the anion-conducting polymer layer to the thickness of the interface region is at least 10:1.

In some embodiments, the nanoparticles are carbon nanoparticles or magnesium oxide nanoparticles.

In some embodiments, the interface region also includes an ion-conducting polymer.

In some embodiments, the nanoparticles are iridium, platinum, titanium or gold.

In some embodiments, the cation-conducting polymer layer is disposed between the anode catalyst layer and the anion-conducting polymer layer.

In some embodiments, the cathode catalyst layer includes a reduction catalyst and an anion-conducting polymer.

In some embodiments, the anode catalyst layer includes an oxidation catalyst and a cation-conducting polymer.

In a second aspect, the present disclosure encompasses a $CO_x$ reduction reactor. In some embodiments, the membrane electrode assembly includes a cathode catalyst layer having a catalyst configured for reduction of $CO_x$; an anode catalyst layer; and a bipolar membrane disposed between the cathode catalyst layer and the anode catalyst layer, where the bipolar membrane includes an anion-conducting polymer layer, a cation-conducting polymer layer, and an interface region between the anion-conducting polymer layer and the cation-conducting polymer layer, and where the interface region includes nanoparticles.

In some embodiments, the interface region is from about 1 to 10 micrometers thick.

In some embodiments, the interface region is from about 1 to about 5 micrometers thick.

In some embodiments, a ratio of a thickness of the anion-conducting polymer layer to the thickness of the interface region is at least 10:1.

In some embodiments, the nanoparticles are carbon nanoparticles or magnesium oxide nanoparticles.

In some embodiments, the interface region also includes an ion-conducting polymer.

In some embodiments, the nanoparticles include iridium, platinum, titanium or gold.

In some embodiments, the cation-conducting polymer layer is disposed between the anode catalyst layer and the anion-conducting polymer layer.

In some embodiments, the cathode catalyst layer also includes an anion-conducting polymer.

In some embodiments, the anode catalyst layer includes an oxidation catalyst and a cation-conducting polymer.

In some embodiments, the $CO_x$ reduction reactor is a carbon dioxide reduction reactor.

In a third aspect, the present disclosure encompasses a method of electrochemically reducing $CO_x$. In some embodiments, the method includes providing a carbon oxide to a $CO_x$ reduction reactor, and electrochemically reducing the carbon oxide at a cathode of a $CO_x$ electrolyzer to produce a carbon containing product, where the $CO_x$ reduction reactor includes a membrane electrode assembly having a cathode catalyst layer; an anode catalyst layer; and a bipolar membrane disposed between the cathode catalyst layer and the anode catalyst layer, where the bipolar membrane includes an anion-conducting polymer layer, a cation-conducting polymer layer, and an interface region between the anion-conducting polymer layer and the cation-conducting polymer layer, and where the interface region includes nanoparticles.

In some embodiments, the $CO_x$ reduction reactor is subjected to electrical current fluctuations.

In some embodiments, the electrical current fluctuations result from a recovery process, a power interruption, a current reversal, or a power outage.

In some embodiments, the carbon oxide is carbon dioxide.

In some embodiments, the carbon containing product is carbon monoxide, a hydrocarbon, formic acid, an alcohol, or a combination thereof.

In some embodiments, the interface region is from about 1 to 10 micrometers thick.

In some embodiments, the interface region is from about 1 to about 5 micrometers thick.

In some embodiments, a ratio of a thickness of the anion-conducting polymer layer to the thickness of the interface region is at least 10:1.

In some embodiments, the nanoparticles are carbon nanoparticles or magnesium oxide nanoparticles.

In some embodiments, the interface region also includes an ion-conducting polymer.

In some embodiments, the nanoparticles include iridium, platinum, titanium, or gold.

In some embodiments, the cation-conducting polymer layer is disposed between the anode catalyst layer and the anion-conducting polymer layer.

In some embodiments, the anion-conducting polymer layer is disposed between the cathode catalyst layer and the cation-conducting polymer layer.

In some embodiments, the cathode catalyst layer includes a reduction catalyst and an anion-conducting polymer.

In some embodiments, the anode catalyst layer includes an oxidation catalyst and a cation-conducting polymer.

In a fourth aspect, the present disclosure encompasses a membrane electrode assembly. In some embodiments, the membrane electrode assembly includes a cathode catalyst layer; an anode catalyst layer; and a bipolar membrane disposed between the cathode catalyst layer and the anode catalyst layer, where the bipolar membrane includes an anion-conducting polymer layer, a cation-conducting polymer layer, and an interface region between the anion-conducting polymer layer and the cation-conducting polymer layer, where the interface region includes an ion-conducting polymer layer and nanoparticles dispersed in the ion-conducting polymer layer.

In some embodiments, the ion-conducting polymer layer includes a sulfonated fluoropolymer.

In some embodiments, the sulfonated fluoropolymer is a sulfonated tetrafluoroethylene-based fluoropolymer copolymer.

In some embodiments, the nanoparticles are carbon nanoparticles.

In some embodiments, the interface region is from about 1 to 10 micrometers thick.

In some embodiments, the interface region is from about 1 to about 5 micrometers thick.

In some embodiments, a ratio of an ion-conducting polymer in the ion-conducting polymer layer to carbon nanoparticles is from about 2:1 to about 1:0.1 weight percent.

In some embodiments, a ratio of an ion-conducting polymer in the ion-conducting polymer layer to carbon nanoparticles is about 1:1 weight percent.

In some embodiments, a ratio of a thickness of the anion-conducting polymer layer to the thickness of the interface region is at least 10:1.

In some embodiments, the cation-conducting polymer layer is disposed between the anode catalyst layer and the anion-conducting polymer layer.

In some embodiments, the anion-conducting polymer layer is disposed between the cathode catalyst layer and the cation-conducting polymer layer.

In some embodiments, the cathode catalyst layer includes a reduction catalyst and an anion-conducting polymer.

In some embodiments, the ion-conducting polymer in the interface region is the same polymer as the cation-conducting polymer in the cation-conducting polymer layer.

In some embodiments, the ion-conducting polymer in the interface region is the same polymer as the anion-conducting polymer in the anion-conducting polymer layer.

In some embodiments, the interface region includes an anion-conducting polymer and a cation-conducting polymer.

In some embodiments, the ion-conducting polymer in the interface region is a different cation-conducting polymer than the cation-conducting polymer in the cation-conducting polymer layer.

In some embodiments, the ion-conducting polymer in the interface region is a different anion-conducting polymer than the anion-conducting polymer in the anion-conducting polymer layer.

These and other aspects of the disclosure are discussed further below with reference to the drawings.

DETAILED DESCRIPTION

Figure 1:
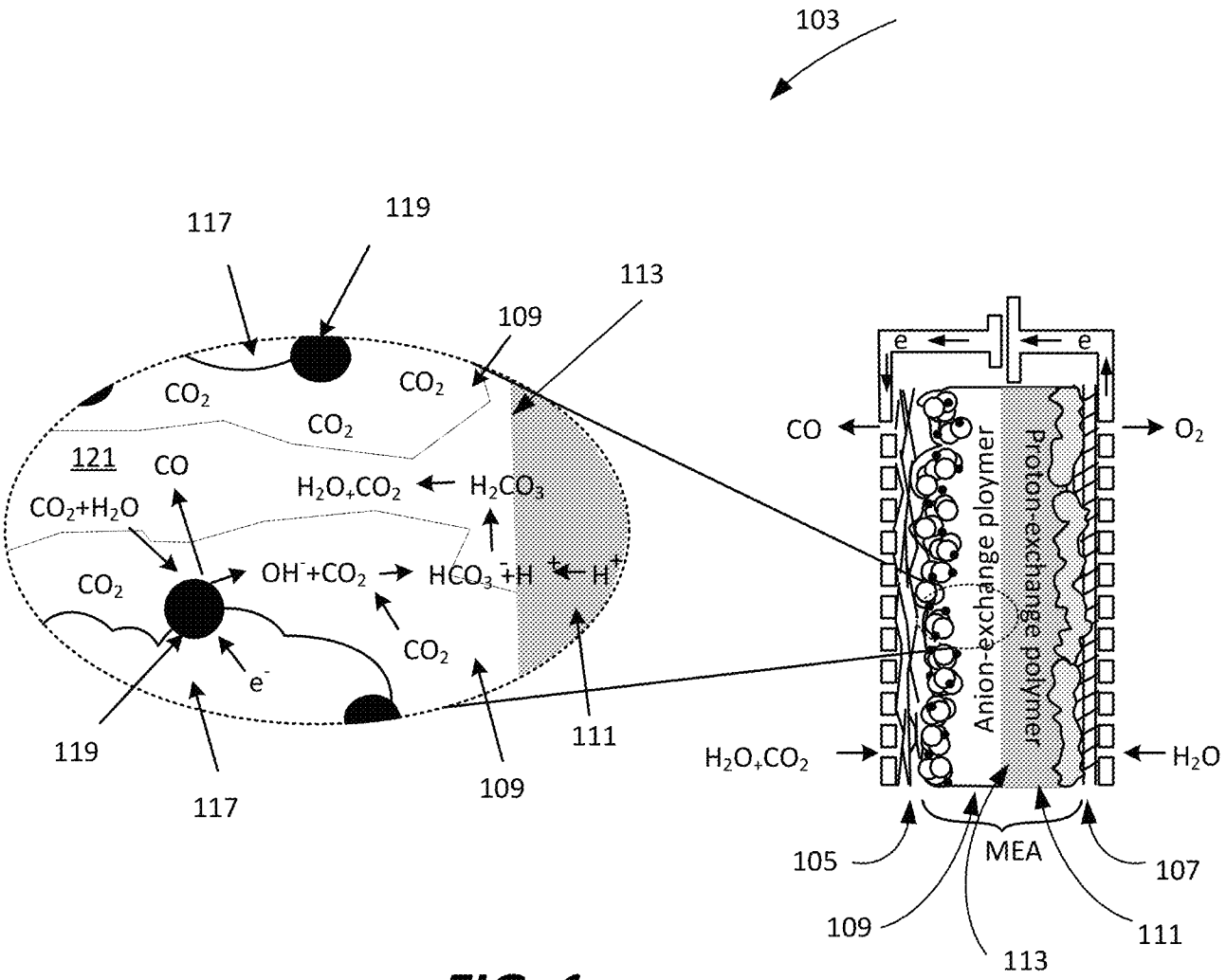
FIG. 1 is a schematic illustration of a carbon dioxide ($CO_2$) electrolyzer configured to receive water and $CO_2$ (e.g., humidified or dry gaseous $CO_2$) as a reactant at a cathode and expel carbon monoxide (CO) as a product in accordance with certain disclosed embodiments.

In the following description, numerous specific details are set forth to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

Definitions

As used herein, the term "about" is understood to account for minor increases and/or decreases beyond a recited value, which changes do not significantly impact the desired function the parameter beyond the recited value(s). In some cases, "about" encompasses +/−10% of any recited value. As used herein, this term modifies any recited value, range of values, or endpoints of one or more ranges.

As used herein, the terms "top," "bottom," "upper," "lower," "above," and "below" are used to provide a relative relationship between structures. The use of these terms does not indicate or require that a particular structure must be located at a particular location in the apparatus.

An "electrochemical cell" includes electrolyzers such as $CO_2$ electrolyzers and water electrolyzers. It also includes some forms of $CO_2$ purifiers, particularly those that employ faradaic reactions at an anode and/or a cathode.

A "carbon oxide" ($CO_x$) includes carbon dioxide ($CO_2$), carbon monoxide (CO), carbonate ions ($CO_3^{2-}$), bicarbonate ions ($HCO_3^-$), and any combinations thereof.

A "mixture" contains two or more components and unless otherwise stated may contain components other than the identified components.

A "porosity enhancing agent" is a substance that increases void space in a layer or network. A porosity enhancing agent can increase void space in a polymeric membrane layer.

A "voltage damping agent" is an agent that reduces voltage increase that occurs after current decrease and/or shutoff of a carbon dioxide reduction reactor.

An "ion-conducting polymer" is used herein to describe a polymer electrolyte having greater than about 1 mS/cm specific conductivity for anions and/or cations.

The terms "micrometers" and "microns" and the abbreviations "μm" and "um" are used interchangeably to mean microns. Unless otherwise noted, ranges described herein (e.g., 10 micrometers to 20 micrometers, 0.25-127, between 1 and 90%, etc.) include the endpoints of those ranges.

Introduction and Context

A membrane electrode assembly (MEA) is described here. It may be used in a $CO_x$ reduction reactor. $CO_x$ may be carbon dioxide ($CO_2$), carbon monoxide (CO), $CO_3^{2-}$ (carbonate ion), $HCO_3^-$ (bicarbonate ion), or combinations thereof. The MEA contains an anode layer, a cathode layer, electrolyte, and optionally one or more other layers. The layers may be solids and/or soft materials. The layers may include polymers such as ion-conducting polymers.

When in use, the cathode of an MEA promotes electrochemical reduction of $CO_x$ by combining three inputs: $CO_x$, ions (e.g., protons) that chemically react with $CO_x$, and electrons. The reduction reaction may produce CO, hydrocarbons, and/or oxygen and hydrogen containing organic compounds such as methanol, ethanol, and acetic acid. When in use, the anode of an MEA promotes an electrochemical oxidation reaction such as electrolysis of water to produce elemental oxygen and protons. The cathode and anode may each contain catalysts to facilitate their respective reactions.

The compositions and arrangements of layers in the MEA may promote high yield of a $CO_x$ reduction products. To this end, the MEA may facilitate any one or more of the following conditions: (a) minimal parasitic reduction reactions (non-$CO_x$ reduction reactions) at the cathode; (b) low loss of $CO_x$ reactants at anode or elsewhere in the MEA; (c) maintain physical integrity of the MEA during the reaction (e.g., prevent delamination of the MEA layers); (d) prevent $CO_x$ reduction product cross-over; (e) prevent oxidation production (e.g., $O_2$) cross-over; (f) maintain a suitable environment at the cathode/anode for oxidation/reduction as appropriate; (g) provide pathway for desired ions to travel between cathode and anode while blocking undesired ions; and (h) minimize voltage losses.

COx Reduction Specific Problems

Polymer-based membrane assemblies such as MEAs have been used in various electrolytic systems such as water electrolyzers and in various galvanic systems such as fuel cells. However, $CO_x$ reduction presents problems not encountered, or encountered to a lesser extent, in water electrolyzers and fuel cells.

For example, for many applications, an MEA for $CO_x$ reduction requires a lifetime on the order of about 50,000 hours or longer (approximately five years of continuous operation), which is significantly longer than the expected lifespan of a fuel cell for automotive applications; e.g., on the order of 5,000 hours. Additionally, for various applications a MEA for $CO_x$ reduction employs electrodes having a relatively large geometric surface area by comparison to MEAs used for fuel cells in automotive applications. For example, MEAs for $CO_x$ reduction may employ electrodes having geometric surface areas (without considering pores and other nonplanar features) of at least about 500 $cm^2$.

$CO_x$ reduction reactions may be implemented in operating environments that facilitate mass transport of particular reactant and product species, as well as to suppress parasitic reactions. Fuel cell and water electrolyzer MEAs often cannot produce such operating environments. For example, such MEAs may promote undesirable parasitic reactions such as gaseous hydrogen evolution at the cathode and/or gaseous $CO_2$ production at the anode.

In some systems, the rate of a $CO_x$ reduction reaction is limited by the availability of gaseous $CO_x$ reactant at the cathode. By contrast, the rate of water electrolysis is not significantly limited by the availability of reactant:liquid water tends to be easily accessible to the cathode and anode, and electrolyzers can operate close to highest current density possible.

Mea Configurations

MEA General Arrangement

In certain embodiments, an MEA has a cathode layer, an anode layer, and a polymer electrolyte membrane (PEM) between the anode layer and the cathode layer. The polymer electrolyte membrane provides ionic communication between the anode layer and the cathode layer, while preventing electronic communication, which would produce a short circuit. The cathode layer includes a reduction catalyst and a first ion-conducting polymer. The cathode layer may also include an ion conductor and/or an electron conductor. The anode layer includes an oxidation catalyst and a second ion-conducting polymer. The anode layer may also include an ion conductor and/or an electron conductor. The PEM includes a third ion-conducting polymer.

In certain embodiments, the MEA has a cathode buffer layer between the cathode layer and the polymer electrolyte membrane. The cathode buffer includes a fourth ion-conducting polymer.

In certain embodiments, the MEA has an anode buffer layer between the anode layer and the polymer electrolyte membrane. The anode buffer includes a fifth ion-conducting polymer.

In connection with certain MEA designs, there are three available classes of ion-conducting polymers: anion-conductors, cation-conductors, and mixed cation-and-anion-conductors. In certain embodiments, at least two of the first, second, third, fourth, and fifth ion-conducting polymers are from different classes of ion-conducting polymers.

Conductivity and Selectivity of Ion-Conducting Polymers for MEA Layers

The term "ion-conducting polymer" is used herein to describe a polymer electrolyte having greater than about 1 mS/cm specific conductivity for anions and/or cations. The term "anion-conductor" describes an ion-conducting polymer that conducts anions primarily (although there will still be some small amount of cation conduction) and has a transference number for anions greater than about 0.85 at around 100 micron thickness. The terms "cation-conductor" and/or "cation-conducting polymer" describe an ion-conducting polymer that conducts cations primarily (e.g., there can still be an incidental amount of anion conduction) and has a transference number for cations greater than approximately 0.85 at around 100 micron thickness. For an ion-conducting polymer that is described as conducting both anions and cations (a "cation-and-anion-conductor"), neither the anions nor the cations has a transference number greater than approximately 0.85 or less than approximately 0.15 at around 100 micron thickness. To say a material conducts ions (anions and/or cations) is to say that the material is an ion-conducting material or ionomer. Examples of ion-conducting polymers of each class are provided in the table below.

Ion-Conducting Polymers

| Class | Description | Common Features | Examples |
|---|---|---|---|
| A. Anion-conducting | Greater than approximately 1 mS/cm specific conductivity for anions, which have a transference number greater than approximately 0.85 at around 100 micron thickness | Positively charged functional groups are covalently bound to the polymer backbone | aminated tetramethyl polyphenylene; poly(ethylene-co-tetrafluoroethylene)-based quaternary ammonium polymer; quaternized polysulfone |
| B. Conducts both anions and cations | Greater than approximately 1 mS/cm conductivity for ions (including both cations and anions), which have a transference number between approximately 0.15 and 0.85 at around 100 micron thickness | Salt is soluble in the polymer and the salt ions can move through the polymer material | polyethylene oxide; polyethylene glycol; poly(vinylidene fluoride); polyurethane |
| C. Cation-conducting | Greater than approximately 1 mS/cm specific conductivity for cations, which have a transference number greater than approximately 0.85 at around 100 micron thickness | Negatively charged functional groups are covalently bound to the polymer backbone | perfluorosulfonic acid polytetrafluoroethylene co-polymer; sulfonated poly(ether ketone); poly(styrene sulfonic acid-co-maleic acid) |

Some Class A ion-conducting polymers are known by tradenames such as 2259-60 (Pall RAI), AHA by Tokuyama Co, Fumasep® FAA—(fumatech GbbH), Sustanion®, Morgane ADP by Solvay, or Tosflex® SF-17 by Tosoh anion exchange membrane material. Further class A ion-conducting polymers include HNN5/HNN8 by Ionomr, FumaSep by Fumatech, TM1 by Orion, and PAP-TP by W7energy. Some Class C ion-conducting polymers are known by tradenames such as various formulations of Nafion® (DuPont™), GORE-SELECT® (Gore), Fumapem® (fumatech GmbH), and Aquivion® PFSA (Solvay).

Polymeric Structures

Examples of polymeric structures that can include an ionizable moiety or an ionic moiety and be used as ion-conducting polymers in the MEAs described here are provided below. The ion-conducting polymers may be used as appropriate in any of the MEA layers that include an ion-conducting polymer. Charge conduction through the material can be controlled by the type and amount of charge (e.g., anionic and/or cationic charge on the polymeric structure) provided by the ionizable/ionic moieties. In addition, the composition can include a polymer, a homopolymer, a copolymer, a block copolymer, a polymeric blend, other polymer-based forms, or other useful combinations of repeating monomeric units. As described below, an ion conducting polymer layer may include one or more of crosslinks, linking moieties, and arylene groups according to various embodiments. In some embodiments, two or more ion conducting polymers (e.g., in two or more ion conducting polymer layers of the MEA) may be crosslinked.

Non-limiting monomeric units can include one or more of the following:

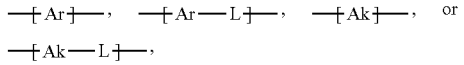

in which Ar is an optionally substituted arylene or aromatic; Ak is an optionally substituted alkylene, haloalkylene, aliphatic, heteroalkylene, or heteroaliphatic; and L is a linking moiety (e.g., any described herein) or can be —C($R^7$)($R^8$)—. Yet other non-limiting monomeric units can include optionally substituted arylene, aryleneoxy, alkylene, or combinations thereof, such as optionally substituted (aryl)(alkyl)ene (e.g., -Ak-Ar— or -Ak-Ar-Ak- or —Ar-Ak-, in which Ar is an optionally substituted arylene and Ak is an optionally substituted alkylene). One or more monomeric units can be optionally substituted with one or more ionizable or ionic moieties (e.g., as described herein).

One or more monomeric units can be combined to form a polymeric unit. Non-limiting polymeric units include any of the following:

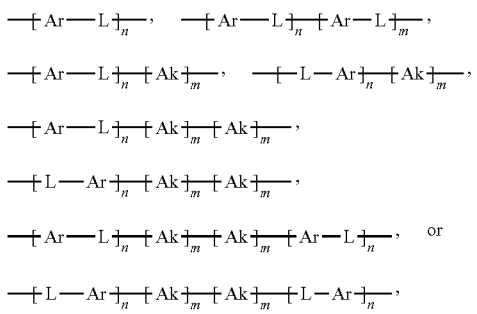

in which Ar, Ak, L, n, and m can be any described herein. In some embodiments, each m is independently 0 or an integer of 1 or more. In other embodiments, Ar can include two or more arylene or aromatic groups.

Other alternative configurations are also encompassed by the compositions herein, such as branched configurations, diblock copolymers, triblock copolymers, random or statistical copolymers, stereoblock copolymers, gradient copolymers, graft copolymers, and combinations of any blocks or regions described herein.

Examples of polymeric structures include those according to any one of formulas (I)-(V) and (X)-(XXXIV), or a salt thereof. In some embodiments, the polymeric structures are copolymers and include a first polymeric structure selected from any one of formulas (I)-(V) or a salt thereof; and a second polymeric structure including an optionally substituted aromatic, an optionally substituted arylene, a structure selected from any one of formulas (I)-(V) and (X)-(XXXIV), or a salt thereof.

In one embodiment, the MW of the ion-conducting polymer is a weight-average molecular weight (Mw) of at least 10,000 g/mol; or from about 5,000 to 2,500,000 g/mol. In another embodiment, the MW is a number average molecular weight (Mn) of at least 20,000 g/mol; or from about 2,000 to 2,500,000 g/mol.

In any embodiment herein, each of n, n1, n2, n3, n4, m, m1, m2, or m3 is, independently, 1 or more, 20 or more, 50 or more, 100 or more; as well as from 1 to 1,000,000, such as from 10 to 1,000,000, from 100 to 1,000,000, from 200 to 1,000,000, from 500 to 1,000,000, or from 1,000 to 1,000,000.

Non-limiting polymeric structures can include the following:

(I)

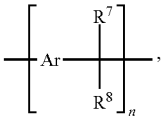

(II)

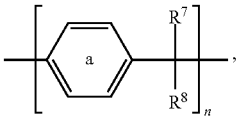

(III)

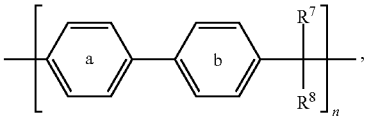

(IV)

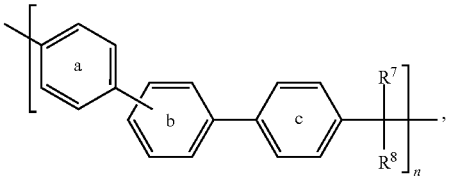

(V)

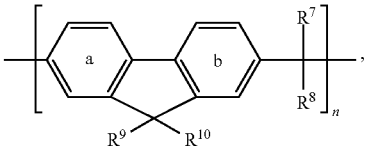

or a salt thereof, wherein:

each of $R^7$, $R^8$, $R^9$, and $R^{10}$ is, independently, an electron-withdrawing moiety, H, optionally substituted aliphatic, alkyl, heteroaliphatic, heteroalkylene, aromatic, aryl, or arylalkylene, wherein at least one of $R^7$ or $R^8$ can include the electron-withdrawing moiety or wherein a combination of $R^7$ and $R^8$ or $R^9$ and $R^{10}$ can be taken together to form an optionally substituted cyclic group;

Ar comprises or is an optionally substituted aromatic or arylene (e.g., any described herein);

each of n is, independently, an integer of 1 or more;

each of rings a-c can be optionally substituted; and rings a-c, $R^7$, $R^8$, $R^9$, and $R^{10}$ can optionally comprise an ionizable or ionic moiety.

Further non-limiting polymeric structures can include one or more of the following:

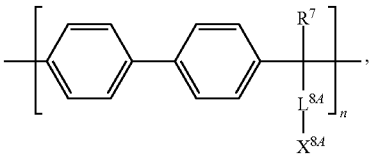

-continued
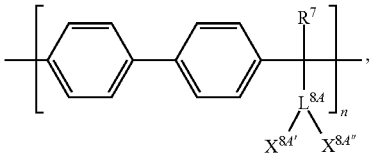
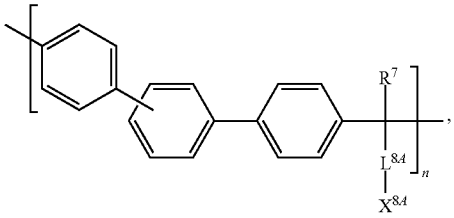
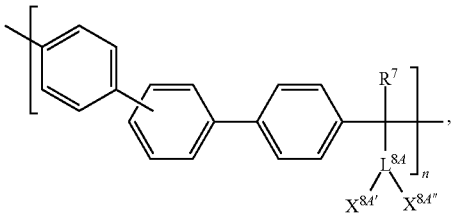
-continued
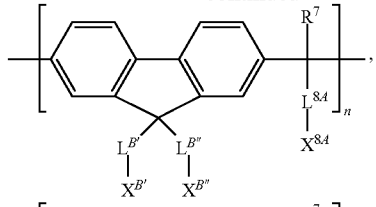
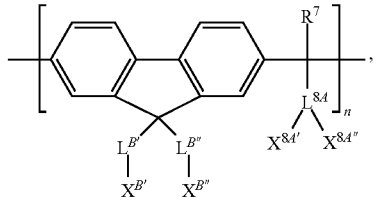
or a salt thereof, wherein:
$R^7$ can be any described herein (e.g., for formulas (I)-(V));
n is from 1 or more;
each $L^{8A}$, $L^{B'}$, and $L^{B''}$ is, independently, a linking moiety; and
each $X^{8A}$, $X^{8A'}$, $X^{8A''}$, $X^{B'}$, and $X^{B''}$ is, independently, an ionizable or ionic moiety.
Yet other polymeric structures include the following:
(X)
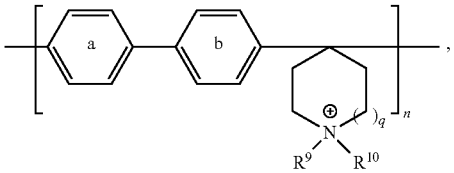
(XI)
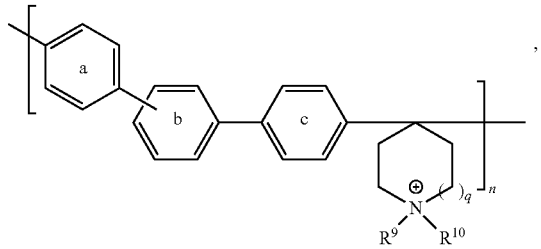
(XII)
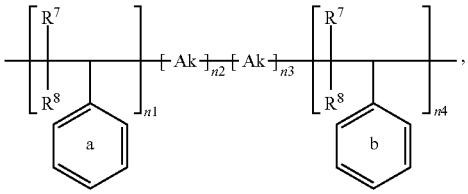
(XIII)
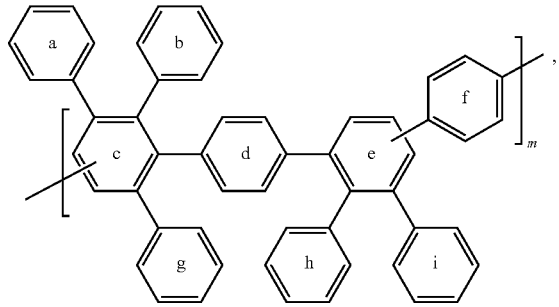
(XIV)
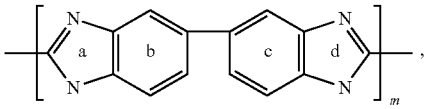
(XV)
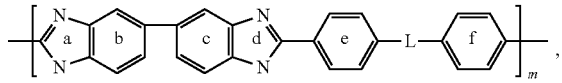
(XVI)
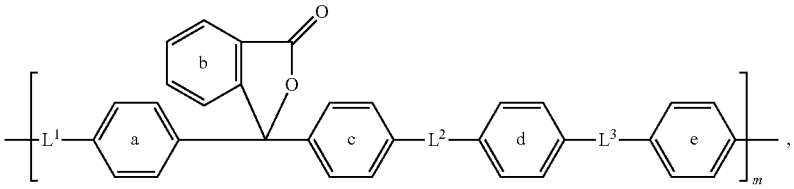

-continued
(XVII)
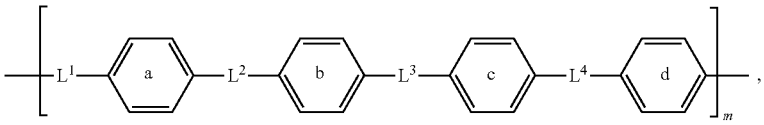
(XVIII)
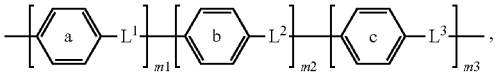
(XIX)
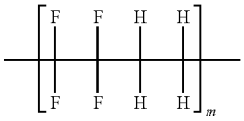
(XX)
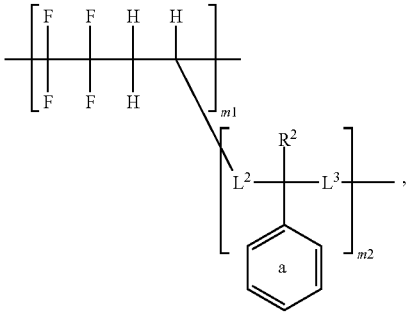
(XXI)
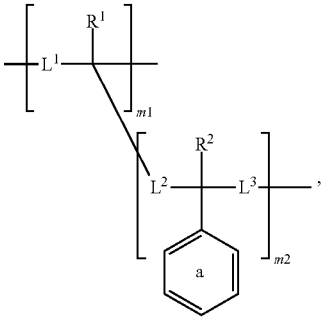
(XXII)
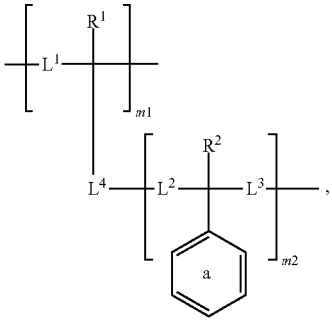
(XXIII)
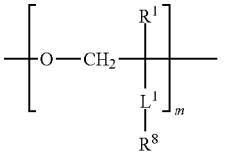
(XXIV)
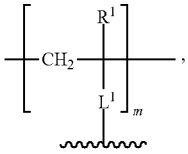
(XXV)
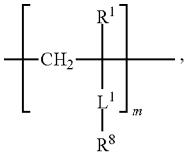
(XXVI)
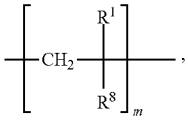
(XXVII)
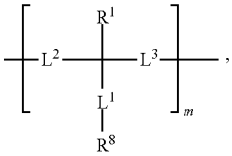
(XXVIII)
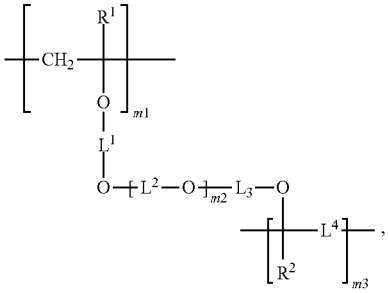
(XXIX)
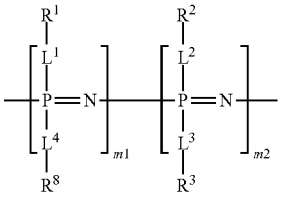

-continued (XXX)

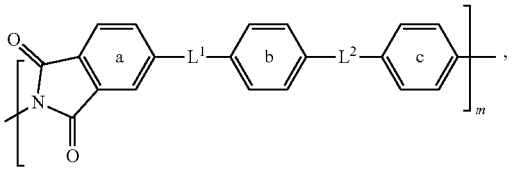

(XXXI)

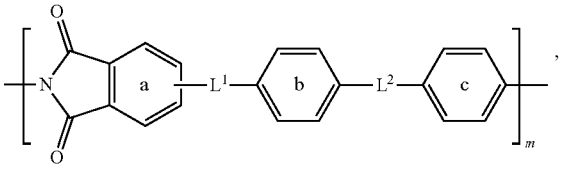

(XXXII)

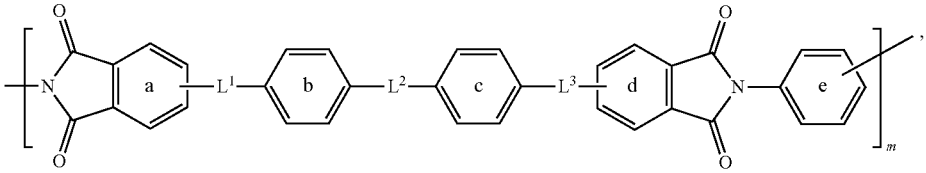

(XXXIII)

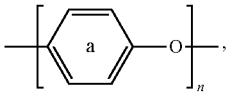

(XXXIV)

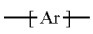

or a salt thereof, wherein:

each of $R^1$, $R^2$, $R^3$, $R^7$, $R^8$, $R^9$, and $R^{10}$ is, independently, an electron-withdrawing moiety, H, optionally substituted aliphatic, alkyl, heteroaliphatic, heteroalkylene, aromatic, aryl, or arylalkylene, wherein at least one of $R^7$ or $R^8$ can include the electron-withdrawing moiety or wherein a combination of $R^7$ and $R^8$ or $R^9$ and $R^{10}$ can be taken together to form an optionally substituted cyclic group;

each Ak is or comprises an optionally substituted aliphatic, alkylene, haloalkylene, heteroaliphatic, or heteroalkylene;

each Ar is or comprises an optionally substituted arylene or aromatic;

each of L, $L^1$, $L^2$, $L^3$, and $L^4$ is, independently, a linking moiety;

each of n, n1, n2, n3, n4, m, m1, m2, and m3 is, independently, an integer of 1 or more;

q is 0, 1, 2, or more;

each of rings a-i can be optionally substituted; and rings a-i, $R^7$, $R^8$, $R^9$, and $R^{10}$ can optionally include an ionizable or ionic moiety.

In particular embodiments (e.g., of formula (XIV) or (XV)), each of the nitrogen atoms on rings a and/or b are substituted with optionally substituted aliphatic, alkyl, aromatic, aryl, an ionizable moiety, or an ionic moiety. In some embodiments, one or more hydrogen or fluorine atoms (e.g., in formula (XIX) or (XX)) can be substituted to include an ionizable moiety or an ionic moiety (e.g., any described herein). In other embodiments, the oxygen atoms present in the polymeric structure (e.g., in formula XXVIII) can be associated with an alkali dopant (e.g., $K^+$).

In particular examples, Ar, one or more of rings a-i (e.g., rings a, b, f, g, h, or i), L, $L^1$, $L^2$, $L^3$, $L^4$, Ak, $R^7$, $R^8$, $R^9$, and/or $R^{10}$ can be optionally substituted with one or more ionizable or ionic moieties and/or one or more electron-withdrawing groups. Yet other non-limiting substituents for Ar, rings (e.g., rings a-i), L, Ak, $R^7$, $R^8$, $R^9$, and $R^{10}$ include one or more described herein, such as cyano, hydroxy, nitro, and halo, as well as optionally substituted aliphatic, alkyl, alkoxy, alkoxyalkyl, amino, aminoalkyl, aryl, arylalkylene, aryloyl, aryloxy, arylalkoxy, hydroxyalkyl, and haloalkyl.

In some embodiments, each of $R^1$, $R^2$, and $R^3$ is, independently, H, optionally substituted aromatic, aryl, aryloxy, or arylalkylene. In other embodiments (e.g., of formulas (I)-(V) or (XII)), $R^7$ includes the electron-withdrawing moiety. In yet other embodiments, $R^8$, $R^9$, and/or $R^{10}$ includes an ionizable or ionic moiety.

In one instance, a polymeric subunit can lack ionic moieties. Alternatively, the polymeric subunit can include an ionic moiety on the Ar group, the L group, both the Ar and L groups, or be integrated as part of the L group. Non-limiting examples of ionizable and ionic moieties include cationic, anionic, and multi-ionic group, as described herein.

In any embodiment herein, the electron-withdrawing moiety can include or be an optionally substituted haloalkyl, cyano (CN), phosphate (e.g., $—O(P{=}O)(OR^{P1})(OR^{P2})$ or $—O—[P({=}O)(OR^{P1})—O]_{P3}—R^{P2}$), sulfate (e.g., $—O—S({=}O)_2(OR^{S1})$), sulfonic acid ($—SO_3H$), sulfonyl (e.g., $—SO_2—CF_3$), difluoroboranyl ($—BF_2$), borono ($B(OH)_2$), thiocyanato (—SCN), or piperidinium. Yet other non-limiting phosphate groups can include derivatives of phosphoric acid, such as orthophosphoric acid, pyrophosphoric acid, tripolyphosphoric acid, tetrapolyphosphoric acid, trimetaphosphoric acid, and/or phosphoric anhydride, or combinations thereof.

Yet other polymeric units can include poly(benzimidazole) (PBI), polyphenylene (PP), polyimide (PI), poly(ethyleneimine) (PEI), sulfonated polyimide (SPI), polysulfone (PSF), sulfonated polysulfone (SPSF), poly(ether ketone) (PEEK), PEEK with cardo groups (PEEK-WC), polyethersulfone (PES), sulfonated polyethersulfone (SPES), sulfonated poly(ether ketone) (SPEEK), SPEEK with cardo groups (SPEEK-WC), poly(p-phenylene oxide) (PPO), sulfonated polyphenylene oxide (SPPO), ethylene tetrafluoroethylene (ETFE), polytetrafluoroethylene (PTFE), poly(epichlorohydrin) (PECH), poly(styrene) (PS), sulfonated poly(styrene) (SPS), hydrogenated poly(butadiene-styrene) (HPBS), styrene divinyl benzene copolymer (SDVB), styrene-ethylene-butylene-styrene (SEBS), sulfonated bisphenol-A-polysulfone (SPSU), poly(4-phenoxy benzoyl-1,4-phenylene) (PPBP), sulfonated poly(4-phenoxy benzoyl-1,4-phenylene) (SPPBP), poly(vinyl alcohol) (PVA), poly(phosphazene), poly(aryloxyphosphazene), polyetherimide, as well as combinations thereof.

Crosslinking

In some embodiments, crosslinking is present within an ion conducting polymer layer and/or between ion conducting polymer layers. Crosslinking within a material can be promoted by use of crosslinking reagents. For instance, the composition can include polymeric units, and a crosslinking reagent can be used to provide crosslinking between polymeric units. For instance, if the polymeric units (P1 and P2) include a leaving group, then a diamine crosslinking reagent (e.g., $H_2N$-Ak-$NH_2$) can be used to react with the polymeric units by displacing the leaving group and forming an amino-containing crosslinker within the composition (e.g., thereby forming P1-NH-Ak-NH—P2). Crosslinkers can be introduced by forming a polymer composition and then exposing the composition to a crosslinking reagent to form crosslinker.

Depending on the functional group present in the material, the crosslinking reagent can include a nucleophilic group (e.g., an amine or a hydroxyl) or an electrophilic group (e.g., a carbonyl). Thus, non-limiting crosslinking reagents can include amine-containing reagents, hydroxyl-containing reagents, carboxylic acid-containing reagents, acyl halide-containing reagents, or others. Further crosslinking reagents can include:

$$\mathrm{Ak}\text{—}]X]_{L3} \quad \text{or} \quad \mathrm{Ar}\text{—}]X]_{L3} \quad \mathrm{Ar}\text{—}]L\text{—}X]_{L3},$$

in which Ak is an optionally substituted aliphatic or alkylene; Ar is an optionally substituted aromatic or arylene; L is a linking moiety (e.g., any herein, such as a covalent bond, optionally substituted alkylene, aliphatic, etc.); L3 is an integer that is 2 or more (e.g., 2, 3, 4, 5, 6, or more); and X is halo, hydroxyl, optionally substituted amino (e.g., $NR^{N1}R^{N2}$, in which each of $R^{N1}$ and $R^{N2}$ is, independently, H or optionally substituted alkyl), hydroxyl, carboxyl, acyl halide (e.g., —C(O)—R, in which R is halo), carboxyaldehyde (e.g., —C(O)H), or optionally substituted alkyl. Non-limiting crosslinking reagents can include terephthalaldehyde, glutaraldehyde, ortho-xylene, para-xylene, meta-xylene, or a multivalent amine, such as diamine, triamine, tetraamine, pentaamine, etc., including 1,6-diaminohexane (hexanediamine), 1,4-diaminobutane, 1,8-diaminooctane, propane-1,2,3-triamine, [1,1': 3',1"-terphenyl]-4,4",5'-triamine, and others.

After reacting the crosslinking reagent, the composition can include one or more crosslinkers within the composition. If the crosslinking reagent is bivalent, then a crosslinker can be present between two of any combination of polymeric structures, polymeric units, and ionizable/ionic moieties (e.g., between two polymeric units, between two ionizable/ionic moieties, etc.). If the crosslinking reagent is trivalent or of higher n valency, then the crosslinker can be present between any n number of polymeric units, linking moieties, ionizable moieties, and/or ionic moieties. Non-limiting crosslinkers present in the composition include those formed after reacting a crosslinking reagent. Thus, examples of crosslinkers can include:

$$\mathrm{Ak}\text{—}]X']_{L3} \quad \text{or} \quad \mathrm{Ar}\text{—}]X']_{L3} \quad \mathrm{Ar}\text{—}]L\text{—}X']_{L3},$$

in which Ak is an optionally substituted aliphatic or an optionally substituted alkylene, Ar is an optionally substituted aromatic or an optionally substituted arylene, L is a linking moiety (e.g., any herein, such as a covalent bond, optionally substituted alkylene, optionally substituted aliphatic, etc.), L3 is an integer that is 2 or more (e.g., 2, 3, 4, 5, 6, or more), and X' is a reacted form of X. In some embodiments, X' is absent, —O—, —C(O)—, or -Ak-, in which $R^{N1}$ is H or optionally substituted alkyl, and Ak is optionally substituted alkylene, optionally substituted heteroalkylene, optionally substituted aliphatic, or optionally substituted heteroaliphatic.

Ionizable and Ionic Moieties

The polymers described herein include one or more ionizable or ionic moieties. Such moieties can include an anionic or cationic charge, such as in an ionic moiety. Alternatively, an ionizable moiety includes a functional group that can be readily converted into an ionic moiety, such as an ionizable moiety of a carboxy group (—$CO_2H$) that can be readily deprotonated to form a carboxylate anion (—$CO_2^-$). As used herein, the terms "ionizable" and "ionic" are used interchangeably.

Moieties can be characterized as an acidic moiety (e.g., a moiety can be deprotonated or can carry a negative charge) or a basic moiety (e.g., a moiety that can be protonated or carry a positive charge). In particular embodiments, the moiety can be a multi-ionic moiety, which can include a plurality of acidic moieties, a plurality of basic moieties, or a combination thereof (e.g., such as in a zwitterionic moiety). Further moieties can include a zwitterionic moiety, such as those including an anionic moiety (e.g., hydroxyl or a deprotonated hydroxyl) and a cationic moiety (e.g., ammonium).

The ionic moieties herein can be connected to the parent structure by way of one or more linking moieties. Furthermore, a single ionic moiety can be extended from a single linking moiety, or a plurality of ionic moieties can have one or more linking moieties therebetween. For instance, the ionic moiety can have any of the following structures: $-L^A-X^A$ or $-L^A-(L^{A'}-X^A)_{L2}$ or $-L^A-(X^A-L^{A'}-X^{A'})_{L2}$ or $-L^A-X^A-L^{A'}-X^{A'}-L^{A''}-X^{A''}$, in which each $L^A$, $L^{A'}$, and $L^{A''}$ is a linking moiety (e.g., any described herein); each $X^A$, $X^{A'}$, and $X^{A''}$ includes, independently, an acidic moiety, a basic moiety, a multi-ionic moiety, a cationic moiety, or an anionic moiety; and L2 is an integer of 1, 2, 3, or more (e.g., from 1 to 20). Non-limiting $L^A$ and $L^{A1'}$ can be —$(CH_2)_{L1}$—, —$O(CH_2)_{L1}$—, —$(CF_2)_{L1}$—, —$O(CF_2)_{L1}$—, or —$S(CF_2)_{L1}$—, in which L1 is an integer from 1 to 3; and $X^A$ is any ionizable or ionic moiety described herein.

Non-limiting ionizable or ionic moieties include carboxy (—$CO_2H$), carboxylate anion (—$CO_2^-$), guanidinium cation, sulfo (—$SO_2OH$), sulfonate anion (—$SO_2O^-$), sulfonium cation, sulfate, sulfate anion, phosphono (e.g., —$P(=O)(OH)_2$), phosphonate anion, phosphate, phosphate anion, phosphonium cation, phosphazenium cation, amino (e.g., —$NR^{N1}R^{N2}$), ammonium cation (e.g., aliphatic or aromatic ammonium), heterocyclic cation (e.g., including piperidinium, pyrrolidinium, pyridinium, pyrazolium, imidazolium, quinolinium, isoquinolinium, acridinium, quinolinium, isoquinolinium, acridinium, pyridazinium, pyrimidinium, pyrazinium, phenazinium, 1,4-diazabicyclo[2.2.2]octane (DABCO) cation, 4-methyl-1,4-diazoniabicyclo[2.2.2]octan-1-yl (MAABCO) cation), and 1-benzyl-1,4-diazoniabicyclo[2.2.2]octane (BABCO) cation), or a salt form thereof. Such moieties can be associated with one or more counterions. For instance, a cationic moiety can be associated with one or more anionic counterions, and an anionic moiety can be associated with one or more cationic counterions.

Arylene Groups

Particular moieties herein (e.g., polymeric units, linking moieties, and others) can include an optionally substituted arylene. Such arylene groups include any multivalent (e.g., bivalent, trivalent, tetravalent, etc.) groups having one or more aromatic groups, which can include heteroaromatic groups. Non-limiting aromatic groups (e.g., for Ar) can include any of the following:

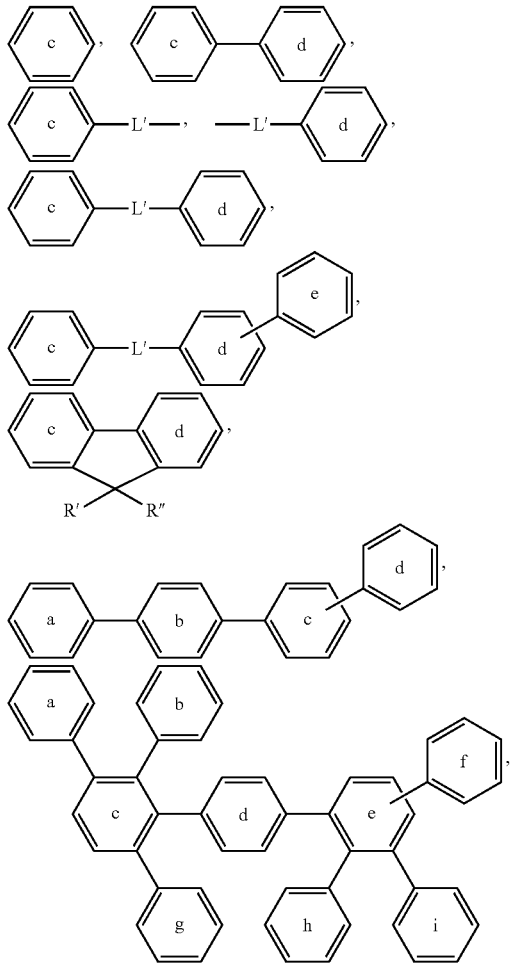

in which each of rings a-i can be optionally substituted (e.g., with any optional substituents described herein for alkyl or aryl; or with any ionic moiety described herein); L' is a linking moiety (e.g., any described herein); and each of R' and R" is, independently, H, optionally substituted alkyl, optionally substituted aryl, or an ionic moiety, as described herein. Non-limiting substituents for rings a-i include one or more described herein for aryl, such as alkyl, alkoxy, alkoxyalkyl, amino, aminoalkyl, aryl, arylalkylene, aryloyl, aryloxy, arylalkoxy, cyano, hydroxy, hydroxyalkyl, nitro, halo, and haloalkyl. In some embodiments, L' is a covalent bond, —O—, —$NR^{N1}$—, —C(O)—, optionally substituted alkylene, heteroalkylene, or arylene.

Yet other non-limiting arylene can include phenylene (e.g., 1,4-phenylene, 1,3-phenylene, etc.), biphenylene (e.g., 4,4'-biphenylene, 3,3'-biphenylene, 3,4'-biphenylene, etc.), terphenylene (e.g., 4,4'-terphenylene), diphenyl ether, anthracene (e.g., 9,10-anthracene), naphthalene (e.g., 1,5-naphthalene, 1,4-naphthalene, 2,6-naphthalene, 2,7-naphthalene, etc.), tetrafluorophenylene (e.g., 1,4-tetrafluorophenylene, 1,3-tetrafluorophenylene), and the like.

Non-limiting examples of linking moieties for arylene include any herein. In some embodiments, L' is substituted one or more ionizable or ionic moieties described herein. In particular embodiments, L' is optionally substituted alkylene. Non-limiting substitutions for L' can include -$L^A$-$X^A$, in which $L^A$ is a linking moiety (e.g., any described herein, such as, -Ak-, —O-Ak-, -Ak-O—, —Ar—, —O—Ar—, or —Ar—O—, in which Ak is optionally substituted alkylene and Ar is optionally substituted arylene), and $X^A$ is an acidic moiety, a basic moiety, or a multi-ionic moiety.

Linking Moieties

Particular chemical functionalities herein can include a linking moiety, either between the parent structure and another moiety (e.g., an ionic moiety) or between two (or more) other moieties. Linking moieties (e.g., L, $L^1$, $L^2$, $L^3$, $L^4$, $L^A$, $L^{A'}$, $L^{A''}$, $L^{B'}$, $L^{B''}$, $L^{8A}$, and others) can be any useful multivalent group, such as multivalent forms of optionally substituted aliphatic, heteroaliphatic, aromatic, or heteroaromatic.

In any embodiment herein, the linking moiety (e.g., L, $L^1$, $L^2$, $L^3$, or $L^4$) includes a covalent bond, spirocyclic bond, —O—, —$NR^{N1}$—, —C(O)—, —C(O)O—, —OC(O)—, —$SO_2$—, optionally substituted aliphatic, alkylene (e.g., —$CH_2$—, —$C(CH_3)_2$—, or —$CR_2$—, in which R is H, alkyl, or haloalkyl), alkyleneoxy, haloalkylene (e.g., —$CF_2$— or —$C(CF_3)_2$—), hydroxyalkylene, heteroaliphatic, heteroalkylene, aromatic, arylene, aryleneoxy, heterocycle, heterocyclyldiyl, —$SO_2$—$NR^{N1}$-Ak-, —(O-Ak)$_{L1}$-$SO_2$—$NR^{N1}$-Ak-, -Ak-, -Ak-(O-Ak)$_{L1}$-, —(O-Ak)$_{L1}$-, -(Ak-O)$_{L1}$—, —C(O)O-Ak-, —Ar—, or —Ar—O—, as well as combinations thereof. In particular embodiments, Ak is optionally substituted aliphatic, alkylene, or haloalkylene; $R^{N1}$ is H, optionally substituted alkyl, or aryl; Ar is an optionally substituted aromatic or arylene; and L1 is an integer from 1 to 3.

In other embodiments, L is an optionally substituted $C_{1-6}$ aliphatic, $C_{1-6}$ alkylene, or $C_{1-6}$ heteroalkylene. The use of short linkers could provide more extensive polymeric networks, as shorter linkers could minimize self-cyclization reactions.

In some embodiments, the linking moiety is —$(CH_2)_{L1}$—, —O$(CH_2)_{L1}$—, —$(CF_2)_{L1}$—, —O$(CF_2)_{L1}$—, or —S$(CF_2)_{L1}$— in which L1 is an integer from 1 to 3. In other embodiments, the linking moiety is -Ak-O—Ar-Ak-O-Ak- or -Ak-O—Ar—, in which Ak is optionally substituted alkylene or haloalkylene, and Ar is an optionally substituted arylene. Non-limiting substituted for Ar includes —$SO_2$-Ph, in which Ph can be unsubstituted or substituted with one or more halo.

The polymers described above in the with reference to the Table and formulas (I)-(V) and (X)-(XXXIV), including homopolymers and copolymers thereof and which may be optionally crosslinked and may include any of the linking moieties, arylene groups, and ionic moieties as described above may be used as appropriate in one or more layers of the MEA including a cathode catalyst layer, an anode catalyst layer, a polymer electrolyte membrane (PEM) layer, a cathode buffer layer, and/or an anode buffer layer.

Bipolar MEA for COx Reduction

In certain embodiments, the MEA includes a bipolar interface with an anion-conducting polymer on the cathode side of the MEA and an interfacing cation-conducting polymer on the anode side of the MEA. In some implementations, the cathode contains a first catalyst and an anion-conducting polymer. In certain embodiments, the anode contains a second catalyst and a cation-conducting polymer. In some implementations, a cathode buffer layer, located between the cathode and PEM, contains an anion-conducting polymer. In some embodiments, an anode buffer layer, located between the anode and PEM, contains a cation-conducting polymer.

During operation, an MEA with a bipolar interface moves ions through a polymer-electrolyte, moves electrons through metal and/or carbon in the cathode and anode layers, and moves liquids and gas through pores in the layers.

In embodiments employing an anion-conducting polymer in the cathode and/or in a cathode buffer layer, the MEA can decrease or block unwanted reactions that produce undesired products and decrease the overall efficiency of the cell. In embodiments employing a cation-conducting polymer in the anode and/or in an anode buffer layer can decrease or block unwanted reactions that reduce desired product production and reduce the overall efficiency of the cell.

For example, at levels of electrical potential used for cathodic reduction of $CO_2$, hydrogen ions may be reduced to hydrogen gas. This is a parasitic reaction; current that could be used to reduce $CO_2$ is used instead to reduce hydrogen ions. Hydrogen ions may be produced by various oxidation reactions performed at the anode in a $CO_2$ reduction reactor and may move across the MEA and reach the cathode where they can be reduced to produce hydrogen gas. The extent to which this parasitic reaction can proceed is a function of the concentration of hydrogen ions present at the cathode. Therefore, an MEA may employ an anion-conducting material in the cathode layer and/or in a cathode buffer layer. The anion-conducting material at least partially blocks hydrogen ions from reaching catalytic sites on the cathode. As a result, parasitic production of hydrogen gas generation is decreased and the rate of CO or other product production and the overall efficiency of the process are increased.

Another process that may be avoided is transport of carbonate or bicarbonate ions to the anode, effectively removing $CO_2$ from the cathode. Aqueous carbonate or bicarbonate ions may be produced from $CO_2$ at the cathode. If such ions reach the anode, they may decompose and release gaseous $CO_2$. The result is net movement of $CO_2$ from the cathode to the anode, where it does not get reduced and is lost with oxidation products. To prevent the carbonate and bicarbonate ion produced at the cathode from reaching the anode, the polymer-electrolyte membrane and/or a anode buffer layer may include a cation-conducting polymer, which at least partially blocks the transport of negative ions such as bicarbonate or carbonate ions to the anode.

Thus, in some designs, a bipolar membrane structure raises the pH at the cathode to facilitate $CO_2$ reduction while a cation-conducting polymer such as a proton-exchange layer prevents the passage of significant amounts of $CO_2$, negative ions (e.g. bicarbonate, carbonate), hydrogen, and $CO_2$ reduction products (e.g., CO, methane, ethylene, alcohols) to the anode side of the cell.

An example MEA for carbon oxide reduction has a cathode layer and an anode layer separated by an ion-conducting polymer layer that provides a path for ions to travel between the cathode layer and the anode layer. In certain embodiments, the cathode layer includes an anion-conducting polymer and/or the anode layer includes a cation-conducting polymer. In certain embodiments, the cathode layer and/or the anode layer of the MEA are porous. The pores may facilitate gas and/or fluid transport and may increase the amount of catalyst surface area that is available for reaction.

The ion-conducting layer may include two or three sublayers: a polymer electrolyte membrane (PEM), an optional cathode buffer layer, and/or an optional anode buffer layer. One or more layers in the ion-conducting layer may be porous. In certain embodiments, at least one layer is nonporous so that reactants and products of the cathode cannot pass via gas and/or liquid transport to the anode and vice versa. In certain embodiments, the PEM layer is nonporous. Example characteristics of anode buffer layers and cathode buffer layers are provided elsewhere herein.

FIG. 1 shows $CO_2$ electrolyzer 103 configured to receive water and $CO_2$ (e.g., humidified or dry gaseous $CO_2$) as a reactant at a cathode 105 and expel CO as a product. Electrolyzer 103 is also configured to receive water as a reactant at an anode 107 and expel gaseous oxygen. Electrolyzer 103 includes bipolar layers having an anion-conducting polymer 109 adjacent to cathode 105 and a cation-conducting polymer 111 (illustrated as a proton-exchange membrane) adjacent to anode 107.

As illustrated in the magnification inset of a bipolar interface 113 in electrolyzer 103, the cathode 105 includes an anion exchange polymer (which in this example is the same anion-conducting polymer 109 that is in the bipolar layers) electronically conducting carbon support particles 117, and metal nanoparticles 119 supported on the support particles. $CO_2$ and water are transported via pores such as pore 121 and reach metal nanoparticles 119 where they react, in this case with hydroxide ions, to produce bicarbonate ions and reduction reaction products (not shown). $CO_2$ may also reach metal nanoparticles 119 by transport within anion exchange polymer 109.

Hydrogen ions are transported from anode 107, and through the cation-conducting polymer 111, until they reach bipolar interface 113, where they are hindered from further transport toward the cathode by anion exchange polymer 109. At interface 113, the hydrogen ions may react with bicarbonate or carbonate ions to produce carbonic acid ($H_2CO_3$), which may decompose to produce $CO_2$ and water. As explained herein, the resulting $CO_2$ may be provided in gas phase and should be provided with a route in the MEA back to the cathode 105 where it can be reduced. The cation-conducting polymer 111 hinders transport of anions such as bicarbonate ions to the anode where they could react with protons and release $CO_2$, which would be unavailable to participate in a reduction reaction at the cathode.

As illustrated, a cathode buffer layer having an anion-conducting polymer may work in concert with the cathode and its anion-conductive polymer to block transport of protons to the cathode. While MEAs employing ion conducting polymers of appropriate conductivity types in the cathode, the anode, cathode buffer layer, and if present, an anode buffer layer may hinder transport of cations to the cathode and anions to the anode, cations and anions may still come in contact in the MEA's interior regions, such as in the membrane layer.

As illustrated in FIG. 1, bicarbonate and/or carbonate ions combine with hydrogen ions between the cathode layer and the anode layer to form carbonic acid, which may decompose to form gaseous $CO_2$. It has been observed that MEAs sometime delaminate, possibly due to this production of gaseous $CO_2$, which does not have an easy egress path.

The delamination problem can be addressed by employing a cathode buffer layer having pores. One possible explanation of its effectiveness is that the pores create paths for the gaseous carbon dioxide to escape back to the cathode where it can be reduced. In some embodiments, the cathode buffer layer is porous but at least one layer between the cathode layer and the anode layer is nonporous. This can prevent the passage of gases and/or bulk liquid between the cathode and anode layers while still preventing delamination. For example, the nonporous layer can prevent the direct passage of water from the anode to the cathode. The porosity of various layers in an MEA is described further at other locations herein.

Examples of Bipolar MEAs

As an example, an MEA includes a cathode layer including a reduction catalyst and a first anion-conducting polymer (e.g., Sustainion, FumaSep FAA-3, Tokuyama anion exchange polymer), an anode layer including an oxidation catalyst and a first cation-conducting polymer (e.g., PFSA polymer), a membrane layer including a second cation-conducting polymer and arranged between the cathode layer and the anode layer to conductively connect the cathode layer and the anode layer, and a cathode buffer layer including a second anion-conducting polymer (e.g., Sustainion, FumaSep FAA-3, Tokuyama anion exchange polymer) and arranged between the cathode layer and the membrane layer to conductively connect the cathode layer and the membrane layer. In this example, the cathode buffer layer can have a porosity between about 1 and 90 percent by volume, but can additionally or alternatively have any suitable porosity (including, e.g., no porosity). In other examples the cathode buffer layer can have any suitable porosity (e.g., between 0.01-95%, 0.1-95%, 0.01-75%, 1-95%, 1-90%, etc.).

Too much porosity can lower the ionic conductivity of the buffer layer. In some embodiments, the porosity is 20% or below, and in particular embodiments, between 0.1-20%, 1-10%, or 5-10%. Porosity in these ranges can be sufficient to allow movement of water and/or $CO_2$ without losing ionic conductivity. Porosity may be measured as described further below.

In a related example, the membrane electrode assembly can include an anode buffer layer that includes a third cation-conducting polymer, and is arranged between the membrane layer and the anode layer to conductively connect the membrane layer and the anode layer. The anode buffer layer preferably has a porosity between about 1 and 90 percent by volume, but can additionally or alternatively have any suitable porosity (including, e.g., no porosity). However, in other arrangements and examples, the anode buffer layer can have any suitable porosity (e.g., between 0.01-95%, 0.1-95%, 0.01-75%, 1-95%, 1-90%). As with the cathode buffer layer, in some embodiments, the porosity is 20% or below, e.g. 0.1-20%, 1-10%, or 5-10%

In an example, an anode buffer layer may be used in a MEA having a cathode catalyst layer with anion exchange polymer, a cathode buffer layer with anion-exchange polymer, a membrane with cation-exchange polymer, and an anode buffer layer with anion-exchange polymer. In such a structure, the anode buffer layer may be porous to facilitate water transport to the membrane/anode buffer layer interface. Water will be split at this interface to make protons that travel through the membrane and hydroxide that travels to the anode catalyst layer. One advantage of this structure is the potential use of low-cost water oxidation catalysts (e.g., $NiFeO_x$) that are only stable in basic conditions.

In another specific example, the membrane electrode assembly includes a cathode layer including a reduction catalyst and a first anion-conducting polymer (e.g., Sustainion, FumaSep FAA-3, Tokuyama anion exchange polymer), an anode layer including an oxidation catalyst and a first cation-conducting polymer, a membrane layer including a second anion-conducting polymer (e.g., Sustainion, FumaSep FAA-3, Tokuyama anion exchange polymer) and arranged between the cathode layer and the anode layer to conductively connect the cathode layer and the anode layer, and an anode buffer layer including a second cation-conducting polymer and arranged between the anode layer and the membrane layer to conductively connect the anode layer and the membrane layer.

An MEA containing an anion-exchange polymer membrane and an anode buffer layer containing cation-exchange polymer may be used for CO reduction. In this case, water would form at the membrane/anode buffer layer interface. Pores in the anode buffer layer could facilitate water removal. One advantage of this structure would be the use of an acid stable (e.g., $IrO_x$) water oxidation catalyst.

In a related example, the membrane electrode assembly can include a cathode buffer layer that includes a third anion-conducting polymer and is arranged between the cathode layer and the membrane layer to conductively connect the cathode layer and the membrane layer. The third anion-conducting polymer can be the same or different from the first and/or second anion-conducting polymer. The cathode buffer layer preferably has a porosity between about 1 and 90 percent by volume but can additionally or alternatively have any suitable porosity (including, e.g., no porosity). However, in other arrangements and examples, the cathode buffer layer can have any suitable porosity (e.g., between 0.01-95%, 0.1-95%, 0.01-75%, 1-95%, 1-90%). In some embodiments, the porosity is 20% or below, and in particular embodiments, between 0.1-20%, 1-10%, or 5-10%.

In an example, a cathode catalyst layer composed of Au nanoparticles 4 nm in diameter supported on Vulcan XC72R carbon and mixed with TM1 (mTPN-1) anion exchange polymer electrolyte (from Orion). Layer is ~15 um thick, Au/(Au+C)=20 wt %, TM1 to catalyst mass ratio of 0.32, mass loading of 1.4-1.6 mg/cm2 (total Au+C), estimated porosity of 0.56. Anion-exchange polymer layer composed of TM1 and PTFE particles. PTFE is approximately 200 nm in diameter. TM1 molecular weight is 30 k-45 k. Thickness of the layer is ~15 um. PTFE may introduce porosity of about 8%. Proton-exchange membrane layer composed of perfluorosulfonic acid polymer (e.g., Nafion 117). Thickness is approximately 183 um. Membrane forms a continuous layer that prevents significant movement of gas ($CO_2$, CO, $H_2$) through the layer. Anode catalyst layer composed of Ir or IrOx nanoparticles (100-200 nm aggregates) that is 10 um thick.

U.S. Patent Application Publication No. 2017/0321334, published Nov. 9, 2017 [OPUSP001B] and US Patent Application Publication No. 20190226103, published Jul. 25, 2019 [OPUSP005], which describe various features and examples of MEAs, are incorporated herein by reference in their entireties. All publications referred to herein are incorporated by reference in their entireties as if fully set forth herein.

Individual Layers of MEA

Cathode Catalyst Layer—General Structure

As indicated above, the cathode of the MEA, which is also referred to as the cathode layer or cathode catalyst layer, facilitates COx conversion. It is a porous layer containing catalysts for $CO_x$ reduction reactions.

In some embodiments, the cathode catalyst layer contains a blend of reduction catalyst particles, electronically-conductive support particles that provide support for the reduction catalyst particles, and a cathode ion-conducting polymer. In some embodiments, the reduction catalyst particles are blended with the cathode ion-conducting polymer without a support.

Examples of materials that can be used for the reduction catalyst particles include, but are not limited, to transition metals such as V, Cr, Mn, Fe, Co, Ni, Cu, Zr, Nb, Mo, Au, Ru, Rh, Pd, Ag, Cd, Hf, Ta, W, Re, Ir, Pt, and Hg, and combinations thereof, and/or any other suitable materials. Other catalyst materials can include alkali metals, alkaline earth metals, lanthanides, actinides, and post transition metals, such as Sn, Si, Ga, Pb, Al, Tl, Sb, Te, Bi, Sm, Tb, Ce, Nd and In or combinations thereof, and/or any other suitable catalyst materials. The choice of catalyst depends on the particular reaction performed at the cathode of the CRR.

Catalysts can be in the form of nanoparticles that range in size from approximately 1 to 100 nm or particles that range in size from approximately 0.2 to 10 nm or particles in the size range of approximately 1-1000 nm or any other suitable range. In addition to nanoparticles and larger particles, films and nanostructured surfaces may be used.

If used, the electronically-conductive support particles in the cathode can be carbon particles in various forms. Other possible conductive support particles include boron-doped diamond or fluorine-doped tin oxide. In one arrangement, the conductive support particles are Vulcan carbon. The conductive support particles can be nanoparticles. The size range of the conductive support particles is between approximately 20 nm and 1000 nm or any other suitable range. It is especially useful if the conductive support particles are compatible with the chemicals that are present in the cathode when the CRR is operating, are reductively stable, and have a high hydrogen production overpotential so that they do not participate in any electrochemical reactions.

For composite catalysts such as Au/C, example metal nanoparticle sizes may range from about 1-100 nm, e.g., 2 nm-20 nm and the carbon size may be from about 20-200 nm as supporting materials. For pure metal catalyst such as Ag or Cu, the particles have a broad range from 2 nm to 500 nm in term of crystal grain size. The agglomeration could be even larger to micrometer range.

In general, such conductive support particles are larger than the reduction catalyst particles, and each conductive support particle can support many reduction catalyst particles. In some embodiments, there may be two different kinds of catalysts supported on a catalyst support particle, such as a carbon particle. Catalyst particles of a first type and second catalyst particles of a second type are attached to the catalyst support particle. In various arrangements, there is only one type of catalyst particle or there are more than two types of catalyst particles attached to the catalyst support particle.

Using two types of catalysts may be useful in certain embodiments. For example, one catalyst may be good at one reaction (e.g., $CO_2 \rightarrow CO$) and the second good at another reaction (e.g., $CO \rightarrow CH_4$). Overall, the catalyst layer would perform the transformation of $CO_2$ to $CH_4$, but different steps in the reaction would take place on different catalysts.

The electronically-conductive support may also be in forms other than particles, including tubes (e.g., carbon nanotubes) and sheets (e.g., graphene). Structures having high surface area to volume are useful to provide sites for catalyst particles to attach.

In addition to reduction catalyst particles and electronically-conductive support particles, the cathode catalyst layer may include an ion conducting polymer. There are tradeoffs in choosing the amount of cathode ion-conducting polymer in the cathode. It can be important to include enough cathode ion-conducting polymer to provide sufficient ionic conductivity. But it is also important for the cathode to be porous so that reactants and products can move through it easily and to maximize the amount of catalyst surface area that is available for reaction. In various arrangements, the cathode ion-conducting polymer makes up somewhere in the range between 30 and 70 wt %, between 20 and 80 wt %, or between 10 and 90 wt %, of the material in the cathode layer, or any other suitable range. The wt % of ion-conducting polymer in the cathode is selected to result in the cathode layer porosity and ion-conductivity that gives the highest current density for $CO_x$ reduction. In some embodiments, it may be between 20 and 60 wt. % or between 20 and 50 wt. %. Example thicknesses of the cathode catalyst layer range from about 80 nm-300 μm.

In addition to the reduction catalyst particles, cathode ion conducting polymer, and if present, the electronically-conductive support, the cathode catalyst layer may include other additives such as PTFE.

In addition to polymer:catalyst mass ratios, the catalyst layer may be characterized by mass loading (mg/cm$^2$), and porosity. Porosity may be determined by a various manners. In one method, the loading of each component (e.g., catalyst, support, and polymer) is multiplied by its respective density. These are added together to determine the thickness the components take up in the material. This is then divided by the total known thickness to obtain the percentage of the layer that is filled in by the material. The resulting percentage is then subtracted from 1 to obtain the percentage of the layer assumed to be void space (e.g., filled with air or other gas or a vacuum), which is the porosity. Methods such as mercury porosimetry or image processing on TEM images may be used as well.

The catalyst layer may also be characterized by its roughness. The surface characteristics of the catalyst layer can impact the resistances across the membrane electrode assembly. Excessively rough catalyst layers can potentially lead to interfacial gaps between the catalyst and the microporous layer. These gaps hinder the continuous pathway for electron transfer from the current collector to the catalytic area, thus, increasing contact resistances. Interfacial gaps may also serve as locations for water accumulation that is detrimental to mass transport of reactants and products. On the other hand, extremely smooth surfaces may suffer from poor adhesion between layers. Catalyst layer roughness may influence electrical contact resistances and concentration polarization losses. Surface roughness can be measured using different techniques (e.g. mechanical stylus method, optical profilometry, or atomic force microscopy) and is defined as the high-frequency, short wavelength component of a real surface. Arithmetic mean height, $S_a$, is a parameter that is commonly used to evaluate the surface roughness. Numerically, it is calculated by integrating the absolute height of valleys and peaks on the surface relative to the mean plane over the entire geometric area of the sample. Catalyst layer $S_a$ values between 0.50-1.10 μm or 0.70-0.90 μm may be used in some embodiments.

Examples of cathode catalyst layers for CO, methane, and ethylene/ethanol productions are given below.

- CO production: Au nanoparticles 4 nm in diameter supported on Vulcan XC72R carbon and mixed with TM1 anion exchange polymer electrolyte from Orion. Layer is about 15 μm thick, Au/(Au+C)=30%, TM1 to catalyst mass ratio of 0.32, mass loading of 1.4-1.6 mg/cm$^2$, estimated porosity of 0.47
- Methane production: Cu nanoparticles of 20-30 nm size supported on Vulcan XC72R carbon, mixed with FAA-3 anion exchange solid polymer electrolyte from Fumatech. FAA-3 to catalyst mass ratio of 0.18. Estimated Cu nanoparticle loading of ~7.1 μg/cm$^2$, within a wider range of 1-100 μg/cm$^2$ Ethylene/ethanol production: Cu nanoparticles of 25-80 nm size, mixed with FAA-3 anion exchange solid polymer electrolyte from Fumatech. FAA-3 to catalyst mass ratio of 0.10. Deposited either on Sigracet 39BC GDE for pure AEM or onto the polymer-electrolyte membrane. Estimated Cu nanoparticle loading of 270 $\mu g/cm^2$.

Bipolar MEA for methane production: The catalyst ink is made up of 20 nm Cu nanoparticles supported by Vulcan carbon (Premetek 40% Cu/Vulcan XC-72) mixed with FAA-3 anion exchange solid polymer electrolyte (Fumatech), FAA-3 to catalyst mass ratio of 0.18. The cathode is formed by the ultrasonic spray deposition of the catalyst ink onto a bipolar membrane including FAA-3 anion exchange solid polymer electrolyte spray-coated on Nafion (PFSA) 212 (Fuel Cell Etc) membrane. The anode is composed of IrRuOx which is spray-coated onto the opposite side of the bipolar membrane, at a loading of 3 $mg/cm^2$. A porous carbon gas diffusion layer (Sigracet 39BB) is sandwiched to the Cu catalyst-coated bipolar membrane to compose the MEA.

Bipolar MEA for ethylene production: The catalyst ink is made up of pure 80 nm Cu nanoparticles (Sigma Aldrich) mixed with FAA-3 anion exchange solid polymer electrolyte (Fumatech), FAA-3 to catalyst mass ratio of 0.09. The cathode is formed by the ultrasonic spray deposition of the catalyst ink onto a bipolar membrane including FAA-3 anion exchange solid polymer electrolyte spray-coated on Nafion (PFSA) 115 (Fuel Cell Etc) membrane. The anode is composed of IrRuOx which is spray-coated onto the opposite side of the bipolar membrane, at a loading of 3 $mg/cm^2$. A porous carbon gas diffusion layer (Sigracet 39BB) is sandwiched to the Cu catalyst-coated bipolar membrane to compose the MEA.

CO production: Au nanoparticles 4 nm in diameter supported on Vulcan XC72R carbon and mixed with TM1 anion exchange polymer electrolyte from Orion. Layer is about 14 micron thick, Au/(Au+C)=20%. TM1 to catalyst mass ratio of 0.32, mass loading of 1.4-1.6 $mg/cm^2$, estimated porosity of 0.54 in the catalyst layer.

CO production: Au nanoparticles 45 nm in diameter supported on Vulcan XC72R carbon and mixed with TM1 anion exchange polymer electrolyte from Orion. Layer is about 11 micron thick, Au/(Au+C)=60%. TM1 to catalyst mass ratio of 0.16, mass loading of 1.1-1.5 $mg/cm^2$, estimated porosity of 0.41 in the catalyst layer.

CO production: Au nanoparticles 4 nm in diameter supported on Vulcan XC72R carbon and mixed with TM1 anion exchange polymer electrolyte from Orion. Layer is about 25 micron thick, Au/(Au+C)=20%. TM1 to catalyst mass ratio of 0.32, mass loading of 1.4-1.6 $mg/cm^2$, estimated porosity of 0.54 in the catalyst layer.

The functions, materials, and structures of the components of the cathode catalyst layer are described further below.

Cathode Catalyst Layer—Functions

A primary function of the cathode catalyst layer is to provide a catalyst for $CO_x$ reduction. An example reaction is:

$$CO_2+2H^++2e-\rightarrow CO+H_2O.$$

The cathode catalyst layer also has a number of other functions that facilitate $CO_x$ conversion. These include water management, gas transport, reactant delivery to the metal catalyst, product removal, stabilizing the particulate structure of the metal catalyst, electronic and ionic conduction to the metal catalyst, and mechanical stability within the MEA.

Certain functions and challenges are particular to CRRs and are not found in MEA assemblies for other applications such as fuel cells or water electrolyzers. These challenges include that the cathode catalyst layer of the MEA transports gas (e.g., $CO_2$ or CO) in and gas (e.g., ethylene, methane, CO) or liquid (e.g., ethanol) out. The cathode catalyst layer also prevents accumulation of water that can block gas transport. Further, catalysts for COx reduction are not as developed as catalysts like platinum that can be used in hydrogen fuel cells. As a result, the COx reduction catalysts are generally less stable. These functions, their particular challenges, and how they can be addressed are described below.

Water Management (Cathode Catalyst Layer)

The cathode catalyst layer facilitates movement of water to prevent it from being trapped in the cathode catalyst layer. Trapped water can hinder access of $CO_x$ to the catalyst and/or hinder movement of reaction product out of the cathode catalyst layer.

Water management challenges are in many respects unique to CRRs. For example, compared to a PEM fuel cell's oxygen electrode, a CRR uses a much lower gas flow rate. A CRR also may use a lower flow rate to achieve a high utilization of the input $CO_x$. Vapor phase water removal is determined by the volumetric gas flow, thus much less vapor phase water removal is carried out in a CRR. A CRR may also operate at higher pressure (e.g., 100 psi-450 psi) than a fuel cell; at higher pressure the same molar flow results in lower volumetric flow and lower vapor phase water removal. As a result, liquid water in MEA of a CRR is present to be removed. For some MEAs, the ability to remove vapor phase water is further limited by temperature limits not present in fuel cells. For example, $CO_2$ to CO reduction may be performed at about 50° C. and ethylene and methane production may be performed at 20° C.-25° C. This is compared to typical operating temperatures of 80° C. to 120° C. for fuel cells. As a result, there is more liquid phase water to remove.

Properties that affect ability of the cathode catalyst layer to remove water include porosity; pore size; distribution of pore sizes; hydrophobicity; the relative amounts of ion conducting polymer, metal catalyst particles, and electronically-conductive support; the thickness of the layer; the distribution of the catalyst throughout the layer; and the distribution of the ion conducting polymer through the layer and around the catalyst.

A porous layer allows an egress path for water. In some embodiments, the cathode catalyst layer has a pore size distribution that includes pores having sizes of 1 nm-100 nm and pores having sizes of at least 1 micron. This size distribution can aid in water removal. The porous structures could be formed by one or more of: pores within the carbon supporting materials; stacking pores between stacked spherical carbon nanoparticles; secondary stacking pores between agglomerated carbon spheres (micrometer scale); or inert filler (e.g., PTFE) introduced porous with the interface between the PTFE and carbon also creating irregular pores ranging from hundreds of nm to micrometers.

The cathode catalyst layer may have a thickness that contributes to water management. Using a thicker layer allows the catalyst and thus the reaction to be distributed in a larger volume. This spreads out the water distribution and makes it easier to manage.

Ion-conducting polymers having non-polar, hydrophobic backbones may be used in the cathode catalyst layer. In some embodiments, the cathode catalyst layer may include a hydrophobic polymer such as PTFE in addition to the ion-conducting polymer. In some embodiments, the ion-conducting polymer may be a component of a co-polymer that also includes a hydrophobic polymer. In some embodiments, the ion-conducting polymer has hydrophobic and hydrophilic regions. The hydrophilic regions can support water movement and the hydrophobic regions can support gas movement.

Gas Transport (Cathode Catalyst Layer)

The cathode catalyst layer is structured for gas transport. Specifically, $CO_x$ is transported to the catalyst and gas phase reaction products (e.g., CO, ethylene, methane, etc.) is transported out of the catalyst layer.

Certain challenges associated with gas transport are unique to CRRs. Gas is transported both in and out of the cathode catalyst layer—$CO_x$ in and products such as CO, ethylene, and methane out. In a PEM fuel cell, gas ($O_2$ or $H_2$) is transported in but nothing or product water comes out. And in a PEM water electrolyzer, water is the reactant with $O_2$ and $H_2$ gas products.

Operating conditions including pressures, temperature, and flow rate through the reactor affect the gas transport. Properties of the cathode catalyst layer that affect gas transport include porosity; pore size and distribution; layer thickness; and ionomer distribution.

In some embodiments, the ionomer-catalyst contact is minimized. For example, in embodiments that use a carbon support, the ionomer may form a continuous network along the surface of the carbon with minimal contact with the catalyst. The ionomer, support, and catalyst may be designed such that the ionomer has a higher affinity for the support surface than the catalyst surface. This can facilitate gas transport to and from the catalyst without being blocked by the ionomer, while allowing the ionomer to conduct ions to and from the catalyst.

Ionomer (Cathode Catalyst Layer)

The ionomer may have several functions including holding particles of the catalyst layer together and allowing movement of ions through the cathode catalyst layer. In some cases, the interaction of the ionomer and the catalyst surface may create an environment favorable for $CO_x$ reduction, increasing selectivity to a desired product and/or decreasing the voltage required for the reaction. Importantly, the ionomer is an ion-conducting polymer to allow for the movement of ions through the cathode catalyst layer. Hydroxide, bicarbonate, and carbonate ions, for example, are moved away from the catalyst surface where the $CO_x$ reduction occurs. In the description below, the ionomer in the cathode catalyst layer can be referred to as a first ion-conducting polymer.

The first ion-conducting polymer can comprise at least one ion-conducting polymer that is an anion-conductor. This can be advantageous because it raises the pH compared to a proton conductor.

In some embodiments, the first ion-conducting polymer can comprise one or more covalently-bound, positively-charged functional groups configured to transport mobile negatively-charged ions. The first ion-conducting polymer can be selected from the group consisting of aminated tetramethyl polyphenylene; poly(ethylene-co-tetrafluoroethylene)-based quaternary ammonium polymer; quaternized polysulfone), blends thereof, and/or any other suitable ion-conducting polymers. The first ion-conducting polymer can be configured to solubilize salts of bicarbonate or hydroxide.

In some embodiments, the first ion-conducting polymer can comprise at least one ion-conducting polymer that is a cation-and-anion-conductor. The first ion-conducting polymer can be selected from the group consisting of polyethers that can transport cations and anions and polyesters that can transport cations and anions. The first ion-conducting polymer can be selected from the group consisting of polyethylene oxide, polyethylene glycol, polyvinylidene fluoride, and polyurethane.

A cation-and-anion conductor will raise pH (compared to a pure cation conductor.) Further, in some embodiments, it may be advantageous to use a cation-and-anion conductor to promote acid base recombination in a larger volume instead of at a 2D interface of anion-conducting polymer and cation conducting polymer. This can spread out water and $CO_2$ formation, heat generation, and potentially lower the resistance of the membrane by decreasing the barrier to the acid-base reaction. All of these may be advantageous in helping avoid the buildup of products, heat, and lowering resistive losses in the MEA leading to a lower cell voltage.

A typical anion-conducting polymer has a polymer backbone with covalently bound positively charged functional groups appended. These may include positively charged nitrogen groups in some embodiments. In some embodiments, the polymer backbone is non-polar, as described above. The polymer may be any appropriate molecular weight, e.g., 25,000 g/mol-150,000 g/mol, though it will be understood that polymers outside this range may be used.

Particular challenges for ion-conducting polymers in CRR's include that $CO_2$ can dissolve or solubilize polymer electrolytes, making them less mechanically stable, prone to swelling, and allowing the polymer to move more freely. This makes the entire catalyst layer and polymer-electrolyte membrane less mechanically stable. In some embodiments, polymers that are not as susceptible to $CO_2$ plasticization are used. Also, unlike for water electrolyzers and fuel cells, conducting carbonate and bicarbonate ions is a key parameter for $CO_2$ reduction.

The introduction of polar functional groups, such as hydroxyl and carboxyl groups which can form hydrogen bonds, leads to pseudo-crosslinked network formation. Cross-linkers like ethylene glycol and aluminum acetylacetonate can be added to reinforce the anion exchange polymer layer and suppress polymer $CO_2$ plasticization. Additives like polydimethylsiloxane copolymer can also help mitigate $CO_2$ plasticization.

According to various embodiments, the ion-conducting polymer may have a bicarbonate ionic conductivity of at least 6 mS/cm, or in some embodiments at least 12 mS/cm, is chemically and mechanically stable at temperatures 80° C. and lower, and soluble in organic solvents used during fabrication such as methanol, ethanol, and isopropanol. The ion-conducting polymer is stable (chemically and has stable solubility) in the presence of the $CO_x$ reduction products. The ion-conducting polymer may also be characterized by its ion exchange capacity, the total of active sites or functional groups responsible for ion exchange, which may range from 2.1 mmol/g-2.6 mmol/g in some embodiments. In some embodiments, ion-conducting polymers having lower IECs such as greater than 1 or 1.5 mmol/g may be used.

Examples of anion-conducting polymers are given above in above table as Class A ion-conducting polymers. A particular example of an anion-conducting polymer is Orion mTPN1 (also referred to herein as Orion TM1), which has m-triphenyl fluoro-alkyl as backbone and trimethylammonium (TMA+) as cation group. The chemical structure is shown below.

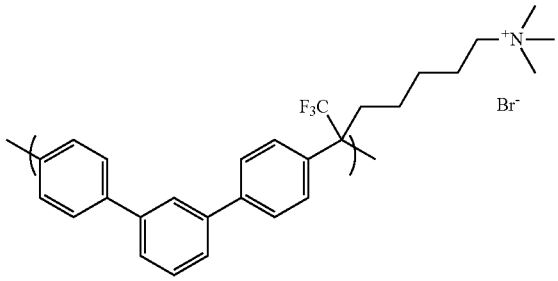

Additional examples include anion exchange membranes produced by Fumatech and Ionomr. Fumatech FumaSep FAA-3 ionomers come in Br— form. Anion exchange polymer/membrane based on polybenzimidazole produced by Ionomr comes in I— form as AF-1-HNN8-50-X.

The as-received polymer may be prepared by exchanging the anion (e.g., $I^-$, $Br^-$, etc.) with bicarbonate.

Also, as indicated above, in certain embodiments the ionomer may be a cation-and-anion-conducting polymer. Examples are given in the above table as Class B ion-conducting polymers.

Metal Catalyst (Cathode Catalyst Layer)

The metal catalyst catalyzes the $CO_x$ reduction reaction(s). The metal catalyst is typically nanoparticles, but larger particles, films, and nanostructured surfaces may be used in some embodiments. The specific morphology of the nanoparticles may expose and stabilize active sites that have greater activity.

The metal catalyst is often composed of pure metals (e.g., Cu, Au, Ag), but specific alloys or other bimetallic systems may have high activity and be used for certain reactions. The choice of catalyst may be guided by the desired reaction. For example, for CO production, Au may be used; for methane and ethylene production, Cu may be used. Other metals including Ag, alloys, and bimetallic systems may be used. $CO_2$ reduction has a high overpotential compared to other well-known electrochemical reactions such as hydrogen evolution and oxygen evolution on known catalysts. Small amounts of contaminants can poison catalysts for $CO_2$ conversion. And as indicated above, metal catalysts such as Cu, Au, and Ag are less developed than catalysts such as platinum used in hydrogen fuel cells.

Different metal catalyst materials may be chosen at least in part based on the desired product and MEA operation. For example, a nanowire has a higher selectivity for ethylene production while triangular Cu nanoplates show higher selectivity for methane. Nanocubes show good selectivity for ethylene in an AEM MEA. Gold nanoparticles with a narrow size distribution (e.g., 2-6 nm) and uniform distribution on carbon surface resulted in higher current efficiency and durability.

Metal catalyst properties that affect the cathode catalyst layer performance include size, size distribution, uniformity of coverage on the support particles, shape, loading (characterized as weight of metal/weight of metal+weight of carbon or as mass of particles per geometric area of catalyst layer), surface area (actual metal catalyst surface area per volume of catalyst layer), purity, and the presence of poisoning surface ligands from synthesis.

Nanoparticles may be synthesized by any appropriate method, such as for example, described in Phan et al., "Role of Capping Agent in Wet Synthesis of Nanoparticles," J. Phys. Chem. A 2018, 121, 17, 3213-3219; Bakshi "How Surfactants Control Crystal Growth of Nanomaterials," Cryst. Growth Des. 2016, 16, 2, 1104-1133; and Morsy "Role of Surfactants in Nanotechnology and Their Applications," Int. J. Curr. Microbiol. App. Sci. 2014, 3, 5, 237-260, which are incorporated by reference herein.

In some embodiments, metal nanoparticles are provided without the presence of poisoning surface ligands. This may be achieved by using the ionomer as a ligand to direct the synthesis of nanocrystal catalysts. The surface of the metal nanocatalysts are directly connected with ionically conductive ionomer. This avoids having to treat the catalyst surface to allow ionomer contact with the metal and improves the contact.

The metal catalyst may be disposed on a carbon support in some embodiments. For CO production, examples include Premetek 20 wt % Au supported on Vulcan XC-72R carbon with 4-6 nm Au particle size and 30% Au/C supported on Vulcan XC-72R with 5-7 nm Au particle size. For methane, examples include Premetek 20 wt % Cu supported on Vulcan XC-72R carbon with 20-30 nm Cu particle size. In some embodiments, the metal catalyst may be unsupported. For ethylene production, examples of unsupported metal catalysts include SigmaAldrich unsupported Cu 80 nm particle size and ebeam or sputter deposited thin Cu layer of 10 nm to 100 nm.

Support (Cathode Catalyst Layer)

The support of the cathode catalyst layer has several functions. It stabilizes metal nanoparticles to prevent them from agglomerating and distributes the catalytic sites throughout the catalyst layer volume to spread out loss of reactants and formation of products. It also forms an electrically conductive pathway to metal nanoparticles. Carbon particles, for example, pack together such that contacting carbon particles provide the electrically conductive pathway. Void space between the particles forms a porous network that gas and liquids can travel through.

In some embodiments, carbon supports developed for fuel cells can be used. Many different types have been developed; these are typically 50 nm-500 nm in size, and can be obtained in different shapes (spheres, nanotubes, sheets (e.g., graphene)), porosities, surface area per volume, electrical conductivity, functional groups (N-doped, O-doped, etc).

The support may be hydrophobic and have affinity to the metal nanoparticle.

Examples of carbon blacks that can be used include:

Vulcan XC-72R-Density of 256 mg/cm2, 30-50 nm

Ketjen Black-Hollow structure, Density of 100-120 mg/cm2, 30-50 nm

Printex Carbon, 20-30 nm

Anode Catalyst Layer

The anode of the MEA, which is also referred to as the anode layer or anode catalyst layer, facilitates oxidation reactions. It is a porous layer containing catalysts for oxidation reactions. Examples of reactions are:

$2H_2O \rightarrow 4H^+ + 4e^- O_2$ (in acidic environment of proton exchange polymer electrolyte—bipolar membrane); or $4OH^- \rightarrow 4e^- + O_2 + 2H_2O$ (in basic environment of anion exchange polymer electrolyte)

The oxidation of other materials, such as hydrocarbons to make $CO_2$ or chloride ions to make chlorine gas, or hydrogen gas to make hydrogen ions, may also be performed.

In some embodiments, the anode contains a blend of oxidation catalyst and an anode ion-conducting polymer. There are a variety of oxidation reactions that can occur at the anode depending on the reactant that is fed to the anode and the anode catalyst(s). In one arrangement, the oxidation catalyst is selected from the group consisting of metals and oxides of Ir, Pt, Ni, Ru, Pd, Au, and alloys thereof, IrRu, PtIr, Ni, NiFe, stainless steel, and combinations thereof. The oxidation catalyst can further contain conductive support particles selected from the group consisting of carbon, boron-doped diamond, and titanium.

The oxidation catalyst can be in the form of a structured mesh or can be in the form of particles. If the oxidation catalyst is in the form of particles, the particles can be supported by electronically-conductive support particles. The conductive support particles can be nanoparticles. It is especially useful if the conductive support particles are compatible with the chemicals that are present in the anode when the CRR is operating and are oxidatively stable so that they do not participate in any electrochemical reactions. It is especially useful if the conductive support particles are chosen with the voltage and the reactants at the anode in mind. In some arrangements, the conductive support particles are titanium, which is well-suited for high voltages. In other arrangements, the conductive support particles are carbon, which can be most useful at low voltages. In general, such conductive support particles are larger than the oxidation catalyst particles, and each conductive support particle can support many oxidation catalyst particles. An example of such an arrangement is shown in FIG. 1 and is discussed above with respect to the cathode catalyst layer. In one arrangement, the oxidation catalyst is iridium ruthenium oxide. Examples of other materials that can be used for the oxidation catalyst include, but are not limited to, those listed above. It should be understood that many of these metal catalysts can be in the form of oxides, especially under reaction conditions.

In some embodiments, the MEA has an anode layer comprising oxidation catalyst and a second ion-conducting polymer. The second ion-conducting polymer can comprise one or more polymers that contain covalently-bound, negatively-charged functional groups configured to transport mobile positively-charged ions. The second ion-conducting polymer can be selected from the group consisting of ethanesulfonyl fluoride, 2-[1-[difluoro-[(trifluoroethenyl)oxy]methyl]-1,2,2,2-tetrafluoroethoxy]-1,1,2,2,-tetrafluoro-, with tetrafluoroethylene, tetrafluoroethylene-perfluoro-3,6-dioxa-4-methyl-7-octanesulfonic acid copolymer, other perfluorosulfonic acid polymers and blends thereof. Examples of cation-conducting polymers include e.g., Nafion 115, Nafion 117, and/or Nafion 211.

There are tradeoffs in choosing the amount of ion-conducting polymer in the anode. It is important to include enough anode ion-conducting polymer to provide sufficient ionic conductivity. But it is also important for the anode to be porous so that reactants and products can move through it easily, and to maximize the amount of catalyst surface area that is available for reaction. In various arrangements, the ion-conducting polymer in the anode makes up approximately 50 wt % of the layer or between approximately 5 and 20 wt %, 10 and 90 wt %, between 20 and 80 wt %, between 25 and 70 wt %, or any suitable range. It is especially useful if the anode can tolerate high voltages, such as voltages above about 1.2 V vs. a reversible hydrogen electrode. It is especially useful if the anode 240 is porous in order to maximize the amount of catalyst surface area available for reaction and to facilitate gas and liquid transport.

In one example of a metal catalyst, Ir or IrOx particles (100-200 nm) and Nafion ionomer form a porous layer approximately 10 μm thick. Metal catalyst loading is approximately 0.5-3 g/cm$^2$.

In some embodiments, NiFeOx or $NiO_x$ is used for basic reactions.

PEM (MEA Layer Description)

The MEAs include a polymer electrolyte membrane (PEM) disposed between and conductively coupled to the anode catalyst layer and the cathode catalyst layer. The polymer electrolyte membrane has high ionic conductivity (greater than about 1 mS/cm), and is mechanically stable. Mechanical stability can be evidenced in a variety of ways such as through high tensile strength, modulus of elasticity, elongation to break, and tear resistance. Many commercially-available membranes can be used for the polymer electrolyte membrane. Examples include, but are not limited to, various Nation® formulations, GORE-SELECT, FumaPEM® (PFSA) (FuMA-Tech GmbH), and Aquivion® (PFSA) (Solvay).

In one arrangement, the PEM comprises at least one ion-conducting polymer that is a cation-conductor. The third ion-conducting polymer can comprise one or more covalently-bound, negatively-charged functional groups configured to transport mobile positively-charged ions. The third ion-conducting polymer can be selected from the group consisting of ethanesulfonyl fluoride, 2-[1-[difluoro-[(trifluoroethenyl)oxy]methyl]-1,2,2,2-tetrafluoroethoxy]-1,1,2,2,-tetrafluoro-, with tetrafluoroethylene, tetrafluoroethylene-perfluoro-3,6-dioxa-4-methyl-7-octanesulfonic acid copolymer, other perfluorosulfonic acid polymers and blends thereof.

Cathode Buffer Layer (MEA Layer Description)

It is important to note that when the polymer electrolyte membrane is a cation conductor and is conducting protons, it contains a high concentration of protons during operation of the CRR, while the cathode operates best when a low concentration of protons is present. It can be useful to include a cathode buffer layer between the polymer electrolyte membrane and the cathode to provide a region of transition from a high concentration of protons to a low concentration of protons. In one arrangement, the cathode buffer layer is an ion-conducting polymer with many of the same properties as the ion-conducting polymer in the cathode. The cathode buffer layer provides a region for the proton concentration to transition from the polymer electrolyte membrane, which has a high concentration of protons to the cathode, which has a low proton concentration. Within the cathode buffer layer, protons from the polymer electrolyte membrane encounter anions from the cathode, and they neutralize one another. The cathode buffer layer helps ensure that a deleterious number of protons from the polymer electrolyte membrane does not reach the cathode and raise the proton concentration. If the proton concentration of the cathode is too high, COx reduction does not occur. High proton concentration is considered to be in the range of approximately 10 to 0.1 molar and low concentration is considered to be less than approximately 0.01 molar.

The cathode buffer layer can include a single polymer or multiple polymers. If the cathode buffer layer includes multiple polymers, the multiple polymers can be mixed together or can be arranged in separate, adjacent layers. Examples of materials that can be used for the cathode buffer layer include, but are not limited to, FumaSep FAA-3, Tokuyama anion exchange membrane material, and polyether-based polymers, such as polyethylene oxide (PEO), and blends thereof. Further examples are given above in the discussion of the cathode catalyst layer.

The thickness of the cathode buffer layer is chosen to be sufficient that COx reduction activity is high due to the proton concentration being low. This sufficiency can be different for different cathode buffer layer materials. In some embodiments, the thickness of the cathode buffer layer is between approximately 200 nm and 100 μm, between 300 nm and 75 μm, between 500 nm and 50 μm, or any suitable range.

In some embodiments, the cathode buffer layer is less than 50 μm, for example between 1-25 μm such between 1-5 μm, 5-15 μm, or 10-25 μm. By using a cathode buffer layer in this range of thicknesses, the proton concentration in the cathode can be reduced while maintaining the overall conductivity of the cell. In some embodiments, an ultra-thin layer (100 nm-1 μm and in some embodiments, sub-micron) may be used. And as discussed above, in some embodiments, the MEA does not have a cathode buffer layer. In some such embodiments, anion-conducting polymer in the cathode catalyst layer is sufficient. The thickness of the cathode buffer layer may be characterized relative to that of the PEM.

Water and $CO_2$ formed at the interface of a cathode buffer layer and a PEM can delaminate the MEA where the polymer layers connect. The delamination problem can be addressed by employing a cathode buffer layer having inert filler particles and associated pores. One possible explanation of its effectiveness is that the pores create paths for the gaseous carbon dioxide to escape back to the cathode where it can be reduced.

Materials that are suitable as inert filler particles include, but are not limited to, TiO2, silica, PTFE, zirconia, and alumina. In various arrangements, the size of the inert filler particles is between 5 nm and 500 μm, between 10 nm and 100 μm, or any suitable size range. The particles may be generally spherical.

If PTFE (or other filler) volume is too high, it will dilute the polymer electrolyte to the point where ionic conductivity is low. Too much polymer electrolyte volume will dilute the PTFE to the point where it does not help with porosity. In many embodiments a mass ratio of polymer electrolyte/PTFE is 0.25 to 2, and more particularly, 0.5 to 1. A volume ratio polymer electrolyte/PTFE (or, more generally, polymer electrolyte/inert filler) may be 0.25 to 3, 0.5 to 2, 0.75 to 1.5, or 1.0 to 1.5.

In other arrangements, porosity is achieved by using particular processing methods when the layers are formed. One example of such a processing method is laser ablation, where nano to micro-sized channels are formed in the layers. Another example is mechanically puncturing a layer to form channels through it. Another example is appropriately tailoring conditions during ultrasonic spray deposition of a layer to make it porous.

In one arrangement, the cathode buffer layer has a porosity between 0.01% and 95% (e.g., approximately between, by weight, by volume, by mass, etc.). However, in other arrangements, the cathode buffer layer can have any suitable porosity (e.g., between 0.01-95%, 0.1-95%, 0.01-75%, 1-95%, 1-90%). In some embodiments, the porosity is 50% or less, e.g., 0.1-50%, 5-50%, 20-50%, 5-40%, 10-40%, 20-40%, or 25%-40%. In some embodiments, the porosity is 20% or below, e.g. 0.1-20%, 1-10%, or 5-10%.

Porosity of the cathode buffer layer or any layer in the MEA may be measured as described above with respect to the catalyst layer, including using mass loadings and thicknesses of the components, by methods such as mercury porosimetry, x-ray diffraction (SAXS or WAXS), and image processing on TEM images to calculate filled space vs. empty space. Porosity is measured when the MEA is completely dry as the materials swell to varying degrees when exposed to water during operation. As described further below, the porosity may be determined using measured loading and thickness of the layer and known density of the material or materials of the layer.

Porosity in layers of the MEA, including the cathode buffer layer, is described further below.

Anode Buffer Layer (MEA Layer Description)

In some CRR reactions, bicarbonate is produced at the cathode. It can be useful if there is a polymer that blocks bicarbonate transport somewhere between the cathode and the anode, to prevent migration of bicarbonate away from the cathode. It can be that bicarbonate takes some $CO_2$ with it as it migrates, which decreases the amount of $CO_2$ available for reaction at the cathode. In one arrangement, the polymer electrolyte membrane includes a polymer that blocks bicarbonate transport. Examples of such polymers include, but are not limited to, Nafion® formulations, GORE-SELECT, FumaPEM® (PFSA) (FuMA-Tech GmbH), and Aquivion® (PFSA) (Solvay). In another arrangement, there is an anode buffer layer between the polymer electrolyte membrane and the anode, which blocks transport of bicarbonate. If the polymer electrolyte membrane is an anion-conductor, or does not block bicarbonate transport, then an additional anode buffer layer to prevent bicarbonate transport can be useful. Materials that can be used to block bicarbonate transport include, but are not limited to Nafion® formulations, GORE-SELECT, FumaPEM® (PFSA) (FuMA-Tech GmbH), and Aquivion® (PFSA) (Solvay). Of course, including a bicarbonate blocking feature in the ion-exchange layer is not particularly desirable if there is no bicarbonate in the CRR.

In another embodiment of the invention, the anode buffer layer provides a region for proton concentration to transition between the polymer electrolyte membrane to the anode. The concentration of protons in the polymer electrolyte membrane depends both on its composition and the ion it is conducting. For example, a Nafion polymer electrolyte membrane conducting protons has a high proton concentration. A FumaSep FAA-3 polymer electrolyte membrane conducting hydroxide has a low proton concentration. For example, if the desired proton concentration at the anode is more than three orders of magnitude different from the polymer electrolyte membrane, then an anode buffer layer can be useful to effect the transition from the proton concentration of the polymer electrolyte membrane to the desired proton concentration of the anode. The anode buffer layer can include a single polymer or multiple polymers. If the anode buffer layer includes multiple polymers, the multiple polymers can be mixed together or can be arranged in separate, adjacent layers. Materials that can be useful in providing a region for the pH transition include, but are not limited to, Nafion, FumaSep FAA-3, Sustainion®, Tokuyama anion exchange polymer, and polyether-based polymers, such as polyethylene oxide (PEO), blends thereof, and/or any other suitable materials. High proton concentration is considered to be in the range of approximately 10 to 0.1 molar and low concentration is considered to be less than approximately 0.01 molar. Ion-conducting polymers can be placed in different classes based on the type(s) of ions they conduct. This has been discussed in more detail above. There are three classes of ion-conducting polymers described in the table above. In one embodiment of the invention, at least one of the ion-conducting polymers in the cathode, anode, polymer electrolyte membrane, cathode buffer layer, and anode buffer layer is from a class that is different from at least one of the others.

Layer Porosity

In some embodiments, one or more of the layers of the MEA include pores that allow gas and liquid transport.

These pores are distinct from ion-conduction channels that allow ion conduction. In many polymer electrolytes (e.g. PFSA), ion conduction occurs through pores lined with stationary charges. The mobile cations hop between the oppositely charged stationary groups that line the ion conduction channel. Such channels may have variable width; for PFSA materials, the ion conduction channel diameter ranges from narrow areas of approximately 10 Å diameter to wider areas of approximately 40 Å diameter. In anion conducting polymer materials, the channel diameters may be larger, up to about a minimum width of 60 Å in the narrow areas of the channel.

For efficient ion conduction, the polymer-electrolyte is hydrated, so the ion conduction channels also contain water. It is common for some water molecules to move along with the mobile ions in a process termed electro-osmotic drag; typically 1-5 water molecules per mobile ion are moved via electro-osmotic drag. The ion-conducting channel structure and degree of electro-osmotic drag can vary with different polymer-electrolytes or ion-conducting materials. While these ion conducting channels allow ions to move along with some water molecules, they do not allow uncharged molecules to move through them efficiently. Nor do they allow bulk water that is not associated with ions to move through them. A solid (i.e., non-porous) membrane of a polymer electrolyte blocks the bulk of $CO_2$ and products of $CO_2$ electrolysis from passing through it. The typical permeability of $CO_2$, water, and $H_2$ through a wet Nafion 117 PFSA membrane at 30° C. are approximately 8.70×106 mol $cm^{-1}$ $s^{-1}$·$Pa^{-1}$, 4.2 (mol/cm-s-bar)×109, and 3.6 (mol/cm-s-bar)× 1011. Permeability depends on temperature, hydration, and nature of the polymer-electrolyte material. In ion conduction channels that have variable diameters, uncharged molecules and bulk movement of liquid/gas may be blocked at least at the narrow parts of the channel.

Pores of larger diameter that the ion conduction channels described above allow the passage of bulk liquid and gas, not just ions. The polymer electrolyte membrane layer of the MEA typically does not contain this type of pore because the membrane needs to separate reactants and products at the cathode from reactants and products at the anode. However, other layers of the MEA may have this type of pore, for example, the cathode catalyst layer may be porous to allow for reactant $CO_x$ to reach the catalyst and for products of $CO_x$ reduction to move out of the catalyst layer, through the gas distribution layer, and out the flow field of the electrolyzer. As used herein, the term pore refers to pores other than the ion conduction channels in an ionomer. In some embodiments, the pores of anion conducting polymer layer in an MEA have a minimum cross-sectional dimension of at least 60 Å. In some embodiments, the pores of cation conducting polymer layer in an MEA have a minimum cross-sectional dimension of at least 20 Å. This is to distinguish pores that allow gas/liquid transport from the ion conduction channels described above.

It can be useful if some or all of the following layers are porous: the cathode, the cathode buffer layer, the anode and the anode buffer layer. In some arrangements, porosity is achieved by combining inert filler particles with the polymers in these layers. Materials that are suitable as inert filler particles include, but are not limited to, $TiO_2$, silica, PTFE, zirconia, and alumina. In various arrangements, the size of the inert filler particles is between 5 nm and 500 microns, between 10 nm and 100 microns or any suitable size range. In other arrangements, porosity is achieved by using particular processing methods when the layers are formed. One example of such a processing method is laser ablation, where nano to micro-sized channels are formed in the layers. Laser ablation can additionally or alternatively achieve porosity in a layer by subsurface ablation. Subsurface ablation can form voids within a layer, upon focusing the beam at a point within the layer, and thereby vaporizing the layer material in the vicinity of the point. This process can be repeated to form voids throughout the layer, and thereby achieving porosity in the layer. Sublayer by sublayer methods of forming an MEA layer such as ultrasonic spray deposition may be used to form an MEA layer having a controlled porosity. A dry deposit can lead to faster drying of layers and a more porous final deposit. One or more of high substrate temperature, slow deposition rate, high elevation of nozzle from the substrate, and high volatility of deposition ink can be used to make the layer more porous. A wet deposit can lead to slower can lead to slower drying of layers, densification and compaction of several layers for the final deposit. One or more of low substrate temperature, fast deposition rate, low elevation of spray nozzle from the substrate, and low volatility of the deposition ink can be used to make the layer less porous. For example, a room temperature ultrasonic spray deposition may result in a relatively dense layer and a 50° C. ultrasonic spray deposition may result in a relatively porous layer.

In some embodiments, the following conditions may be used to form layers having porosities of at least 1%, e.g., 1-90%, 1-50%, or 1-30% porosity:substrate temperature of at least 40° C.; deposition rate of no more than 0.8 mL/min, e.g., 0.2-0.8 mL/min; elevation of nozzle of at least 50 mm, e.g., 50-75 mm; and solvent volatility of at least 90-100% (e.g., ethanol).

In some embodiments, the following conditions may be used to form layers having non-porous layers or layers having porosities of less than 1%:substrate temperature of less than 40° C.; deposition rate of more than 0.8 mL/min and up to 10 mL/min; elevation of nozzle of less than 50 mm; and lower solvent volatility of at least 90-100% (e.g., 50-90% volatile solvent content such as ethanol or 50-100% intermediate volatility of solvent such as glycol ethers).

The volume of a void may be determined by the laser power (e.g., higher laser power corresponds to a greater void volume) but can additionally or alternatively be determined by the focal size of the beam, or any other suitable laser parameter. Another example is mechanically puncturing a layer to form channels through the layer. The porosity can have any suitable distribution in the layer (e.g., uniform, an increasing porosity gradient through the layer, a random porosity gradient, a decreasing porosity gradient through the layer, a periodic porosity, etc.).

The porosities (e.g., of the cathode buffer layer, of the anode buffer layer, of the membrane layer, of the cathode layer, of the anode layer, of other suitable layers, etc.) of the examples described above and other examples and variations preferably have a uniform distribution, but can additionally or alternatively have any suitable distribution (e.g., a randomized distribution, an increasing gradient of pore size through or across the layer, a decreasing gradient of pore size through or across the layer, etc.). The porosity can be formed by any suitable mechanism, such as inert filler particles (e.g., diamond particles, boron-doped diamond particles, polyvinylidene difluoride/PVDF particles, polytetrafluoroethylene/PTFE particles, etc.) and any other suitable mechanism for forming substantially non-reactive regions within a polymer layer. The inert filler particles can have any suitable size, such as a minimum of about 10 nanometers and a maximum of about 200 nanometers, and/or any other suitable dimension or distribution of dimensions.

As discussed above, the cathode buffer layer preferably has a porosity between about 1 and 90 percent by volume but can additionally or alternatively have any suitable porosity (including, e.g., no porosity). However, in other arrangements and examples, the cathode buffer layer can have any suitable porosity (e.g., between 0.01-95%, 0.1-95%, 0.01-75%, 1-95%, 1-90%, etc.). in some embodiments, the porosity is 20% or below, e.g. 0.1-20%, 1-10%, or 5-10%.

In some embodiments, the cathode buffer layer is porous but at least one layer between the cathode layer and the anode layer is nonporous. This can prevent the passage of gases and/or bulk liquid between the cathode and anode layers while still preventing delamination. For example, the nonporous layer can prevent the direct passage of water from the anode to the cathode.

Porosity of the cathode buffer layer or any layer in the MEA may be measured as described above with respect to the catalyst layer, including using mass loadings and thicknesses of the components, by methods such as mercury porosimetry, x-ray diffraction (SAXS or WAXS), and image processing on TEM images to calculate filled space vs. empty space. Porosity is measured when the MEA is completely dry as the materials swell to varying degrees when exposed to water during operation. Porosity can be determined using the known density of the material, the actual weight of the layer per given area, and the estimated volume of the layer based on the area and thickness. The equation is as follows:

$$\text{Porosity} = 100\% - \frac{\dfrac{\text{layer loading}\left(\dfrac{\text{mg}}{\text{cm}^2}\right)}{\text{density of material}\left(\dfrac{\text{mg}}{\text{cm}^3}\right)}}{\text{layer thickness (cm)}} \times 100\%$$

As indicated above, the density of the material is known, and the layer loading and thickness are measured. For example, in a polymer electrolyte layer with a measured loading of 1.69 mg/cm$^2$ made of 42 wt % anion-exchange polymer electrolyte with a density of 1196 mg/cm$^3$ and 58 wt % PTFE with a density of 2200 mg/cm$^3$ and a total layer thickness of 11.44 microns, the porosity is:

$$\text{Porosity} = 100\% - \frac{\dfrac{1.69\left(\dfrac{\text{mg}}{\text{cm}^2}\right)\times 0.42}{1196\left(\dfrac{\text{mg}}{\text{cm}^3}\right)} + \dfrac{1.69\left(\dfrac{\text{mg}}{\text{cm}^2}\right)\times 0.58}{2200\left(\dfrac{\text{mg}}{\text{cm}^3}\right)}}{0.001144\ (\text{cm})} \times 100\% = 9.1\%$$

As indicated above, the polymer electrolyte layers may have ion conduction channels that do not easily permit the gas/liquid transport. In the calculation above, these ion conduction channels are considered non-porous; that is, the density of the non-porous material above (42 wt % anion-exchange polymer electrolyte) includes the ion conduction channels and is defined by the calculation to be non-porous.

In another example, an ion conductive layer without filler is porous. Porosity may be introduced by appropriate deposition conditions, for example. The measured loading of the porous polymer electrolyte layer is 2.1 g/cm$^2$ and the thickness is 19 micrometers. The known density of the polymer electrolyte with ion-conducting channels but without pores is 1196 g/cm$^3$. The porosity is then calculated as:

$$\text{Porosity} = 100\% - \frac{\dfrac{2.1\left(\dfrac{\text{mg}}{\text{cm}^2}\right)}{1196\left(\dfrac{\text{mg}}{\text{cm}^3}\right)}}{0.0019\ (\text{cm})} \times 100\% = 3.2\%$$

MEA Fabrication

MEAs for $CO_x$ reduction may be fabricated using a variety of techniques. In various embodiments, MEAs fabrication employs multiple steps. Small differences in the parameters of the fabrication process can make a large difference in performance.

In certain embodiments, MEA fabrication employs a polymer-electrolyte membrane (e.g., a Nafion PEM) layer and depositing or otherwise forming an anion-exchange polymer electrolyte layer and cathode catalyst layer on the cathode side of the membrane and depositing or otherwise forming an anode catalyst layer on the anode side of the membrane. An alternate route is to fabricate the catalyst layers on to porous gas diffusion layers (e.g., carbon for the cathode or titanium for the anode) and sandwich the membrane (which may include the anion-exchange layer) between catalyst containing porous layers. In certain embodiments, catalyst layers are fabricated by making an ink of the solid catalyst and support particles and polymer electrolyte dispersed in a solvent. The ink may be applied by a variety of methods to the polymer electrolyte membrane or GDL. The solvent subsequently evaporates leaving behind a porous solid catalyst layer.

Imaging methods may be used to characterize the thickness, uniformity, and surface roughness. The thickness should be consistent and controllable, and the uniformity smooth and as defect free as possible.

Various techniques may be employed to form the individual layers of the MEA. Generally, these techniques form the layer on a substrate such as a PEM layer or GDL as mentioned herein. Examples of such techniques include ultrasonic spray deposition, doctor blade application, gravure, screen printing, slot die coating, and decal transfer.

Catalyst inks using anion-exchange polymers are not well studied (particularly for certain polymers) and do not have the same solution structure as typical Nafion-based inks used in fuel cells and electrolyzers. The formulation and steps needed for form a well dispersed and stable catalyst ink were not known. It is believed that Nafion forms micell-like structures that allow relatively easy suspension in aqueous media. Other ion-conducting polymers and particularly some anion-conducting polymers do not form such structures and therefore are more difficult to provide in suspensions.

In certain embodiments, a catalyst layer ink is prepared by mixing metal or metal supported on carbon catalyst with ion-conducting polymer (e.g., an anion-conducting polymer) and dispersing in solvent (alcohol, etc.) by sonicating.

As indicated, certain fabrication techniques utilize doctor blade application, screen printing, decal transfer, electrospinning, etc. Roll-to-roll techniques such as gravure or microgravure or slot die coating may be used for high throughput processing.

In some embodiments, the cathode side of the MEAs is fabricated by first depositing a layer of anion-exchange polymer-electrolyte on top of a cation-exchange polymer electrolyte membrane. Then a second layer of cathode catalyst is applied on top of the anion-exchange layer. This process produces a catalyst coated membrane. Gas diffusion electrodes may be prepared by depositing the catalyst onto a gas diffusion layer. The anion exchange layer can be deposited onto the catalyst layer or the membrane. The layers can then be pressed together inside the electrolysis cell to make a functioning device. Many methods, including doctor blade, gravure or micro gravure, slot die, decal transfer, screen printing, ultrasonic spray deposition and others can be used to fabricate the anion-exchange polymer layer and the cathode catalyst layer. A more detailed description of MEA cathode fabrication using ultrasonic spray deposition follows:

The cathode side of the MEA is fabricated by first forming a solution of polymer-electrolyte (approximately 1-25 wt %) in a suitable solvent, such as ethanol, n-propanol, isopropanol, or other high vapor pressure and/or low boiling point solvent that will evaporate on a reasonable timescale during fabrication. Mixtures of solvents with one or more higher boiling point components can be used. The polymer electrolyte solution is pushed through an ultrasonic spray deposition nozzle at a desired flow rate. The ultrasonic spray deposition nozzle is held at the desired frequency to disperse the polymer-electrolyte solution into small droplets that are then pushed by an air stream onto a polymer-electrolyte membrane substrate. The polymer-electrolyte membrane may be treated with heat, solvent, or other means before deposition. The small droplets of polymer-electrolyte solution land on polymer-electrolyte membrane substrate where the solvent evaporates and leaves behind the entrained polymer-electrolyte. The ultrasonic spray deposition nozzle moves back and forth across the substrate multiple times with the desired pattern with the desired speed to build up a polymer-electrolyte layer on top of the membrane substrate until the desired thickness is reached. This process is then repeated using a solution of catalyst particles, anion-exchange polymer electrolyte and/or other additives, and a suitable solvent or mixture of solvents; this solution is termed the catalyst ink. The catalyst ink is deposited via ultrasonic spray deposition using the same or different fabrication parameters to form the cathode catalyst layer on top of the anion-exchange polymer layer on the cathode side of the MEA.

MEA Scale Up

As indicated, certain applications of MEAs for $CO_x$ reduction may require relatively large formats. For example, some MEAs have active surface areas (excluding pores) of at least about 500 $cm^2$. And in some other embodiments, MEAs have even larger active surface areas (excluding pores), or e.g., at least about 650 $cm^2$ or 1500 $cm^2$.

To make MEAs with such large active surface areas, an appropriate manufacturing process must be chosen, i.e., a process that can support large volumes of catalyst ink and large surface areas to which the catalyst ink is applied. Scaling up the catalyst ink requires particular methods of dispersing the catalyst particles to ensure good dispersion in large volumes. The ink may be set at a target dispersity, which dynamic light scattering (DLS) can be used to characterize. The ink should be stable within the time range of the layer deposition.

Additionally, humidity and temperature should be tightly controlled. Evaporation rates and processes impact the resulting deposition, so controlling these things within a 1-2 degree temperature window, and roughly 5% RH range is useful.

For ultrasonic spray deposition, thin lines of catalyst ink are laid down by a moving ultrasonic nozzle. The nozzle movement speed and ink flow rate may need to be increased for larger area MEAs. The flow rate and move speed are at least be doubled going from 25 $cm^2$ to a 650 $cm^2$ scale MEA. Water in the solvent is important and adding more water into the ink helps the stacking of droplets be smoother. For example, about 20% water in the formulation may be used for a 650 $cm^2$ MEA.

Catalyst inks are generally relatively less stable, so in certain embodiments, the MEA fabrication time is designed to be relatively short, even when active area is larger. As an example, for a 650 $cm^2$ spray, a deposition time of about 2 hours for the ionomer layer and 1 hour for the catalyst layer may be used. This is relatively fast for such a larger area and can be achieved using the fast flow rate and move speed.

MEA Scale Up Examples

Below are examples of scaling up MEA fabrication. Examples are provided for scaling from 25 $cm^2$ to 650 $cm^2$.

Solvent mixture adjusted (water to alcohol ratio): depending on the size of the spray scale, solvent adjustment from 10% water to 20% water significantly helps with surface uniformity of the surface Deposition Parameters:

- for the ionomer layer: flow rate is increased from 0.4 mL/min to 0.8 mL/min and move speed is changed from 50 mm/s to 100 mm/s
- for the catalyst layer: flow rate is increased from 0.25 mL/min to 0.5 mL/min and move speed is changed from 80 mm/s to 160 mm/s Morphology and thickness: Thickness can be matched from looking at the thickness of fabricated layers in SEM images. Adjustments can be made on characterization data to match the thickness. The morphology is controlled with parameters such as water content and fabrication.

For further scale up, e.g., to 1500 $cm^2$, flow rate and move speed may be further increased, e.g., with ranges being from 0.25-2 mL/min and 30-200 mm/s.

The speed of deposition can be further increased, e.g., to 5-8 mL/min or 5-15 mL/min, by increasing the weight of solids in the solution. In some embodiments, the solution may be greater than 5 wt. %, greater than 10 wt. %, greater than 20 wt. %, or greater than 30 wt. %.

MEA Post Treatments

After the MEA is fabricated, additional treatments may be used to increase performance. Examples the types of performance improvement include lifetime and voltage. These improvements may be manifest in MEAs that have structural modifications resulting from the treatments including better adhesion between layers.

MEA Post Treatment Examples

Hot pressing: heating the MEA under pressure to bond the layers together. Hot pressing is a step sometimes used in MEA fabrication where the MEA including the membrane and catalyst layers and sometimes GDLs are compressed together for a period of time at a desired temperature. Hot pressing is used to decrease the interfacial resistance and increase adhesion between layers and can help 'melt' layers together to prevent delamination. Example times, temperatures, and pressures are given below:

- Time: about 2 min to 10 min (MEA only); 1.5 min to 2 min (MEA+gas distribution layer (GDL)); the "MEA+GDL" may be pressed at least twice to form a stable assembly
- Temperature: about 100° C. to 195° C.;
- Pressure: between 28 psi and 2900 psi. In one example, between about 300 psi and 600 psi may be used for a 3×3 inch ½ MEA but the MEA can tolerate about 2500 psi without GDL;

The temperature of the hot press is typically selected so that it is above the glass transition temperature of the polymer electrolyte, but below the temperature where any materials of the MEA become structurally or chemically damaged. The glass transition temperature is the temperature above which the polymer-electrolyte becomes soft, which may allow for the polymer-electrolyte at layer interfaces to deform and form a better contact with lower ionic transport resistance and better adhesion.

Hydration: soaking the MEA in water or aqueous solutions to wet the polymer-electrolytes prior to cell assembly Boil Nafion or other polymer electrolyte MEA. This permanently changes the macrostructure of the polymer electrolyte and increases the amount of water in the polymer matrix. This increases ionic conductivity, but also increases water transport number.

Heat to dry. This permanently decrease water content and can reduce the amount of water transported through the polymer electrolyte during operation. Example times and temperatures for heating various MEAs are below.

| MEA | Time (Hour) | Temperature (° C.) |
|---|---|---|
| Nafion 115 25 $cm^2$ ½ MEA | 24 | 10-30 |
| Nafion 115 100 $cm^2$ ½ MEA | 48 | 10-30 |
| Nafion 117 25, 100 $cm^2$ ½ MEA | 24 | 10-30 |
| Nafion 212 ½ MEA | 24 | 10-30 |
| Nafion 211 ½ MEA | 24 | 10-30 |

½ MEA refers to the polymer-electrolyte membrane coated with the anode catalyst layer on one side.

Stabilized Interface Between MEA Layers

Water and $CO_2$ formed at the interface of an anion-conducting layer (e.g., a cathode buffer layer) and a cation-conducting membrane (e.g., a PEM) can cause the two layers to separate or delaminate where the polymer layers connect. The reaction at the bipolar interface is depicted in FIGS. 1 and 2.

In addition, it is desirable for the $CO_2$ to return to the cathode of the cell where it can be reduced instead of lost to the anode, so a pathway (e.g., pores) in an anion-exchange layer (e.g., a cathode buffer layer and/or cathode layer) provides both a way to remove water and $CO_2$ from the interface to prevent delamination and return $CO_2$ to the cathode where it can react.

Figure 2:
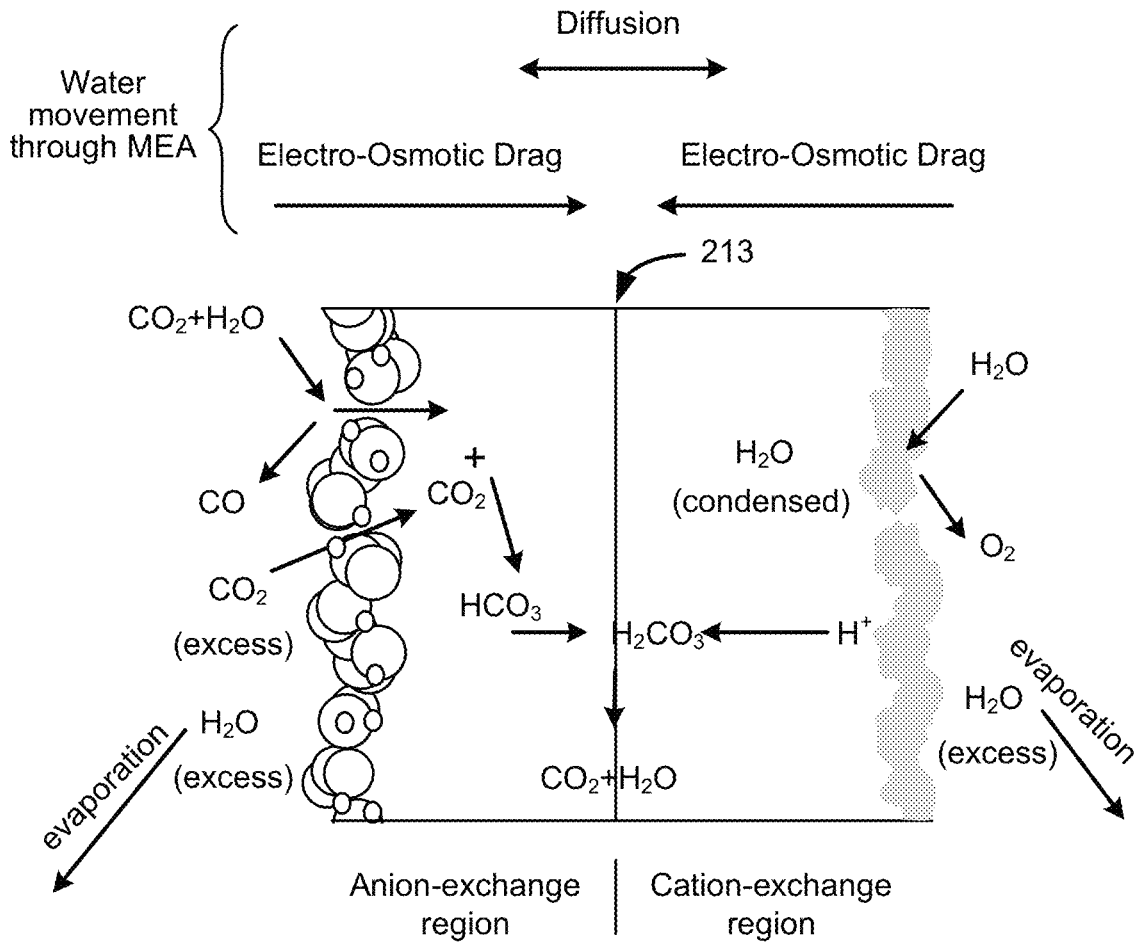
FIG. 2 is a schematic illustration of a bipolar interface of a MEA in accordance with certain disclosed embodiments.

FIG. 2 is similar to FIG. 1, but it includes additional information relevant to mass transport and generation of $CO_2$ and water at a bipolar interface. For example, it shows hydroxide and $CO_2$ reacting on the cathode side to produce bicarbonate ions, which move toward the bipolar interface 213. On the anode side, hydrogen ions produced by water oxidation move toward bipolar interface 213, where they react with the bicarbonate ions to produce water and $CO_2$, both of which should be allowed to escape without damaging the bipolar layers.

Also depicted in FIG. 2 are water transport paths including (a) electro-osmotic drag with anions from the cathode to interface 213, (b) electroosmotic drag with cations from the anode to interface 213, and (c) diffusion. Water evaporates at the anode and cathode.

Various MEA designs contain features that resist delamination and optionally provide a pathway for the reaction products to leave the interface area. In some embodiments, the bipolar interface is flat. But in some designs, the interface is provided with a composition gradient and/or interlocking structures. These are described further below with reference to FIGS. 3A, 3B, 3C, and 3D, which illustrate bipolar interfaces of MEA designs configured to resist delamination.

Engineering the interface can be used to reduce undesired co-ion leakage through the anion exchange membrane (AEM) and cation exchange membrane (CEM) and improving the mechanical stability of bipolar membrane with better adhesion. Chemical and physical modifications to the interface can be used to achieve these two goals. As described further below, the AEM and CEM layers can be chemically bonded through multiple cross-linking pathways: side chain, backbone, backbone-to-side-chain, and triple cross-linking. In some embodiments, the AEM and CEM layers interpenetrate. This can include one or more of a gradient of anion-exchange and cation-exchange polymers, a mixture of anion-exchange and cation-exchange polymers, and/or protrusions of at least one polymer extending into the other.

There are also different ways to physically modify the interface. Hot-pressing the AEM and CEM close to their respective glass transition temperature can increase the adhesion between the AEM and CEM. In some embodiments, adhesion is improved by increasing the interfacial surface area through electrospinning anion and cation exchange layers. In such embodiments, the anion and cation exchange ionomers to have similar swelling properties to avoid delamination. Adding a small concentration of a third polymer (e.g. PTFE) to the intertwined ionomers could also facilitate water removal from the interface. The surface of both the CEM and AEM can be intentionally roughened through plasma surface treatment, etching, or hot-pressing with a woven or patterned fabric. One or more of these techniques may be used to increase contact between the AEM and CEM.

In some embodiments, the interface includes a gradient. A gradient may be formed, for example, by using two nozzles during spray deposition and adding anion-exchange polymer with the relative amounts of the polymers varied during deposition of the cation-exchange layer. Similarly, cation-exchange polymer may be added during deposition of the anion-exchange layer. Referring for example to FIG. 2, a gradient may extend through substantially all or a portion of the anion-exchange region and cation-exchange region, such that the anion-exchange region has predominantly anion-exchange polymer adjacent to the cathode with the relative amount of cation-exchange polymer increasing moving from the cathode toward the interface 213. Similarly, the cathode-exchange region has a predominantly cation-exchange polymer adjacent the anode cathode with the relative amount of anion-exchange polymer increasing moving from the anode toward the interface 213. In some embodiments, there are a pure anion-exchange and pure cation-exchange regions with a gradient between the two.

In some embodiments, the layers of the bipolar membrane are melted together. This may be accomplished by choosing an appropriate solvent. For example, Nafion is at least slightly soluble in a water/ethanol mixture. By using that mixture (or another solvent in which the cation-conducting polymer is soluble) as a solvent for the anion-conducting polymer can result in Nafion or other cation-conducting polymer at least slightly dissolvent and melting into the interface. In some embodiments, this results in a thin gradient, e.g., one that extends 0.5-10% into the anion-conducting polymer layer thickness.

Figure 3A:
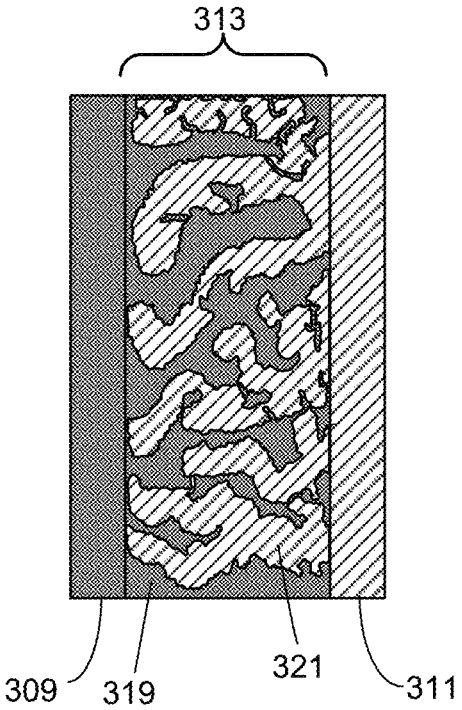
FIGS. 3A-3D are schematic illustrations of bipolar interfaces of MEAs that are configured to resist delamination in accordance with certain disclosed embodiments.

In some embodiments, the interface includes a mixture of the polymers. FIG. 3A illustrates a bipolar interface 313 in which a cation-conducting polymer 321 and an anion-conducting polymer 319 are mixed. In the example of FIG. 3A, a portion of an anion-conducting polymer layer 309 and a portion of a cation-conducting polymer layer 311 are shown. The anion-conducting polymer layer 309 may be a pure anion-conducting polymer and the cation-conducting polymer layer 311 may be pure cation exchange polymer. The cation-conducting polymer 321 may be the same or different cation-conducting polymer as in the cation-conducting polymer layer 311. The anion-conducting polymer 319 may be the same or different anion-conducting polymer as in the anion-conducting polymer layer 309.

Figure 3B:
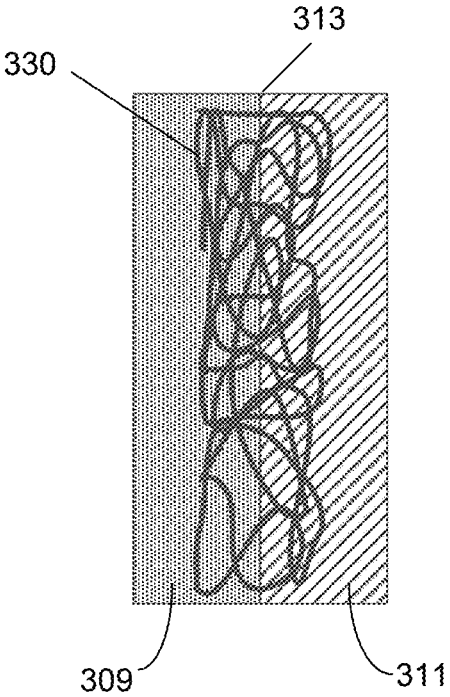

In some embodiments, the interface includes a third material that physically reinforces the interface. For example, FIG. 3B shows an example of a material 330 that straddles interface 313. That is, the material 330 partially resides in an anion-conducting polymer layer 309 and a cation-conducting polymer layer 311. Because of this, material 330 may bind the two layers in a manner that resists delamination. In one example, the material 330 is an inert material, such as PTFE, polyvinylidene difluoride (PVDF), a charged colloidal sphere such as a surface-modified metal hydroxide sphere such as $Al(OH)_3$ with trimethylaluminum (TMA). The inert material may be in the form of a web or mesh with gaps that can be filled by the ionomers. Such an interface may be fabricated, for example, by casting or otherwise applying the cation-conducting polymer and the anion-conducting polymer on opposite sides of a PTFE mesh or similar structure, followed by hot pressing.

Figure 3C:
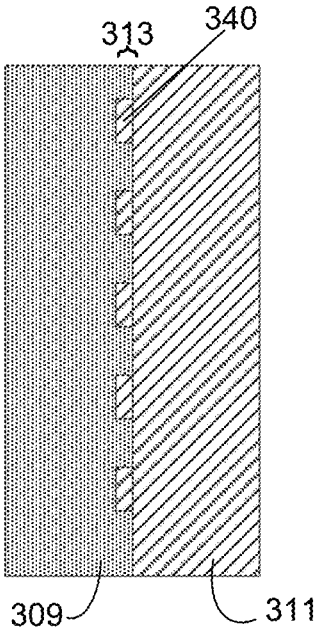

FIG. 3C illustrates a bipolar interface 313 having protrusions 340 of the cation-conducting polymer extending from the cation-conducting polymer layer 311 into the anion-conducting polymer layer 309. These protrusions may mechanically strengthen interface 313 so that it does not delaminate when $CO_2$ and water are produced at the interface. In some embodiments, protrusions extend from anion-conducting polymer layer 309 into cation-conducting polymer layer 311. In certain embodiments, protrusions extend both directions. Example dimensions are 10 μm-1 mm in the in-plane dimension, though smaller dimensions (e.g., 500 nm-1 μm) are possible. The out-of-plane dimension may be for example, 10-75% or 10-50% of the total thickness of the anion exchange layer. The protrusions may be fabricated for example by any appropriate technique such as lithographic techniques or by spraying the polymer into a patterned mesh that is then removed. Surface roughening techniques may also be used to create protrusions. In some embodiments, protrusions may be formed from a different material, e.g., a non-ion-conducting polymer, a ceramic, or a metal to help interlock the polymer layers and mechanically strengthen the interface.

Figure 3D:
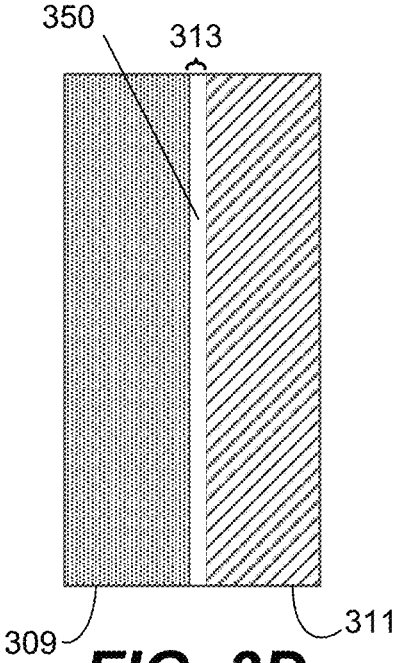

FIG. 3D illustrates a bipolar interface 313 having an interface region 350 disposed between the cation-conducting polymer layer 311 and the anion-conducting polymer layer 309. The interface region 350 is or includes a third material. In some embodiments, the third material is mixed with one or both of the polymers. In some embodiments, the third material separates the polymers and is not mixed with them.

The third material is generally confined to the interface region 350. While it may be mixed with one or both of the cation conducting polymer and the anion conducting polymer, it does not extend beyond the region 350.

In some embodiments, a third material may be in the form of particulates. The particulates may be in a mixture with other components such as ion-conducting polymers and additives. The particles may of any appropriate shape including spherical, fibrous, tubular, etc. In some embodiments, the particles are nanoparticles. These may or may not be in the form of aggregates. Aggregates include spheroidal aggregates, ellipsoidal aggregates, linear aggregates, branched aggregates, and combinations thereof.

In some embodiments, the particles are or include carbon. Carbon particles include single-walled or multiwall carbon nanotubes, fullerenes, spheroid carbon particles, carbon powders, etc.

In some embodiments, the particles are ceramic nanoparticles including inorganic solids made up of oxides, carbides, carbonates and phosphates. In a particular example, the nanoparticles may be magnesium oxides. In some embodiments, the particles are metal nanoparticles, such as iridium, gold, platinum or titanium. In some embodiments, the particles are polymeric or lipid-based nanoparticles.

In some embodiments, the nanoparticles may be from about 1 to about 250 nanometers in size, or from about 10 to about 100 nanometers. In some embodiments, the nanoparticles are about 50 nanometers. Size refers to average diameter. Agglomerations of particles may have larger diameters, e.g., from 250 to micrometer scale.

Carbon nanoparticles have large specific surface areas and high electrical conductivity due to their $sp^2$-hybridized carbon atomic structures. In some embodiments, they may be covalently or non-covalently functionalized. Covalent functionalization may be direct or indirect. For example, aromatic molecules such as 2,3-dichloro-5,6-dicyano-1,4-benzoquinone (DDQ) may be utilized to enhance electrical properties or carbon nanotubes, due to coupling of π electrons between the aromatic molecule and the nanotube.

In some embodiments, the third material is or includes one or more porosity enhancing agents. Any particulate third material may be a porosity enhancing agent, with porosity introduced from packing of agglomerated particles. Porosity enhancing agents are further described above with respect to porosity in various layers of the MEA. Porosity may also be introduced to the interface region by any appropriate method including appropriate spray deposition techniques, the use of porogens, etc. A porosity enhancing agent in the interface region may be different from that in a cathode buffer layer.

In some embodiments, the third material is or includes a voltage damping agent. Porosity enhancing agents as discussed above can act as voltage damping agents.

The high surface area of nanoparticles creates the capacity to absorb a discharge current, such as occurs during a power interruption, a recovery process, an unplanned outage, or equipment shutdown. The AEM/PEM interface is a low surface area interface, so introduction of particulate material at the interface beneficially increases surface area for discharge current absorption. When the discharge current is absorbed, any putative voltage increase from the power interruption can be reduced.

In operation of a carbon oxide reduction reactor, a recovery process may be periodically performed, as discussed further below. During a recovery process, cell selectivity may be increased, yet an undesirable irreversible voltage increase may accompany the desirable increased selectivity. The irreversible voltage increase can cause deleterious membrane degradation. Use of a voltage damping agent material such as carbon nanoparticles at the interface of the AEM and PEM facilitates recovery processes, as it reduces or prevents voltage-induced degradation. Thus, a more aggressive recovery process can be performed.

In some embodiments, the third material is or includes a water splitting catalyst. When an electrochemical cell is turned off, an energy intensive water splitting process may occur at the interface of the anion exchange membrane and the proton exchange membrane, leading to membrane decay. This is a reverse reaction, as during normal operation there is a buildup of water and carbon dioxide at the interface. The water is consumed during the reverse reaction. This can cause higher resistance and heat generation, which can degrade the membranes. When a particulate material such as carbon nanoparticles is utilized at the interface, it may act as a catalyst, facilitating the water splitting process and decreasing membrane decay. Similarly, other catalyst materials can perform the same function. Suitable catalysts may include iridium, gold, platinum, or titanium.

In some embodiments, the third material is a mixture composed of particulates dispersed in polymer. The polymer/nanoparticle mixture may be made by dissolving the polymer in a solvent. The dissolved polymer may then be combined with the nanoparticles and aggressively mixed or sonicated to make a stable and well-dispersed mixture which is spray deposited on a membrane. In some embodiments, the membrane surface may be roughened prior to spray deposition of the polymer/nanoparticle interfacial mixture.

In some embodiments, the polymer is an ion-conducting polymer. Useful ion-conducting polymers include those described in the Polymeric Structures section above. In some embodiments, the polymer has a molecular weight of 100 g/mol or higher. In some embodiments, the ion-conducting polymer is an anion-conducting polymer, a cation conducting polymer, or an anion and cation conducting polymer as described in the table of Ion-Conducting Polymers above. In some embodiments, polymer is a cation-conducting polymer such as a sulfonated tetrafluoroethylene-based fluoropolymer copolymer. Examples include Nafion 115, Nafion 117, Nafion 211, Nafion 324, Nafion 350, Nafion 417, Nafion 424, Nafion 438, Nafion 450, Nafion 521 or Nafion 551. Polymers may be dissolved in a suitable solvent for spray application. In certain embodiments, solvents include ethanol, 1-propanol, 2-propanol, water or a mixture thereof. The concentration of polymer in solvent may range from about 1 to about 20 weight percent.

For example, the third material may be a mixture of a cation-conducting sulfonated tetrafluoroethylene-based fluoropolymer copolymer and carbon nanoparticles. The ratio of polymer to nanoparticle may be from about 10:1 to about 1:0.01; or from about 5:1 to about 2:1 weight percent. In some embodiments the ratio is about 1:1 weight percent.

According to various embodiments, the ion-conducting polymer in the interface region may be the same as that of the cation-conducting polymer layer or the anion-conducting polymer layer. In some embodiments, the ion-conducting polymer in the interface region is different from that of the cation-conducting polymer layer and the anion-conducting polymer layer. In some embodiments, the interface region may include a third material (e.g., carbon nanoparticles) that is embedded in both the anion-conducting polymer layer and the cation-conducting polymer layer.

In some embodiments, the interface region 350 may be about 0.1 to about 20 micrometers thick, about 1 to about 10 micrometers thick or about 1 to about 5 micrometers thick. In some embodiments, the interface is 3 micrometers thick. The ratio of the thickness of the anion-conducting polymer layer to the interface may be about 20:1, about 10:1, or about 2:1.

The present disclosure additionally encompasses a method for mitigating effects of electrical current fluctuation. In some embodiments, the method of mitigating effects of electrical current fluctuation on bipolar membrane electrochemical cells includes providing an electrochemical cell having a bipolar membrane, wherein the bipolar membrane includes an anion-conducting polymer layer and a cation-conducting polymer layer and an interfacial layer between the anion-conducting polymer layer and the cation-conducting polymer layer of the bipolar membrane; and wherein the interfacial layer includes nanoparticles such as carbon nanoparticles; and subjecting the electrochemical cell to electrical current fluctuation, whereby degradation of at least one of the anion-conducting polymer layer and the cation-conducting polymer layer caused by electrical current fluctuation is reduced.

In some embodiments, the electrical current fluctuation results from turning the cell on and off. In some embodiments, the electrical current fluctuation results from a power interruption, a current reversal, or a power outage. In some embodiments, degradation of the anion-conducting polymer layer and the cation-conducting polymer layer caused by electrical current fluctuation is reduced. In some embodiments, the bipolar membrane electrochemical cell's lifetime is extended.

Returning to FIG. 3D, in some embodiments, for example, the third material can be an additive as discussed further below. In some embodiments, the third material can be a blend of anion-conducting and cation-conducting ionomers at the interface. For example, it can be a mixture of Nafion 5 wt % ionomer and Orion 2 wt % mTPN1. In some embodiments, the third material may include ion acceptors and donors, either mixed together or provided as distinct layers.

In some embodiments, the interface region includes additives to facilitate acid-base reactions and prevent delamination. In some embodiments, the additives may facilitate spreading out the acid base recombination a larger volume instead of just at a 2D interface of the anion conducting polymer and cation conducting polymer. This spreads out water and $CO_2$ formation, heat generation, and may lower the resistance of the membrane by decreasing the barrier to the acid-base reaction. These effects can be advantageous in helping avoid build-up of products, heat, and lowering resistive losses in the MEA leading to a lower cell voltage. Further, it helps avoid degrading materials at the interface due to heat and gas production.

Examples of additives that facilitate acid-base reactions include molecules that are both proton and anion acceptors, such as hydroxide containing ionic liquids with 1-butyl-3-methylimidazolium hydroxide being a specific example. Other ionic liquids may also be used, including those having one of the following ionic groups: N,N,N,N-tetraalkylammonium (e.g., N,N,N,N-tetramethylammonium, N,N-dimethyl-N,N-dipropylammonium, or N-methyl-N,N,N-tri-$C_{1-12}$ alkylammonium), N,N,N-trialkylammonium-1-yl (e.g., N,N,N-trimethylammonium-1-yl, N-methyl-N,N-dipropylammonium-1-yl, or N,N,N-tri-$C_{1-12}$ alkylammonium-1-yl), N,N,N-trialkyl-N-alkoxyalkylammonium (e.g., N,N,N-trimethyl-N-alkoxyalkylammonium, N-methyl-N,N-diethyl-N-methoxyethylammonium, or N,N,N-tri-$C_{1-12}$ alkyl-N—$C_{1-6}$ alkoxy-$C_{1-6}$ alkylammonium), N,N-dialkyl-N-alkoxyalkylammonium-1-yl (e.g., N,N-dimethyl-N-alkoxyalkylammonium-1-yl or N,N-di-$C_{1-12}$ alkyl-N—$C_{1-6}$ alkoxy-$C_{1-6}$ alkylammonium-1-yl), N,N-dialkylpyrrolidinium (e.g., N,N-dimethylpyrrolidinium, N-methyl-N-ethylpyrrolidinium, or N-methyl-N—$C_{1-12}$ alkylpyrrolidinium), N-alkylpyrrolidinium-1-yl (e.g., N-methylpyrrolidinium-1-yl or N—$C_{1-12}$ alkylpyrrolidinium-1-yl), N,N-dialkylpiperidinium (e.g., N,N-dimethylpiperidinium, N-methyl-N-ethylpiperidinium, or N-methyl-N—$C_{1-12}$ alkylpiperidinium), N-alkylpiperidinium-1-yl (e.g., N-methylpiperidinium-1-yl or N—$C_{1-12}$ alkylpiperidinium-1-yl), N,N,4-trialkylpiperidinium (e.g., N,N,4-trimethylpiperidinium, N,4-dimethyl-N-ethylpiperidinium, or N-methyl-N,4-di-$C_{1-12}$ alkylpiperidinium), N,4-dialkylpiperidinium-1-yl (e.g., N,4-dimethylpiperidinium-1-yl or N,4-di-$C_{1-12}$ alkylpiperidinium-1-yl), N,N,3,5-tetraalkylpiperidinium (e.g., N,N,3,5-tetramethylpiperidinium, N,3,5-trimethyl-N-ethylpiperidinium, or N-methyl-N,3,5-tri-$C_{1-12}$ alkylpiperidinium), N,3,5-trialkylpiperidinium-1-yl (e.g., N,3,5-trimethylpiperidinium-1-yl or N,3,5-tri-$C_{1-12}$ alkylpiperidinium-1-yl), N,N,2,6-tetraalkylpiperidinium (e.g., N,N,2,6-tetramethylpiperidinium, N,2,6-trimethyl-N-ethylpiperidinium, or N-methyl-N,2,6-tri-$C_{1-12}$ alkylpiperidinium), N,2,6-trialkylpiperidinium-1-yl (e.g., N,2,6-trimethylpiperidinium-1-yl or N,2,6-tri-$C_{1-12}$ alkylpiperidinium-1-yl), N,N-dialkylazepanium (e.g., N,N-dimethylazepanium, N-methyl-N-ethylazepanium, or N-methyl-N—$C_{1-12}$ alkylazepanium), N-alkylazepanium-1-yl (e.g., N-methylazepanium-1-yl or N—$C_{1-12}$ alkylazepanium-1-yl), N,N-dialkylmorpholinium (e.g., N,N-dimethylmorpholinium, N-methyl-N-ethylmorpholinium, or N-methyl-N—$C_{1-12}$ alkylmorpholinium), N-alkylmorpholinium-4-yl (e.g., N-methylmorpholinium-4-yl or N—$C_{1-12}$ alkylmorpholinium-4-yl), N1,N3-dialkylimidazolium (e.g., N1,N3-dimethylimidazolium, N1-ethyl-N3-methylimidazolium, or N1-$C_{1-12}$ alkyl-N3-methylimidazolium), N3-alkylimidazolium-1-yl (e.g., N3-methylpiperidinium-1-yl or N3-$C_{1-12}$ alkylpiperidinium-1-yl), 1-alkyl-1-azabicyclo[2.2.2]octane (e.g., 1-methyl-1-azabicyclo[2.2.2]octane or 1-$C_{1-12}$ alkyl-1-azabicyclo[2.2.2]octane), or 1-azoniabicyclo[2.2.2]octan-1-yl, in which each of these can be optionally substituted (e.g., substituted on a ring with one or more alkyl and/or substituted on an alkyl with one or more heteroatoms).

In some embodiments, an ionomer different from that of the anion-conductive polymer layer and the cation-conductive polymer layer may be used. For example, a relatively high conductivity anion-exchange material such as Sustanion may be used. Such anion-exchange material may not be selective enough to use as a cathode buffer layer but can be used at the interface.

In particular examples, an ionomer may be used at the interface that has a higher ion exchange capacity than at least one of the ionomers of the bipolar membrane. Such an ionomer may not be suitable for the layers of the bipolar membrane, for example, due to propensity to swelling or lack of stability, but can be added at the interface. In particular examples, an ionomer that improves adhesion and physical contact may be used. A polymer at the interface that goes into both layers may be used to improve adhesion. An ionomer at the interface can itself have multiple sublayers. In one example, a third ionomer may have center region having higher void space disposed between denser regions.

In some embodiments, an ionomer used at the interface is an anion exchange ionomer that is different from the anion-conducting polymer of the anion conducting polymer layer and may be referred to as an interface AEM to distinguish it from the bulk AEM of the anion conducting polymer layer. In some such embodiments, the interface AEM has lower water uptake than the anion-conducting polymer layer to match the water uptake of PFSA or other cation-conducting polymer. This can help prevent delamination at the interface while maintaining a higher ion exchange capacity (IEC). Both the higher IEC and lower water uptake of the interface ionomer may help minimize cation crossover from the anode side. Lower water uptake can result from smaller ion conduction channels in the interface ionomer than in the anion-conducting polymer of the bipolar membrane. Higher IEC can result from a higher concentration of cation functional groups on the interface ionomer. One or both of these characteristics may be present in the interface ionomer and can restrict cations from the cathode.

In particular embodiments, when forward bias is applied across a bipolar membrane, ion recombination occurs at the interface to form products such as water. An interfacial layer should be mechanically robust during ion recombination (i.e., exhibit good adhesion between AEM and CEM of the bipolar membrane) while minimizing undesired co-ion leakage through the AEM and CEM. In some embodiments, an interface AEM has a thickness of 0.1%-10% of the bulk AEM thickness, with examples of bulk AEM thickness being between 5-80 μm. The interface AEM1 and 90 percent by volume may be kept relatively low to avoid additional ohmic resistances across the bipolar membrane. The water uptake of the interface AEM can be between 0%-25% to circumvent membrane delamination due to a mismatch of swelling properties between the adjacent AEM and CEM. In some interface AEM can have an ion exchange capacity (IEC) in the range of 2.5-3.0 mmol/g. In some such embodiments, the IEC of the bulk AEM is lower than that of the interface AEM and may be 1.5-2.5 mmol/g. A high density of positively-charged functional groups (i.e. high IEC) at the interface serves to electrostatically repel undesired co-ion (e.g. H+ or K+) transport to the bulk AEM via the Donnan exclusion effect.

Additional examples of materials that may be present at the interface include block copolymers having different charged groups (e.g., both cation and anion stationary charge groups), cation-and-anion conducting polymers, resin material, ion donors such as oxides including graphene oxide, catalysts for acid/base recombination, catalysts that react $H_2$ and $O_2$ diffusing from the anode and cathode, water splitting catalysts, $CO_2$ absorbing material, and $H_2$ absorbing material.

In some embodiments, the anion-conducting polymer and the cation-conducting polymer of the bipolar membrane have the same backbone, with different stationary charge groups. As an example, Orion ionomers may be used with different stationary charge groups. The ionomers are more compatible and less apt to delaminate.

In the examples above, the interface 313 may be a three-dimensional volume having thickness that is between 1% and 90% of the overall thickness of the bipolar membrane, or between 5% and 90%, or between 10% and 80%, or between 20% and 70%, or between 30% and 60% of the overall thickness of the bipolar membrane. In some embodiments, it less than half the overall thickness, including between 0.1% and 30%, 5% and 25%, 5% and 20%, 5% and 15% or 0.5% to 5%.

Any of the bipolar interfaces described above may be hot pressed. Particularly between the anion-exchange and cation exchange membrane layers, hot pressing can soften the polymer electrolytes and allow them to meld together.

In some embodiments, the bipolar AEM/PEM interface includes a relatively smooth PEM layer in contact with a rougher AEM layer. For example, a PEM arithmetic mean height ($S_a$) in such embodiments can range from near 0 to 0.2 μm. The AEM layer in contact with the PEM layer can have higher roughness, and in some embodiments have an $S_a$ in the 0.2 to 0.5 μm range, in the 0.4 to 1.5 μm range, or in the 0.6 to 1 μm range. The roughness of the AEM with the PEM can create a discontinuous interface. The $S_a$ of the AEM layer in contact with the PEM can be lowered to near 0 to 0.2 μm or near 0 to 1 μm through changes to fabrication parameters, such as treatment with solvent that partially dissolves the polymer electrolyte before evaporating to leave behind a smoother surface or hot pressing. The AEM layer may be substantially continuous and non-porous, or it may contain pores with typical porosity ranges can be 0.1 to 90%, 1-20%, and 5-15% that allow for gas and/or water movement.

In another embodiment, the surface of the PEM membrane may be roughened to an $S_a$ of 5 to 10 μm, 1 to 5 μm, 0.2 to 1 μm, or 0.4 to 0.6 μm. In some such embodiments, the AEM layer in contact with the PEM membrane may have $S_a$ near 0 to 1 μm or near 0 to 0.2 μm, or it may be rougher, with a $S_a$ in the 2 to 5 μm range, in the 0.4 to 1.5 μm range, or in the 0.6 to 1.0 μm range. The AEM may be substantially continuous and non-porous, or it may contain pores with typical porosity ranges of 0.1 to 90%, 1-20%, and 5-15% that allow for gas and/or water movement.

In some embodiments, a cross-linker may be added to covalently cross-link the two polymers of the bipolar membrane. A crosslinker can be used at an interface between ion-conducting polymer layers. Each layer can include one or more polymers, in which each polymer can be characterized by a backbone and a side chain attached to the backbone. A crosslinking reaction can occur at the interface, as well as between a crosslinker and (i) two or more side chains, (ii) two or more backbones, or (iii) a combination of two or more side chain(s) and backbone(s).

The crosslinker can be bivalent, trivalent, tetravalent, or other higher valency. In this way, the crosslinker can react with any number of reactive groups present at the interface within the cation-conducting, anion-conducting, or mixed cation-and-anion-conducting polymer layers. In some embodiments, the crosslinker includes:

$$Ak\text{-}[X]_{L3} \text{ or } Ar\text{-}[X]_{L3}Ar\text{-}[L\text{-}X]_{L3},$$

in which Ak is an optionally substituted aliphatic, alkylene, cycloaliphatic, or cycloalkylene; Ar is an optionally substituted aromatic, arylene, heteroaromatic, or heteroarylene; L is a linking moiety (e.g., any herein); L3 is an integer that is 2 or more; and X is halo, hydroxyl, optionally substituted amino (e.g., $NR^{N1}R^{N2}$, in which each of $R^{N1}$ and $R^{N2}$ is, independently, H or optionally substituted alkyl), carboxyl, acyl halide (e.g., —C(O)—R, in which R is halo), carboxyaldehyde (e.g., —C(O)H), or optionally substituted alkyl.

Non-limiting crosslinkers can include terephthalaldehyde, glutaraldehyde, ortho-xylene, para-xylene, meta-xylene, or a multivalent amine, such as diamine, triamine, tetraamine, pentaamine, etc., including 1,6-diaminohexane (hexanediamine, DHA), N,N'-dimethyl-1,6-hexanediamine, N,N,N',N'-tetramethyl-1,6-hexanediamine (TMHDA), 1,3-diaminopropane, N,N'-dimethyl-1,3-propanediamine, N,N,N',N'-tetramethyl-1,3-propanediamine, 1,4-diaminobutane, N,N'-dimethyl-1,4-butanediamine, N,N,N',N'-tetramethyl-1,4-butanediamine, 1,8-diaminooctane, N,N'-dimethyl-1,8-octanediamine, N,N,N',N'-tetramethyl-1,8-octanediamine, propane-1,2,3-triamine, [1,1':3',1"-terphenyl]-4,4",5'-triamine, 1,3,5-triazine-2,4,6-triamine (melamine), and others.

In some embodiments, a crosslinker is used for crosslinking between side chain groups of the first and second polymer layers. The side chain group can include a reactive group that is either present within the material or installed in any useful manner.

Scheme I

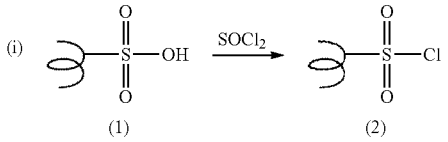

-continued

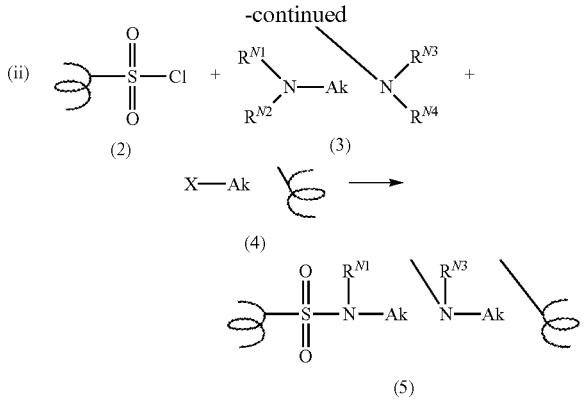

For instance, if a polymer layer includes an ionic or ionizable side chain group (e.g., —$SO_2OH$, —$CO_2H$, etc.), then this group can be converted to provide a reactive group (e.g., a halo or a leaving group). In one non-limiting embodiment, as seen in step (i) of Scheme I above, the first polymer (1) includes an ionic side chain group (—$SO_2OH$), which is converted to a reactive group (—$SO_2Cl$ in (2)) by use of thionyl chloride. The second polymer, in turn, can also include a reactive side chain group(s) (e.g., a halide, such as —Br, haloalkyl, or another leaving group), as in (4). By using a crosslinker, crosslinks are formed between reactive groups. As seen in step (ii) of Scheme I above, the reactive groups in the first polymer (2) and the second polymer (4) are reacted with a crosslinker that is a multivalent amine (3). In this way, crosslinks (5) are formed at the interface and between the side chain groups. In one instance, the polymer layers can be crosslinked based on the formation of two or more covalent bonds (e.g., an N—S covalent bond, N—C covalent bond, or C—C covalent bond).

In other embodiments, a crosslinker forms crosslinks between backbone(s) of the first and second polymer layers.

Scheme II

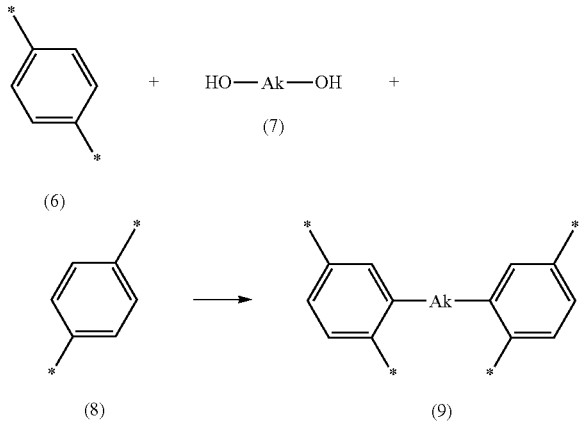

In one non-limiting embodiment, as seen in Scheme II above, the first polymer (6) and the second polymer (8) include an aryl backbone. Then, a crosslinker is used to react with backbone groups. If the crosslinker is a multivalent hydroxyalkyl as in (7), then the two polymer layers can be crosslinked by way of a be an acid-catalyzed in the presence of a proton source, such as an organic acid (e.g., trifluoromethanesulfonic acid, sulfuric acid, methanesulfonic acid, trifluoroacetic acid, p-toluenesulfonic acid, etc.). In one instance, the hydroxyalkyl crosslinker can be a tertiary alcohol, which is protonated by a Bronsted acid, lose water as a byproduct, and form a tertiary carbocation intermediate. This intermediate, in turn, can readily react with the π electrons of the aromatic backbone based on electrophilic substitution. In this method, aromatic backbone from the polymer layers could be grafted with a crosslinker to from a high-density polymer matrix.

In yet other embodiments, a crosslinker is used for crosslinking between side chain group(s) of the first polymer layer and backbone(s) of the second polymer layer. For instance, the side chain group can be converted into a nucleophile, and the backbone can include an electrophile.

Scheme III

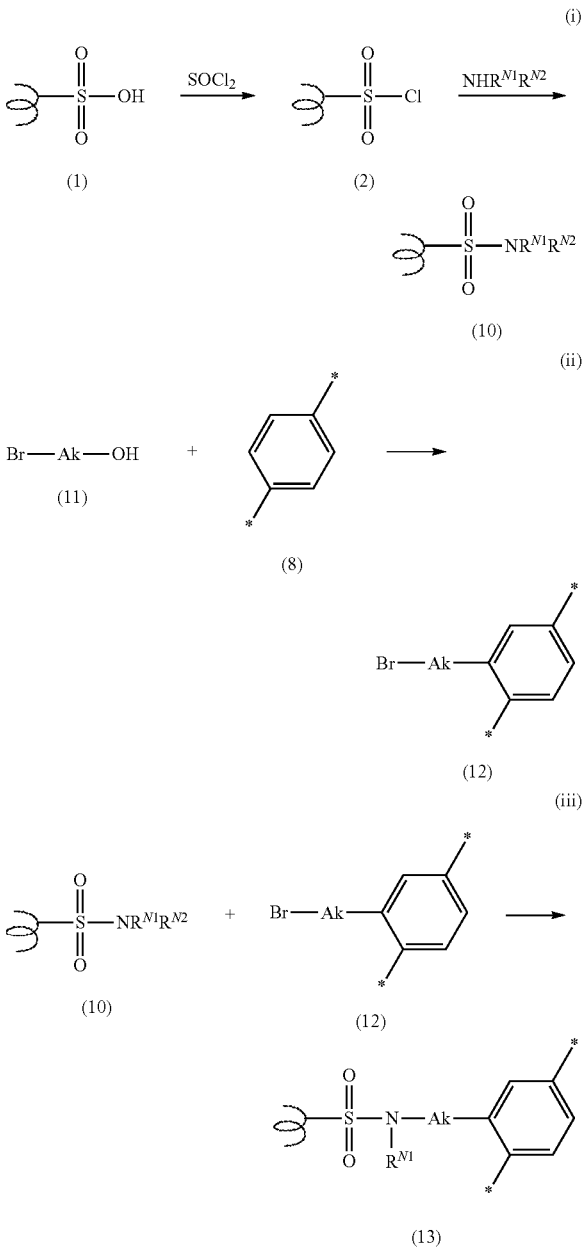

In one non-limiting embodiment, as seen in Scheme III above, the first polymer (1) includes an ionic side chain group (—$SO_2OH$), which is converted to a reactive group (—$SO_2Cl$ in (2)) by use of thionyl chloride and then aminated to provide a reactive nucleophilic group (e.g., a sulfonamide, such as —$SO_2NR^{N1}R^{N2}$ in (10)). The second polymer (8) can include an aryl backbone, which can be reacted with a multivalent crosslinker. For instance, the crosslinker (11) can be a hydroxyhaloalkyl, which can react by way of an acid-catalyzed Friedel-Crafts alkylation reaction to provide an alkylated polymer (12). Finally, the first polymer (10) having a nucleophilic group can be reacted with the second polymer (12) having an electrophilic group to provide a crosslinked polymer (13). Alternative chemistries, reactive groups, electrophiles, and nucleophiles can be used to provide reactive pairs in the first and second polymers that can react at the interface.

Thickness of Layers of MEA

In certain embodiments, a polymer electrolyte membrane and an adjoining cathode buffer layer or other anion-conducting polymer layer may have relative thickness that facilitate the fabrication and/or operating performance of an MEA.

Partial layers of an MEA may include an anion-conducting polymer layer (AEM), which may be a cathode buffer layer, and a polymer electrolyte membrane (PEM), which may be cation-conducting polymer layer (e.g., a proton exchange polymer layer) or an anion-conducting polymer layer. In some embodiments, the PEM is relatively thicker than the anion-conducting polymer layer. For example, the PEM may be 120 micrometers compared with about 10-30 or 10-20 micrometers thick for the AEM. The PEM may provide mechanical stability to the AEM.

In some cases, anion-conducting polymers are substantially less conductive than cation-conducting polymers. Therefore, to provide the benefits of a cathode buffer layer (e.g., anion-conducting polymer layer) without substantially increasing the overall resistance of the MEA, a relatively thin cathode buffer is used. However, when a cathode buffer layer becomes too thin, it becomes difficult to handle during fabrication of the MEA and in other contexts. Therefore, in certain embodiments, a thin cathode buffer layer is fabricated on top of a relatively thicker PEM layer such as a cation-conducting polymer layer. The anion-conducting polymer layer may be fabricated on the PEM layer using, for example, any of the fabrication techniques described elsewhere herein.

In various embodiments, the polymer electrolyte membrane layer is between about 20 and 200 micrometers thick. In some embodiments, the polymer electrolyte membrane layer is between about 60 and 120 micrometers thick. In some embodiments, a thin polymer electrolyte membrane layer is used, being between about 20 and 60 micrometers thick. In some embodiments, a relatively thick polymer electrolyte layer is used, between about 120 and 200 micrometers thick.

In some embodiments, a thinner cathode buffer layer is used with a thinner polymer electrolyte membrane. This can facilitate movement of the CO2 formed at the interface back to cathode, rather than to the anode. In some embodiments, a thicker cathode buffer layer is used with a thicker polymer electrolyte membrane. This can result in reducing cell voltage in some embodiments.

Factors that can influence the thickness of a cathode buffer layer include the ion selectivity of the anion-conducting polymer, the porosity of the anion-conducting polymer, the conformality of the anion-conducting polymer coating the polymer electrolyte membrane.

Many anion-conducting polymers are in the range of 95% selective for anions, with about 5% of the current being cations. Higher selectivity anion-conducting polymers, with greater than 99% selectivity for anions can allow for a reduction in a significant reduction in thickness while providing a sufficient buffer.

Mechanical strength of an anion-conducting layer can also influence its thickness, with mechanical stable layers enabling thinner layers. Reducing porosity of an anion-conducting polymer may reduce the thickness of the anion-conducting layer.

In some implementations, a cathode buffer layer or other anion-conducting polymer layer that abuts the polymer electrolyte membrane is between about 5 and 50 micrometers, 5 and 40 micrometers, 5 and 30 micrometers, 10 and 25 micrometers, or 10 and 20 micrometers thick. Using a >99% selective polymer can allow the cathode buffer layer to be reduced to between 2 and 10 microns in some embodiments.

In some cases, the ratio of thicknesses of the polymer electrolyte membrane and the adjoining anion-conducting polymer layer is between about 3:1-90:1 with the ratios at the higher end used with highly selective anion-conducting polymer layers. In some embodiments, the ratio is 2:1-13:1, 3:1-13.1, or 7:1-13.1.

Figure 4:
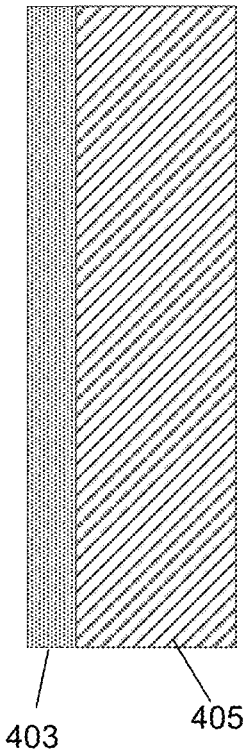
FIG. 4 is a schematic illustration of layers of a MEA, including an anion-conducting polymer layer (AEM) and a polymer electrolyte membrane (PEM) in accordance with certain disclosed embodiments.

In certain embodiments, a relatively thinner PEM improves some aspects of the MEA's performance. Referring to FIG. 4, for example, polymer electrolyte membrane 405 may have a thickness of about 50 micrometers, while the anion-conducting layer 403 may have a thickness between about 10 and 20 micrometers. A thin PEM favors movement of water generated at the AEM/PEM interface to move toward the anode. The pressure of gas on the cathode side of the cell can be 80-450 psi, which causes the water at the interface to move to the anode. However, in some instances, a thick PEM can cause the majority of water to move through the AEM to the cathode, which leads to flooding. By using a thin PEM, flooding can be avoided.

In some embodiments, a thin PEM may have a thickness of 10 micrometers to 50 micrometers, 30 micrometers to 50 micrometers, or 25 micrometers to 35 micrometers. In some such embodiments, the AEM may have a similar thickness to the PEM, such as 5 micrometers to 50 micrometers, 5 micrometers to 30 micrometers, or 10 micrometers to 20 micrometers. The ratio of PEM:AEM thicknesses could be 1:2 to 1:1 when PEMs with thicknesses of 10-30 micrometers are used, 1:2 to 2:1 when PEM thickness is 30-50 micrometers, or 1:1 to 3:1 when PEM thickness is 20-35 micrometers. As described further below, AEMs in these thickness ranges may be useful for water management.

Commercially available anion exchange membranes and cation exchange membranes typically have known thicknesses. For example, Nafion® membranes have the following dry thicknesses:

| Membrane Type | Thickness (μm) |
|---|---|
| Nafion 117 | 183 |
| Nafion 115 | 127 |
| Nafion 211 | 25.4 |

Such known thickness can be used to determine thickness ratios. For example, if an AEM has a thickness between approximately 200 nm and 100 μm, between 300 nm and 75 μm, between 500 nm and 50 μm as described above in the discussion of the cathode buffer layer, the PEM:AEM thickness ratio can be determined as follows:

| PEM Membrane Type | Example ranges of PEM:AEM |
|---|---|
| N117 | 1.83-915; 2.44-610; 3.66-366 |
| N115 | 1.27-635; 1.69-423; 2.54-254 |
| N211 | 0.25-127; 0.34-84.7; 0.51-50.8 |

An AEM may have a thickness that aids in water management, as discussed further below.

Water Management

As described above, one of the key challenges in a $CO_x$ electrolyzer is managing water in the cathode due to the need to have water present to hydrate the polymer-electrolyte and/or participate in the $CO_x$ reduction reaction but not so much water that it blocks the transport of $CO_x$ to the cathode catalyst. Water can transport predominantly by two methods in a polymer electrolyte system: by electro-osmotic drag and by diffusion. Through diffusion, water will move from areas of high concentrations to low concentrations, the rate of water transport depends on the diffusion coefficient that is an inherent property of the polymer electrolyte material. Electro-osmotic drag is the movement of water molecules with ions as they travel through the polymer-electrolyte. Water in a cation exchange membrane system will transport along with the movement of cations from the anode to the cathode, whereas water moves in the opposite direction with anions in an anion exchange membrane system.

With a bipolar membrane (including a cation exchange membrane and an anion exchange membrane), the net movement of water from the anode to the cathode can be managed by changing the thickness of the anion-exchange and cation-exchange polymer electrolyte layers and/or their material properties.

In some embodiments, an AEM may have a thickness between 5 and 80 micrometers, 5 and 50 micrometers, 5 and 40 micrometers, or 5 and 30 micrometers. As described below, relatively thick AEMs can aid in water management and in preventing delamination, which prolongs lifetime. However, the thickness also contributes to higher voltages and lower efficiencies. Thus, in some embodiments, the AEM may be no more than 50 microns thick.

The tables below show net water transported from the anode to the cathode of the $CO_x$ electrolyzer per ionic charge moved through the polymer-electrolyte when the thickness of the anion-exchange polymer electrolyte layer and cation-exchange membrane thickness are varied. When the anion-exchange polymer-electrolyte layer thickness increases, the net movement of water from the anode to the cathode decreases. Increasing the molecular weight of the anion-exchange polymer, which reduces the diffusion coefficient of water through the anion-exchange layer has a similar effect of decreasing the net movement of water per ionic charge from the anode to the cathode of the device.

Nafion 115 (PFSA cation exchange membrane thickness 127 microns)

| Anion-exchange polymer electrolyte layer thickness (um) | Anion-exchange polymer-electrolyte MW (kg/mol) | Water moved from anode to cathode of COx electrolyzer per charge |
|---|---|---|
| 14-15 | 33 | 3.07 |
| 17.5-18.5 | 33 | 2.80 |
| 20-21 | 33 | 2.44 |

Nafion 212 (PFSA cation exchange membrane thickness 50.8 microns)

| Anion-exchange polymer electrolyte layer thickness (um) | Anion-exchange polymer-electrolyte MW (kg/mol) | Water moved from anode to cathode of COx electrolyzer per charge |
|---|---|---|
| 22 | 33 | 1.25 |
| 8 | 33 | 2.16 |

Thus, in some embodiments, the ratio of the cation exchange membrane thickness:anion exchange membrane thickness (i.e., the PEM:AEM ratio) in a bipolar MEA is no more than 7:1, 5:1, 3:1, 2:1, 1.5:1, 1:1, or 1:1.5.

Nafion 115 (PFSA cation exchange membrane thickness 127 microns) with anion-exchange polymer electrolyte layers with different molecular weights.

| Anion-exchange polymer electrolyte layer thickness (um) | Anion-exchange polymer-electrolyte MW (kg/mol) | Water moved from anode to cathode of COx electrolyzer per charge |
|---|---|---|
| 14-15 | 33 | 3.07 |
| 14-15 | 77 | 2.55 |
| 14-15 | 90 | 2.48 |

Thus, in some embodiments, the molecular weight of the anion exchange polymer electrolyte may be at least 50 kg/mol, at least 60 kg/mol, at least 70 kg/mol, at least 80 kg/mol, or at least 90 kg/mol.

In some embodiments, the AEM polymer may be cross-linked to decrease water movement from the anode to the cathode.

$CO_2$ Electrolyzers

Figure 5:
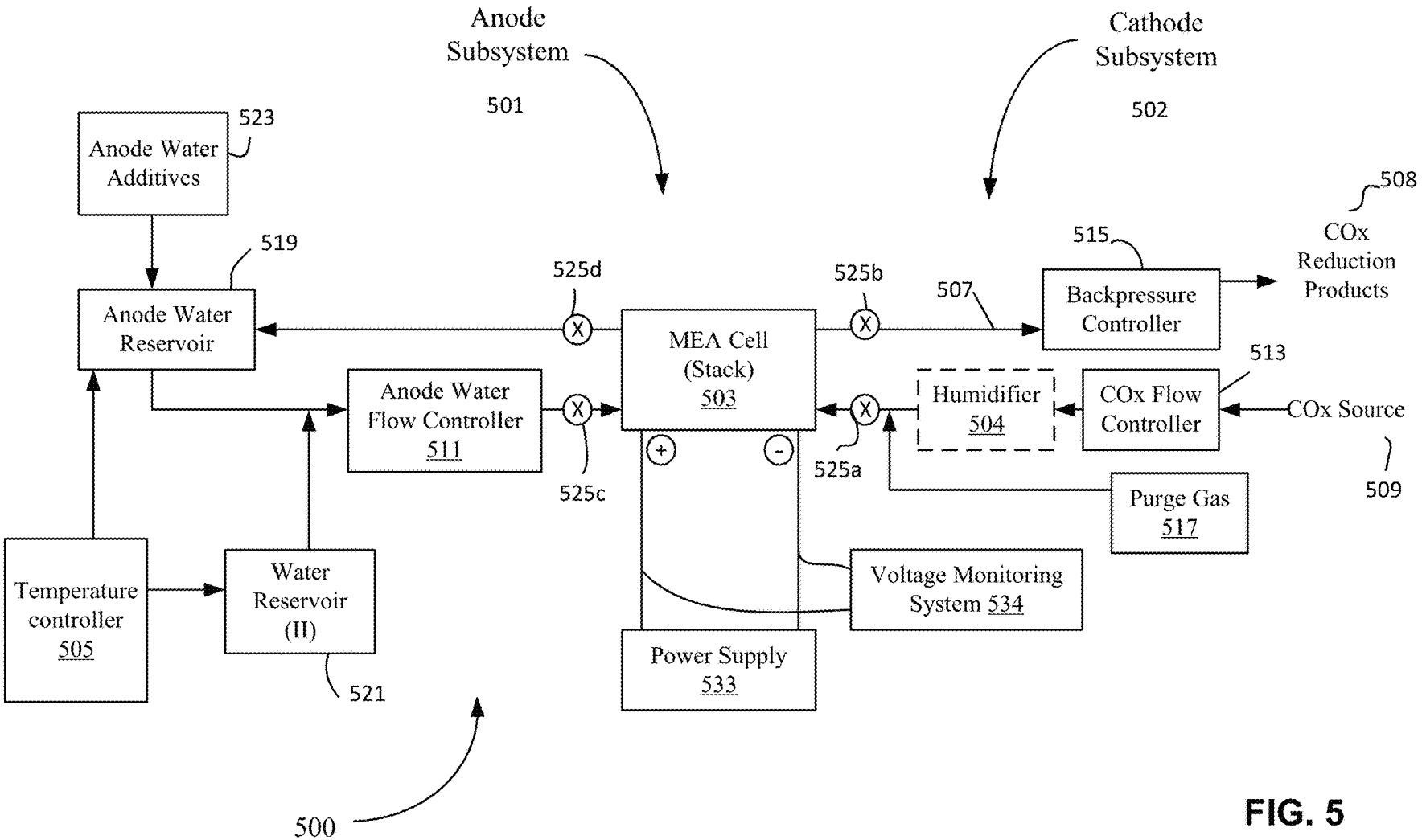
FIG. 5 is a block diagram schematically illustrating an exemplary electrolyzer for carbon oxide reduction that may include a cell comprising an MEA (membrane electrode assembly) in accordance with certain disclosed embodiments.

FIG. 5 depicts an example system 500 for a carbon oxide reduction reactor 503 (often referred to as an electrolyzer herein) that may include a cell comprising a MEA (membrane electrode assembly). The reactor may contain multiple cells or MEAs arranged in a stack. System 500 includes an anode subsystem 501 that interfaces with an anode of reduction reactor 503 and a cathode subsystem 502 that interfaces with a cathode of reduction reactor 503. System 500 is an example of a system that may be used with or to implement any of the methods or operating conditions described above.

As depicted, the cathode subsystem includes a carbon oxide source 509 configured to provide a feed stream of carbon oxide to the cathode of reduction reactor 503, which, during operation, may generate an output stream that includes product(s) of a reduction reaction at the cathode. The product stream may also include unreacted carbon oxide and/or hydrogen. See 508.

The carbon oxide source 509 is coupled to a carbon oxide flow controller 513 configured to control the volumetric or mass flow rate of carbon oxide to reduction reactor 503. One or more other components may be disposed on a flow path from flow carbon oxide source 509 to the cathode of reduction reactor 503. For example, an optional humidifier 504 may be provided on the path and configured to humidify the carbon oxide feed stream. Humidified carbon oxide may moisten one or more polymer layers of an MEA and thereby avoid drying such layers. Another component that may be disposed on the flow path is a purge gas inlet coupled to a purge gas source 517. In certain embodiments, purge gas source 517 is configured to provide purge gas during periods when current is paused to the cell(s) of reduction reactor 503. In some implementations, flowing a purge gas over an MEA cathode facilitates recovery of catalyst activity and/or selectivity. Examples of purge gases include carbon dioxide, carbon monoxide, hydrogen, nitrogen, argon, helium, oxygen, and mixtures of any two or more of these.

In various embodiments, a $CO_2$ purifier (not shown in FIG. 5) as described herein is provided upstream of source 509. Such a $CO_2$ purifier may be considered to be part of the cathode subsystem.

During operation, the output stream from the cathode flows via a conduit 507 that connects to a backpressure controller 515 configured to maintain pressure at the cathode side of the cell within a defined range (e.g., about 50 to 800 psig, depending on the system configuration). The output stream may provide the reduction products 508 to one or more components (not shown) for separation and/or concentration.

In certain embodiments, the cathode subsystem is configured to controllably recycle unreacted carbon oxide from the outlet stream back to the cathode of reduction reactor 503. In some implementations, the output stream is processed to remove reduction product(s) and/or hydrogen before recycling the carbon oxide. Depending upon the MEA configuration and operating parameters, the reduction product(s) may be carbon monoxide, hydrogen, hydrocarbons such as methane and/or ethylene, oxygen-containing organic compounds such as formic acid, acetic acid, and any combinations thereof. In certain embodiments, one or more components, not shown, for removing water from the product stream are disposed downstream form the cathode outlet. Examples of such components include a phase separator configured to remove liquid water from the product gas stream and/or a condenser configured to cool the product stream gas and thereby provide a dry gas to, e.g., a downstream process when needed. In some implementations, recycled carbon oxide may mix with fresh carbon oxide from source 509 upstream of the cathode. Not shown in FIG. 5 are one or more optional separation components that may be provided on the path of the cathode outlet stream and configured to concentrate, separate, and/or store the reduction product from the reduction product stream.

As depicted in FIG. 5, an anode subsystem is configured to provide an anode feed stream to an anode side of the carbon oxide reduction reactor 503. In certain embodiments, the anode subsystem includes an anode water source, not shown, configured to provide fresh anode water to a recirculation loop that includes an anode water reservoir 519 and an anode water flow controller 511. The anode water flow controller 511 is configured to control the flow rate of anode water to or from the anode of reduction reactor 503. In the depicted embodiment, the anode water recirculation loop is coupled to components for adjusting the composition of the anode water. These may include a water reservoir 521 and/or an anode water additives source 523. Water reservoir 521 is configured to supply water having a composition that is different from that in anode water reservoir 519 (and circulating in the anode water recirculation loop). In one example, the water in water reservoir 521 is pure water that can dilute solutes or other components in the circulating anode water. Pure water may be conventional deionized water even ultrapure water having a resistivity of, e.g., at least about 15 MOhm-cm or over 18.0 MOhm-cm. Anode water additives source 523 is configured to supply solutes such as salts and/or other components to the circulating anode water.

During operation, the anode subsystem may provide water or other reactant to the anode of reactor 503, where it at least partially reacts to produce an oxidation product such as oxygen. The product along with unreacted anode feed material is provided in a reduction reactor outlet stream. Not shown in FIG. 5 are one or more optional separation components that may be provided on the path of the anode outlet stream and configured to concentrate, separate, and/or store the oxidation product from the anode product stream.

Other control features may be included in system 500. For example, a temperature controller may be configured to heat and/or cool the carbon oxide reduction reactor 503 at appropriate points during its operation. In the depicted embodiment, a temperature controller 505 is configured to heat and/or cool anode water provided to the anode water recirculation loop. For example, the temperature controller 505 may include or be coupled to a heater and/or cooler that may heat or cool water in anode water reservoir 519 and/or water in reservoir 521. In some embodiments, system 500 includes a temperature controller configured to directly heat and/or cool a component other than an anode water component. Examples of such other components in the cell or stack and the carbon oxide flowing to the cathode.

In certain embodiments, system 500 is configured to adjust the flow rate of carbon oxide to the cathode and/or the flow rate of anode feed material to the anode of reactor 503. Components that may be controlled for this purpose may include carbon oxide flow controller 513 and anode water controller 511.

Certain components of system 500 may operate to control the composition of the carbon oxide feed stream and/or the anode feed stream. For example, water reservoir 521 and/or anode water additives source 523 may be controlled to adjust the composition of the anode feed stream. In some cases, additives source 523 may be configured to adjust the concentration of one or more solutes such as one or more salts in an aqueous anode feed stream.

In some cases, a temperature controller such controller 505 is configured to adjust the temperature of one or more components of system 500 based on a phase of operation. For example, the temperature of cell 503 may be increased or decreased during break-in, a current pause in normal operation, and/or storage.

In some embodiments, a carbon oxide electrolytic reduction system is configured to facilitate removal of a reduction cell from other system components. This may be useful with the cell needs to be removed for storage, maintenance, refurbishment, etc. In the depicted embodiments, isolation valves 525*a* and 525*b* are configured to block fluidic communication of cell 503 to a source of carbon oxide to the cathode and backpressure controller 515, respectively. Additionally, isolation valves 525*c* and 525*d* are configured to block fluidic communication of cell 503 to anode water inlet and outlet, respectively.

The carbon oxide reduction reactor 503 may also operate under the control of one or more electrical power sources and associated controllers. See, block 533. Electrical power source and controller 533 may be programmed or otherwise configured to control current supplied to and/or to control voltage applied to the electrodes in reduction reactor 503. Any of the current profiles described herein may be programmed into power source and controller 533.

In certain embodiments, electric power source and controller 533 performs some but not all the operations necessary to implement control profiles of the carbon oxide reduction reactor 503. A system operator or other responsible individual may act in conjunction with electrical power source and controller 533 to fully define the schedules and/or profiles of current applied to reduction reactor 503. In certain embodiments, electric power source and controller 533 controls operation of a carbon oxide purifier disposed upstream of carbon oxide source 509.

In certain embodiments, the electrical power source and controller acts in concert with one or more other controllers or control mechanisms associated with other components of system 500. For example, electrical power source and controller 533 may act in concert with controllers for controlling the purification of carbon oxide, the delivery of carbon oxide to the cathode, the delivery of anode water to the anode, the addition of pure water or additives to the anode water, and any combination of these features. In some implementations, one or more controllers are configured to control or operate in concert to control any combination of the following functions: applying current and/or voltage to reduction cell 503, controlling backpressure (e.g., via backpressure controller 515), supplying purge gas (e.g., using purge gas component 517), delivering carbon oxide (e.g., via carbon oxide flow controller 513), humidifying carbon oxide in a cathode feed stream (e.g., via humidifier 504), flow of anode water to and/or from the anode (e.g., via anode water flow controller 511), and anode water composition (e.g., via anode water source 505, pure water reservoir 521, and/or anode water additives component 523).

In the depicted embodiment, a voltage monitoring system 534 is employed to determine the voltage across an anode and cathode of an MEA cell or across any two electrodes of a cell stack, e.g., determining the voltage across all cells in a multi-cell stack. In certain embodiments, voltage monitoring system 534 is configured to work in concert with power supply 533 to cause reduction cell 503 to remain within a specified voltage range. If, for example the cell's voltage deviates from a defined range (as determined by voltage monitoring system 534), power supply may be configured to apply current or voltage to the electrodes to maintain the cell voltage within the specified range.

An electrolytic carbon oxide reduction system such as that depicted in FIG. 5 may employ a control system that includes one or more controllers and one or more controllable components such as pumps, sensors, dispensers, valves, and power supplies. Examples of sensors include pressure sensors, temperature sensors, flow sensors, conductivity sensors, voltmeters, ammeters, electrolyte composition sensors including electrochemical instrumentation, chromatography systems, optical sensors such as absorbance measuring tools, and the like. Such sensors may be coupled to inlets and/or outlets of an MEA cell (e.g., in a flow field), in a reservoir for holding anode water, pure water, salt solution, etc., and/or other components of an electrolytic carbon oxide reduction system.

Among the various functions that may be controlled by one or more controllers are: applying current and/or voltage to a carbon oxide reduction cell, controlling backpressure on an outlet from a cathode on such cell, supplying purge gas to a cathode inlet, delivering carbon oxide to the cathode inlet, humidifying carbon oxide in a cathode feed stream, flowing anode water to and/or from the anode, and controller anode feed composition. Any one or more of these functions may have a dedicated controller for controlling its function alone. Any two or more of these functions may share a controller. In some embodiments, a hierarchy of controllers is employed, with at least one master controller providing instructions to two or more component controllers. For example, a system may comprise a master controller configured to provide high level control instructions to (i) a power supply to a carbon oxide reduction cell, (ii) a cathode feed stream flow controller, and (iii) an anode feed stream flow controller. For example, a programmable logic controller (PLC) may be used to control individual components of the system.

A controller may be integrated with electronics for controlling operation the electrolytic cell before, during, and after reducing a carbon oxide. The controller may control various components or subparts of one or multiple electrolytic carbon oxide reduction systems. The controller, depending on the processing requirements and/or the type of system, may be programmed to control any of the processes disclosed herein, such as delivery of gases, temperature settings (e.g., heating and/or cooling), pressure settings, power settings (e.g., electrical voltage and/or current delivered to electrodes of an MEA cell), liquid flow rate settings, fluid delivery settings, and dosing of purified water and/or salt solution. These controlled processes may be connected to or interfaced with one or more systems that work in concert with the electrolytic carbon oxide reduction system.

A controller may include any number of processors and/or memory devices. The controller may contain control logic such software or firmware and/or may execute instructions provided from another source. In various embodiments, a controller comprises electronics having various integrated circuits, logic, memory, and/or software that receive instructions, issue instructions, control operations described herein. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a process on one or more components of an electrolytic carbon oxide reduction system. The operational parameters may, in some embodiments, be part of a recipe defined by process engineers to accomplish one or more processing steps during generation of a particular reduction product such as carbon monoxide, hydrocarbons, and/or other organic compounds.

The controller, in some implementations, may be a part of or coupled to a computer that is integrated with, coupled to the system, otherwise networked to the system, or a combination thereof. For example, the controller may utilize instructions stored remotely (e.g., in the "cloud") and/or execute remotely. The computer may enable remote access to the system to monitor current progress of electrolysis operations, examine a history of past electrolysis operations, examine trends or performance metrics from a plurality of electrolysis operations, to change parameters of current processing, to set processing steps to follow a current processing, or to start a new process. In some examples, a remote computer (e.g., a server) can provide process recipes to a system over a network, which may include a local network or the internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations.

The controller may be distributed, such as by comprising one or more discrete controllers that are networked together and working towards a common purpose, such as applying current to an MEA cell and other process controls described herein. An example of a distributed control system for such purposes includes one or more processors on a system for electrolytically reducing a carbon oxide and one or more processors located remotely (such as at the platform level or as part of a remote computer) that combine to control a process.

Controllers and any of various associated computational elements including processors, memory, instructions, routines, models, or other components are sometimes described or claimed as "configured to" perform a task or tasks. In such contexts, the phrase "configured to" is used to denote structure by indicating that the component includes structure (e.g., stored instructions, circuitry, etc.) that performs a task or tasks during operation. As such, a controller and/or associated component can be said to be configured to perform the task even when the specified component is not necessarily currently operational (e.g., is not on).

Controllers and other components that are "configured to" perform an operation may be implemented as hardware—for example, circuits, memory storing program instructions executable to implement the operation, etc. Additionally, controllers and other components "configured to" perform an operation may be implemented as hardware that is manipulated by software and/or firmware (e.g., an FPGA or a general-purpose processor executing software) to operate in manner that is capable of performing the recited task(s). Additionally, "configured to" can refer to one or more memories or memory elements storing computer executable instructions for performing the recited task(s). Such memory elements may include memory on a computer chip having processing logic.

Non-computation elements such as reactors such electrolyzers, membrane assemblies, layers, and catalyst particles may also be "configured" to perform certain functions. In such contexts, the phrase "configured to" indicate that the referenced structure has one or more features that allow the function to be performed. Examples of such features include physical and/or chemical properties such as dimensions, composition, porosity, etc.

Recovery and Processes

As described above, in some embodiments, a bipolar interface including a region having one or more of a particulate third material, a porosity enhancing agent, a voltage damping agent, and/or a catalyst may be particularly advantageous in the context of a recovery process.

In certain embodiments, a sequence of operations includes temporarily deviating from normal operating conditions to flow water or other liquid to the cathode and/or to flow a gas to the cathode under non-standard conditions. It has been found that flowing water to the cathode and/or flowing a gas (e.g., a gas other than the normal carbon oxide reactant) to cathode can facilitate a recovery in performance of a carbon oxide electrolyzer. This alternate sequence of operations is sometimes referred to as a "recovery process" or a "recovery sequence."

A recovery process may be performed after a carbon oxide electrolyzer has been in service, operating under normal conditions, for a period of time such as a few thousand hours. After a recovery process is completed, an electrolyzer may transition back to normal operation. A recovery process may be performed repeatedly over the service life of an electrolyzer or over the life of one or more of its components such as its associated MEA(s), gas diffusion layer(s) (GDL), and flow field(s). For example, a recovery process may be performed every 1000 to 10,000 hours of service life.

While many embodiments disclosed herein are presented as procedures for recovering lost performance of a carbon oxide electrolyzer, some embodiments pertain to protecting a carbon oxide electrolyzer from the detrimental effects of some unanticipated event such as loss of power to the electrolyzer. A carbon oxide electrolyzer may be placed in a protection mode when an unexpected event is determined to be occurring or likely to occur soon. If unmitigated, such unexpected events could damage the electrolyzer or infrastructure supporting the electrolyzer.

In some implementations, any of the operations, or any combination of such operations, described herein for performing recovery may also be employed for the protection of a carbon oxide electrolyzer.

In some embodiments, an electrolyzer and/or associated control system implements a protection mode by (a) determining that an unexpected and potentially detrimental event is occurring or will likely occur in the future and such unexpected event will, if unmitigated, likely damage or degrade the carbon oxide electrolyzer; and (b) performing one or more protective operations on the carbon oxide electrolyzer that reduce the likelihood that the electrolyzer will be damaged or degraded if the unexpected event continues to occur or does in fact occur in the future.

Examples of unexpected events that may trigger the protective operations include sudden decrease or loss of an input material such as anolyte or carbon oxide (e.g., $CO_2$) gas decrease or loss of heating or cooling, and loss of power to the electrolyzer. A substantial decrease or loss input material may require adjusting the power to electrolyzer to produce open circuit voltage or no current. Loss of power to the electrolyzer may cause the electrolyzer to discharge from operating voltage to an uncontrolled voltage, such as open circuit voltage or zero voltage either rapidly or gradually.

Examples of protective operations to mitigate the impact of the unexpected event include applying a relatively low current density to the electrolyzer, transitioning the electrolyzer voltage to open circuit voltage and reducing or ramping down the current applied to the electrolyzer. Any of these protective operations may be applied for a limited time such as only while the unexpected event continues to occur or until the likelihood of such event occurring is substantially reduced.

In some embodiments, the protective operation reduces electrolyzer current density to a relatively small (in comparison to normal operation) forward current density of about 1-50 mA/cm$^2$ or about 5-25 mA/cm$^2$ (e.g., about 10 mA/cm$^2$), or about 0.3% to 20% of the current density in normal operating conditions.

In some embodiments, the protective operation ramps down current to the electrolyzer. A ramp may have any form or slope. In some cases, the average ramp rate from full current (normal operation) to a final current is about 0.1 to 1 mA/cm$^2$ per minute, or about 1 to 10 mA/cm$^2$ per minute. In some cases, the ramping is stepped. The number of steps, the time duration of the steps, and the magnitude of the current density changes of the steps may vary. As an example, a ramp may have about 2 to 50 steps, or about 5 to 30 steps. As a further example, the duration of the steps may be about 1 to 100 seconds, or about 5 to 50 seconds. As a further example, the current magnitude of the steps may be about 0.1 to 10 mA/cm$^2$ or about 0.5 to 5 mA/cm$^2$.

In one example, a step profile reduces current density to an electrolyzer from a normal operating value (e.g., about 300 mA/cm$^2$ to 2 A/cm) via a sequence of steps, each having a much smaller value (e.g., about 10, 9, 8, 7, 6, 5, 4, 3, 2, 1 mA/cm$^2$) and each having a defined duration (e.g., about 30 seconds each), and then sets the final current output to maintain the electrolyzer at open circuit for about 5-10 minutes.

In some embodiments, an electrolyzer returns from recovery or protective mode to normal operating conditions via a current ramp. Such a return ramp may have any of the characteristics just identified for ramping current down but in the opposite direction, i.e., from low current density to higher current density.

Example Recovery Processes

In one example, a recovery process includes the following sequence: pause electrical current to the electrolyzer, then flow water over the cathode, and then restart flow of electrical current to the electrolyzer. In another example, a recovery process includes the following sequence: pause electrical current to the electrolyzer, then flow gas over the cathode, then flow water over the cathode, then again flow gas over the cathode, and finally restart normal operation by flowing electrical current through the cell. Included below are a few further examples of recovery sequences.

In some examples, a recovery operation comprises contacting the cathode with water while no current flows to the cathode. In some implementations, a relatively small amount of current flows while water is present in the cathode. In some cases, this current flows in the reverse direction (anodic at the carbon oxide reduction cathode). As an example, no more than about 1 mA/cm$^2$ current flows to the cathode in the reverse direction while water is present. In some examples, during a portion of the recovery process, water flows over the cathode, rather than quiescently contacting the cathode. Examples of recovery operations involving water flow or water contact include examples 1, 2, 3, and 4.

Example Recovery Sequence 1

- Normal operation, optionally including pulsing electrical current or voltage;
- Turn off or significantly reduce electrical current;
- Introduce water to the cathode by flowing or otherwise contacting the cathode;
- Turn on or increase current to normal operating level and reestablish normal operation (e.g., flow reactant gas at normal operating pressure and flow rate).

In some embodiments, a recovery operation comprises stopping the current, flowing water to the cathode, and then drying the cathode. The drying operation is optionally performed with the reactant gas, a modified reactant gas, or a different gas such as an inert gas.

Example Recovery Sequence 2

- Normal operation, optionally including pulsing electrical current or voltage;
- Turn off or significantly reduce electrical current;
- Introduce water to the cathode by flowing or otherwise contacting the cathode;
- Dry the cathode (e.g., by flowing gas through the cathode);
- Turn on or increase current to normal operating level and reestablish normal operation (e.g., flow reactant gas at normal operating pressure and flow rate).

In some embodiments, a recovery operation comprises flowing water to the cathode while no gas (reactant or other gas) flows to the cathode.

Example Recovery Sequence 3

Normal operation, optionally including pulsing electrical current or voltage;
Turn off or significantly reduce electrical current;
Release backpressure and stop flow of the reactant gas to the cathode;
Introduce water to the cathode;
Dry the cathode (e.g., by flowing gas through the cathode);
Turn on or increase current to normal operating level and reestablish normal operation (e.g., flowing the reactant gas at normal operating pressure and flow rate).

Note that stopping the gas flow and releasing or reducing the backpressure can occur in either order. If the process employs a different gas than the reactant, it may be necessary to first release the gas pressure and then stop the flow.

Example Recovery Sequence 4

Normal operation, optionally including pulsing electrical current or voltage;
Turn off or significantly decrease cell current;
Release backpressure and stop flow of the reactant gas to the cathode;
Flow gas under alternative conditions to cathode;
Stop gas flow;
Introduce water to the cathode by flowing or otherwise contacting the cathode;
Stop contacting the cathode with water;
Flow drying gas to cathode;
Flow reactant gas to cathode;
Turn on or increase current to normal operating level and reestablish normal operation.

In some embodiments, the recovery process comprises stopping the flow of current, followed by flowing a gas, which may be the reactant gas or a gas other than the reactant gas. In a case, where the gas is not the reactant gas, the gas flows for a period of time before restarting flow of the reactant gas and turning the current back on. In some embodiments, the gas other than the reactant gas comprises air, an oxidative gas, an inert gas, a combination thereof, or a modified composition of the reactant gas. In some such embodiments, water is not flowed to the cathode at least part of the time while the gas flows. Examples of recovery operations involving gas flow without water contact for at least part of time gas flows include examples 5, 6, and 7.

Example Recovery Sequence 5

Normal operation, optionally including pulsing electrical current or voltage;
Turn off or significantly reduce electrical current;
Release backpressure of the reactant gas and turn off the reactant gas to the cathode;
Flow a gas other than the reactant gas to the cathode for a period of time;
Reintroduce the reactant gas at normal operating pressure and flow rate;
Turn on or increase current to reestablish normal operation.

In some embodiments, the recovery process comprises stopping the flow of current, followed by flowing the reactant gas at reduced pressure and/or reduced flow rate for a period of time, then increasing the pressure and/or flow rate of the reactant gas to normal operating pressure, and finally turning the current back to normal level. In some such embodiments, water is not flowed to the cathode.

Example Recovery Sequence 6

Normal operation, optionally including pulsing electrical current or voltage;
Turn off or significantly reduce electrical current;
Flow gas (optionally the reactant gas) to the cathode under alternative conditions such as reduced flow rate;
Turn on or increase current to reestablish normal operation.

Example Recovery Sequence 7

Normal operation, optionally including pulsing electrical current or voltage;
Turn off or significantly reduce electrical current;
Reduce pressure of the reactant gas to the cathode for a period of time;
Increase pressure of the reactant gas to normal operating pressure;
Turn on or increase current to reestablish normal operation.

Example Recovery Sequence 8

Normal operation, optionally including pulsing electrical current or voltage;
Ramp down electrical current to the electrolyzer and optionally apply a low reverse current;
Flow gas (optionally the reactant gas) to the cathode under alternative conditions such as reduced flow rate and/or pressure (while applying a low current, which may be the low reverse current);
Ramp up positive electrical current;
Reestablish full normal operating conditions including full positive current and full flow of reactant gas.

Example Recovery Sequence 9

Normal operation, optionally including pulsing electrical current or voltage;
Apply a low reverse current (by ramping or direct transition);
Flow gas (optionally the reactant gas) to the cathode under alternative conditions such as reduced flow rate and/or pressure (while applying a low current, which may be the low reverse current);
Ramp up positive electrical current;
Reestablish full normal operating conditions including full positive current and full flow of reactant gas.

Example Recovery Sequence 10

Normal operation, optionally including pulsing electrical current or voltage;
Adjust power source or associated circuit to short the electrolyzer or otherwise reach a potential below open circuit voltage;
Flow gas (optionally the reactant gas) to the cathode under alternative conditions such as reduced flow rate and/or pressure (while holding the electrolyzer at open circuit voltage or in a short circuit state);
Reestablish full normal operating conditions including normal operating electrolyzer potential and full flow of reactant gas.

Example Protection Sequence 11

- Normal operation, optionally including pulsing electrical current or voltage;
- Determine likely occurrence of an unexpected, detrimental event;
- Transition electrolyzer to a protective mode (examples of protective mode operating conditions include applying a relatively low current density to the electrolyzer, transitioning the electrolyzer voltage to open circuit voltage, reducing or ramping down the current applied to the electrolyzer);
- Determine that that detrimental event is no longer a threat;
- Reestablish full normal operating conditions.

Example Recovery Sequence 12

- Normal operation, optionally including pulsing electrical current or voltage;
- Adjust power source or associated circuit to reach and maintain open circuit voltage;
- Flow gas (optionally the reactant gas) to the cathode under alternative conditions such as reduced flow rate and/or pressure (while holding the electrolyzer at open circuit voltage or in a short circuit state);
- Reestablish full normal operating conditions including normal operating electrolyzer potential and full flow of reactant gas.

Process Parameters Associated with Recovery Processes

Various operations associated with a recovery process are discussed in sequence below.

Normal Operation

As mentioned, a carbon oxide electrolyzer may operate normally for a period of time before a recovery sequence is executed. Normal operation may include a set of normal operating conditions as described elsewhere herein. Such conditions may include (a) normal reactant gas flow, which may be characterized by normal levels of a reactant gas pressure and flow rate or flow velocity at the cathode, (b) a reactant gas composition, (c) a set temperature or temperature profile, (d) an electrical current or voltage magnitude, optionally with a non-constant waveform, or (e) any combination thereof. In some embodiments, during normal operation, the electrical current or voltage has a pulsed or paused profile in which the current magnitude at the electrolyzer is periodically temporarily decreased or increased.

Normal operation may comprise converting a carbon oxide in the reactant gas to a carbon-containing product. In some embodiments, the carbon oxide is $CO_2$ and/or CO and the carbon-containing reduction product comprises COx a hydrocarbon, and/or an organic oxygen-containing compound. Typically, during normal operation, liquid (e.g., water) is not introduced to the cathode via the carbon oxide inlet or other source outside the MEA. However, liquid in the form of mist or droplets may, during normal operation, contact the cathode along with the inlet gas.

In various embodiments, an electrolyzer operates normally for a period of time prior to a recovery sequence. For example, an electrolyzer may operate under normal conditions for a period of at least about 100 hours before executing a recovery sequence. In some cases, the period of normal operation lasts for at least about 1000 hours, or at least about 2000 hours, or at least about 5000 hours, or at least about 10,000 hours before executing a recovery sequence. After the recovery sequence, an electrolyzer may return to normal operation for an extended period such as at least about 100 hours. The ensuing period of normal operation may continue uninterrupted by another recovery process or by terminating operation of the electrolyzer. In some implementations, a recovery process is performed periodically during the life of the electrolyzer, but instances of the recovery process are separated by minimum periods of normal operation, such as periods of at least about 100 hours or at least about 500 hours, or at least about 1000 hours.

Electrical Current Reduction or Stoppage

In certain implementations, the recovery sequence stops the flow of electrical current to the electrolyzer, reduces the magnitude of the current density, or reverses the direction of the current at the cathode. The reduction in current may be significant, which means that it does not detrimentally affect the electrolyzer or any of its components such as a cathode catalyst layer. For example, the current should not corrode or otherwise degrade catalyst components such as metals, carbon support material, or polymers. As an example, the current is reduced by at least about 50%. In some examples, a reduced current density at the cathode has a magnitude of at most about 100 $mA/cm^2$ of planar cathode surface area. This current density may apply when gas and/or water is delivered to the cathode from outside the MEA.

In some cases, the recovery sequence employs, at least temporarily, application of electrical current in the reverse direction (i.e., an anodic current flows at the cathode side of the cell). A small anodic current (at the cathode side) may assist in the recovery of performance at the electrolyzer cathode during a subsequent normal operation. It may refresh the catalyst surface.

In some embodiments, current or voltage ramping is applied to a carbon oxide electrolyzer for either recovery for protection. As discussed above in connection with the discussion of protection mode, a ramp may have any of form or slope. In some cases, the average ramp rate from full current (normal operation) to a final current is about 20 $mA/cm^2$ per minute or less, or about 1 to 10 $mA/cm^2$ per minute, or about 0.5 to 1 $mA/cm^2$ per minute. In some cases, the ramping is stepped. The number of steps, the time duration of the steps, and the magnitude of the current density changes of the steps may vary. As an example, a ramp may have about 2 to 50 steps, or about 5 to 30 steps. As a further example, the duration of the steps may be about 1 to 100 seconds, or about 5 to 50 seconds. As a further example, the current magnitude of the steps may be about 0.1 to 10 $mA/cm^2$ or about 0.5 to 5 $mA/cm^2$.

Duration of Current Stoppage

In certain embodiments, the duration of current stoppage in a recovery sequence is about 5 minutes to days (e.g., 10 days). In certain embodiments, the duration of current stoppage is about 10 minutes to about 300 minutes, or about 15 minutes to 60 minutes.

When changing the current from the normal operation at the beginning of the recovery process, the current may be reduced by a sudden stoppage (a single step change), ramping down, and/or multiple steps.

In certain embodiments in which a reverse current is applied, the duration of reverse current applied to the cathode is about 5 seconds to 60 minutes or about 5 minutes to 60 minutes.

Short Circuit

In some embodiments, a power source for powering a carbon oxide electrolyzer is short circuited during recovery or protection mode. A short circuit may occur when the electronic resistance is not large enough in the circuit to impede current flow between the anode and cathode. In such cases, the potential or potentials of the anode and cathode equalize; in other words, the cell voltage is 0 volts. When shorted, the electrolyzer discharges from a normal operating state or from open circuit voltage. During shorting of the electrolyzer, the cell voltage transitions to a level below the open circuit voltage.

The short circuit condition may be held for a prescribed period during recovering or protection mode. In some embodiments, short circuit mode is held for about 30 minutes or less, or about 10 minutes or less, or about 5 minutes or less, or about 1 to 5 minutes. After exiting the short circuit condition, the electrolyzer may return to a normal operating voltage, and optionally to full normal operation.

A short circuit and associated discharge process in which current flows in the reverse direction may provide an oxidation condition on a catalyst (e.g., a gold catalyst) that increases the catalytic effect by, e.g., generating extra active surface area and/or by removing potential impurities or intermediates. A short circuit may also deplete ionic species such as $K^+$, $H^+$, $COOH^-$, $HCO_3^-$, $CO_3^{(2-)}$, $OH^-$, or any combination of positive and/or negative ions. A short circuit may also cause water electrolysis at an MEA interface (e.g., between a PEM and AEM in a bipolar MEA) and/or at the cathode to provide a drier condition for better carbon oxide (e.g., $CO_2$) mass transport. A short circuit may temporarily change the cathode local environment such as its pH or ionic concentrations to thereby improve the $CO_2$ reduction selectivity. A change from lower to higher pH or a change from lower to higher concentrations of potassium may improve selectivity for a particular reaction as the CO generation reaction.

In certain embodiments, a system applies a short circuit when the selectivity of $CO_2$ reduction to CO is below a certain target value and/or it is desired to extend the electrolyzer life by, e.g., a couple of hundred hours. In certain embodiments, a system applies a short circuit for periodic (e.g., recurring) recovery on the reaction selectivity to reach a certain decay rate target within a certain time range. For example, a system may perform a recovery operation whenever the selectivity decays to certain value, e.g., about 90% or less. Another approach performs a recovery operation every time an electrolyzer operates normally for a defined period (e.g., about 200 to 500 hours). Another approach performs a recovery operation every time an electrolyzer exhibits a threshold drop in the selectivity (e.g., about 10% or more).

Open Circuit Voltage

In some embodiments, a carbon oxide electrolyzer is allowed to reach or is maintained at an open circuit voltage during recovery or protection. Open circuit voltage refers to the voltage difference between the anode and cathode when no net electrochemical reaction is taking place at the anode or cathode. This may result when no current flows between the anode and cathode. An open circuit potential may be achieved when a switch in the circuit containing the electrolyzer and a power supply opens by breaking a conductive path between the anode and/or cathode. An open circuit potential may also be achieved by employing a very high impedance element in the circuit including the power supply and electrolyzer. Such a resistor will have the effect of completely shutting off or nearly shutting off all current flow between the anode and the cathode of the electrolyzer.

In some cases, setting an electrolyzer to OCV or allowing to reach OCV while maintaining similar $CO_2$ gas flow rate at the cathode may provide a relative dry condition thereby allowing improved $CO_2$ mass transport. Setting an electrolyzer to OCV or allowing to reach OCV may flush out potential intermediates or impurities on the catalyst surface when no electrochemical reactions are occurring. In some cases, setting an electrolyzer to OCV or allowing to reach OCV temporarily changes the cathode local environment such as pH or ionic concentrations and thereby improve the $CO_2$ reduction selectivity for, e.g., CO production.

Various scenarios and applications may benefit from setting an electrolyzer to OCV or allowing to reach OCV. In some cases, OCV is used when a modest recovery in selectivity is desired and/or the electrolyzer voltage should be maintained at a relatively high level as by comparison to a short circuit condition.

Reverse Current

As indicated, in some embodiments, a reverse current is applied to a carbon oxide electrolyzer during recovery or protection. Forward current is current applied to a carbon oxide electrolyzer during normal operation. Electrons are supplied from a power source to the cathode allowing reduction to occur, and electrons are withdrawn from the anode allowing oxidation to occur. During reverse current, the flow of electrons is reversed so that the electrode that serves as a cathode during normal operation serves as an anode during application of reverse current, and the electrode that serves as an anode during normal operation serves as the cathode during application of reverse current.

Typically, a reverse current is maintained below a level at which carbon and/or other material in the cathode catalyst oxidizes or corrodes. In some embodiments, a reverse current has a magnitude of about $-100$ mA/cm$^2$ or less or about $-5$ to $\sim 100$ mA/cm$^2$. In some embodiments, a reverse current is applied for a time duration of about 100 minutes or less, or about 50 minutes or less, or about 30 seconds to 20 minutes. As a further example, the reverse current may be no greater than about 1 mA/cm$^2$ of cathode surface area or not greater than about 0.5 mA/cm$^2$. In some cases, the reverse current flows is maintained at or below a level in which the cell voltage does not exceed about 1.25 V (for reactant gas) and 2.5 V (for oxidizing gases such as air), or does not exceed about 0.5 V (for reactant gases) and 2 V (for oxidizing gases such as air). In certain embodiments employing a reverse current, such current is limited to no more than about 0.6 Coulombs/cm$^2$ of cathode surface area.

After the finishing application of a reverse current, the electrolyzer may return to a normal operating current, and optionally to full normal operation. In certain embodiments, a final value of the reverse current is achieved by ramping to the final value. A ramp rate and/or stepped ramp procedure as described herein for protection mode or for achieving a reduced current value may be employed.

Among the potential benefits of exposing a carbon oxide electrolyzer to reverse current are those described herein for applying a short circuit. Similarly, exposing a carbon oxide electrolyzer to a reverse current may find applications similar to those for applying a short circuit.

Types of Gases Flowed to the Cathode (Pre-Contact with Water)

In some implementations of a recovery process, a gas flows to the cathode for a period of time after the electrical current is stopped or reduced. Sometimes this gas is referred to herein as a "recovery gas." In some cases, the recovery gas has the same composition as the carbon oxide reactant that flows during normal operation, optionally at a different pressure and/or flow rate than employed in normal operation. For example, the gas flowed during normal operation and during the recovery process contains carbon dioxide or carbon monoxide at a defined concentration. In some cases, a recovery gas that flows to the cathode during a recovery process has composition that is different from that of the reactant gas. In some cases, compared to the reactant gas, the recovery process gas has a lower concentration of carbon oxide reactant. In some cases, the recovery process gas contains an inert gas that is not present in (or is present at a different concentration in) the normal process gas. Examples of inert gases include noble gases (e.g., Ar, He, or Kr) or nitrogen. In some cases, the recovery process gas is or contains air. In some cases, the recovery gas contains an oxidative gas such as oxygen. In some cases, the oxidative gas is simply air, which may contain about 21% oxygen. In other cases, the oxidative gas is oxygen or other oxidizer provided apart from air. For example, oxygen produced at the electrolyzer anode, during normal operation, may be used as an oxidative recovery gas. In some implementations, the recovery gas is humidified. In some embodiments, component gases include carbon dioxide, air, water, an inert gas, or any combination thereof.

In some examples, the recovery gas is 100% or pure reactant gas. In some examples, the recovery gas is 100% or pure inert gas. In some examples, the recovery gas comprises a reactant gas and an inert gas in any ratio. In some examples, the recovery gas comprises an oxidative gas and an inert gas in any ratio. In some examples, the recovery gas is a humidified gas having water vapor present in a concentration of about 0-2% by volume. In some cases, a humidified gas comprises a reactant gas, an inert gas, an oxidative gas, or any combination thereof.

Gas Pressure at Cathode (Pre-Contact with Water)

In some embodiments, after current stoppage or reduction, the pressure of a recovery gas flowing to the cathode may be at a level up to normal operating pressure of the electrolyzer cell. In some embodiments, after current stoppage or reduction, the cathode gas back pressure is reduced to, e.g., 0 psig. Cathode gas back pressure may be controlled by a pressure regulator located downstream from the cathode in the gas flow path. After reducing the cathode gas back pressure, the recovery gas may be present and optionally flowing under a pressure of about 0-600 psig, or about 0-400 psig, or about 0-50 psig.

Gas Flow Rate Going Through the Cathode (Pre-Contact with Water)

In certain embodiments in which a recovery gas flows after reducing or stopping the electrical current, the gas may be flowed at a rate of about 0 to 50 sccm/cm$^2$ of planar cathode surface area, or about 10 to 30 sccm/cm$^2$ of planar cathode surface area. Note that the flow rate values presented herein are provided on a per surface area of cathode (e.g., per cm$^2$ of planar cathode surface). As a single example, the gas flow rate may be about 500 sccm for an electrolyzer having 25 cm$^2$ of cathode surface area. The gas flow rate may scale linearly or non-linearly with surface area of the cathode. The flow rate values presented here may be instantaneous flow rates or average flow rates.

Duration of Gas Flowing at Cathode (Pre-Contact with Water)

In recovery sequence embodiments in which a recovery gas flows to the cathode, that gas may flow for a period of time after the electrical current is stopped or reduced. In certain embodiments, the duration of the gas flowing to or residing at the cathode is about 30 minutes to 10 days, or about 1 hour to 2 days. The duration of gas flow in a recovery sequences may be at least partially dependent on the flow rate of the gas (e.g., the average flow rate in cases where the flow rate varies). As an example, low or zero flow for a few days and high flow for a few minutes or hours may have similar effects. As a further example, a gas flow and/or exposure time range could be 30 minutes to even days. But at a flow rate of 50 sccm/cm$^2$, the maximum contact/flow time may be about 5 hours.

In some embodiments, the recovery gas is flowed to the cathode before contacting the cathode with water or other liquid. The recovery gas flow may be stopped before contact with the liquid.

Composition of Water Contacting the Cathode

As indicated, various recovery processes involve contacting the cathode with a liquid such as water. It should be understood that when referring to water herein, the recovery process may employ water over a wide range of purities. In some embodiments, the water is deionized water such as deionized water having a resistivity of at least about 1 megaohm, or at least about 10 megaohm, or at least about 18 megaohm. In some embodiments, the water includes one or more dissolved solutes or suspended components. Examples of dissolved solutes include bicarbonates, carbonates, sulfates, hydrogen sulfates, formates, acetates, and halides. As examples, the solutes may be metal (e.g., sodium, potassium, or cesium) or ammonium salts of these anions. In certain embodiments, recovery process water comprises a bicarbonate at a concentration of at most about 10 mM bicarbonate ion, or at most about 5 mM bicarbonate ion, or at most about 2 mM bicarbonate ion. In some embodiments, the recovery process water has a composition that matches or is similar to that of anode water used during normal operation. Examples of anode water compositions are presented in PCT Patent Application No. PCT/US2019/063471, filed Nov. 26, 2019, which is incorporated herein by reference in its entirety.

Water Flow Rate at Cathode

The water optionally flows during contact with the cathode. In some embodiments, the water flow rate to the cathode is up to about 20 ml/min per cm$^2$ of planar cathode surface area. As an example, the water flow rate is about 2-10 ml/min per cm$^2$ of planar cathode surface area. In some embodiments, the flow rate is limited based on pump and associated hardware. Note that water provided to the cathode as part of a recovery process is typically provided from outside MEA, such as via the carbon oxide inlet to the cathode, as opposed to being provided from the anode via the MEA.

Duration of Water Flowing Through Cathode

In certain embodiments, the duration of water flowing to the cathode is about 1-100 minutes. In certain embodiments, the duration of water flowing to the cathode is about 2-50 minutes, or about 5-15 minutes.

Drying Steps (Gas Flowing) after Water Flowing

A drying operation may be performed when no water contacts the cathode. Drying may be performed after water contact but before, or possibly during an initial period of, resumption of normal operation.

Drying may be performed with a gas of any composition that removes water from the cathode. Such gas may be referred to herein as a "drying gas." Examples of gases that may be present in a drying gas are air, the reactant gas, and inert gases. Examples of the inert gases include the noble gases (e.g., He, Ar, Kr) and nitrogen. If the reactant gas is used, it is optionally used at a concentration that is different from its use during normal operation. For example, carbon dioxide may be present at 50% (molar) in the reactant and be present at 20% (molar) in the drying gas.

The physical mechanism by which the drying gas removes water from the cathode may include pushing or otherwise forcing water out of the cathode by contacting the cathode with gas at a pressure and/or velocity sufficient to remove liquid water.

Water may also or alternatively be removed by evaporation into the drying gas. To this end, the relative humidity of the drying gas entering the cathode may be controlled to facilitate evaporation. While, in some embodiments, the drying gas may have a very low relative humidity (e.g., about 0 to 100%), in other embodiments, it may have a higher value, which may be desirable to ensure that the MEA does not lose moisture to the point where it dries and its performance degrades.

Duration of Drying

In certain embodiments, the duration of drying the cathode is about 0 to 500 minutes, or about 2 to 100 minutes, or about 5 to 30 minutes.

In some embodiments, the drying operation continues until no further liquid water (e.g., water droplets or mist) is present downstream from the cathode. In some embodiments, the drying operation continues until the humidity of the drying gas entering the cathode is approximately the same as the humidity of the drying gas exiting the cathode.

Restarting Flow or Reactant Gas

If the drying is not conducted with the reactant gas, the recovery process transitions from flowing drying gas to flowing reactant gas. This may involve reestablishing the normal operating gas pressure at the cathode by, e.g., adjusting a setting on the pressure regulator downstream from the cathode. If the drying gas is the reactant gas, then the transition from flowing the drying gas to flowing the reactant gas need not occur, or optionally it occurs but represents only a change in the gas flow rate, pressure, composition, or a combination thereof.

Current Ramp Rate after Recovery

In some embodiments, at the conclusion of the recovery operation, electrical current is resumed directly to the original value or with some ramping steps or step increase.

Optional Voltage Scan

In some embodiments, a recovery process is performed with a voltage or current scan. A voltage or current scan may be performed repeatedly in alternating directions, between two endpoints. A voltage scan may be performed in the manner of cyclic voltammetry. In some cases, a voltage or current scan is performed in a recovery process while the current is otherwise stopped. In some cases, a voltage or current scan is performed while gas flows to the cathode, but water does not contact the cathode. For example, a voltage or current scan may be performed during a gas drying operation in any of recovery sequence examples 2-4, above. In some examples, a voltage or current scan is performed during a gas contact operation that occurs prior to contact with water. See recovery sequence examples 3 and 4, above. In some examples, a voltage or current scan is performed during a gas contact operation that is not associated with a water contact operation. See recovery sequence examples 5-7, above.

A voltage or current scan may have various effects on an electrolyzer cell or its cathode. Examples include:

- Relax the charging overpotential of carbon materials within the electrode, which is caused by strong polarization, through current stoppage for different lengths of time.
- Electrode surface cleaning (removing impurities/unwanted intermediates) by changing adsorption/desorption environment at zero or slight anodic voltage or under air exposure.
- Rearrange cathode catalyst sites to more favorable orientations for COx reduction.
- Keep the MEA hydrated.

A voltage scan may be characterized by an initial cathode voltage E0 (V), an upper cathode voltage limit V1 (V), a lower cathode voltage limit V2 (V), and a scan rate S (mV/s). In some embodiments, E0 has a range of about −1V to 1.2V vs. RHE. In some embodiments, E1 has a range of about −1V to 1.2V. In some embodiments, E2 has a range of about −1V to 1.2V. In some embodiments, S has a range of about −10000 to −0.1 mV/s, or about 0.1 to 10000 mV/s. The scan direction can be positive or negative, with positive meaning the first sweep is towards the positive direction, while negative meaning the first sweep is towards the negative direction. The scan rates in the positive and negative directions may be the same or different. The number of scans (n) can be in the range from about 1 to 1000.

Temperature Variation During Recovery Operations

In certain embodiments, the temperature of an electrolyzer cell remains unchanged during a recovery operation. In certain embodiments, the temperature of an electrolyzer cell changes during a recovery operation. The temperature change may be driven by a temperature controller, water flowing to the cathode, gas flowing to the cathode, or any combination thereof. In some embodiments, the electrolyzer cell temperature increases during the recovery operation. In some embodiments, the electrolyzer cell temperature decreases during the recovery operation, e.g., by about 5-25° C.

Experimental

Figure 6:
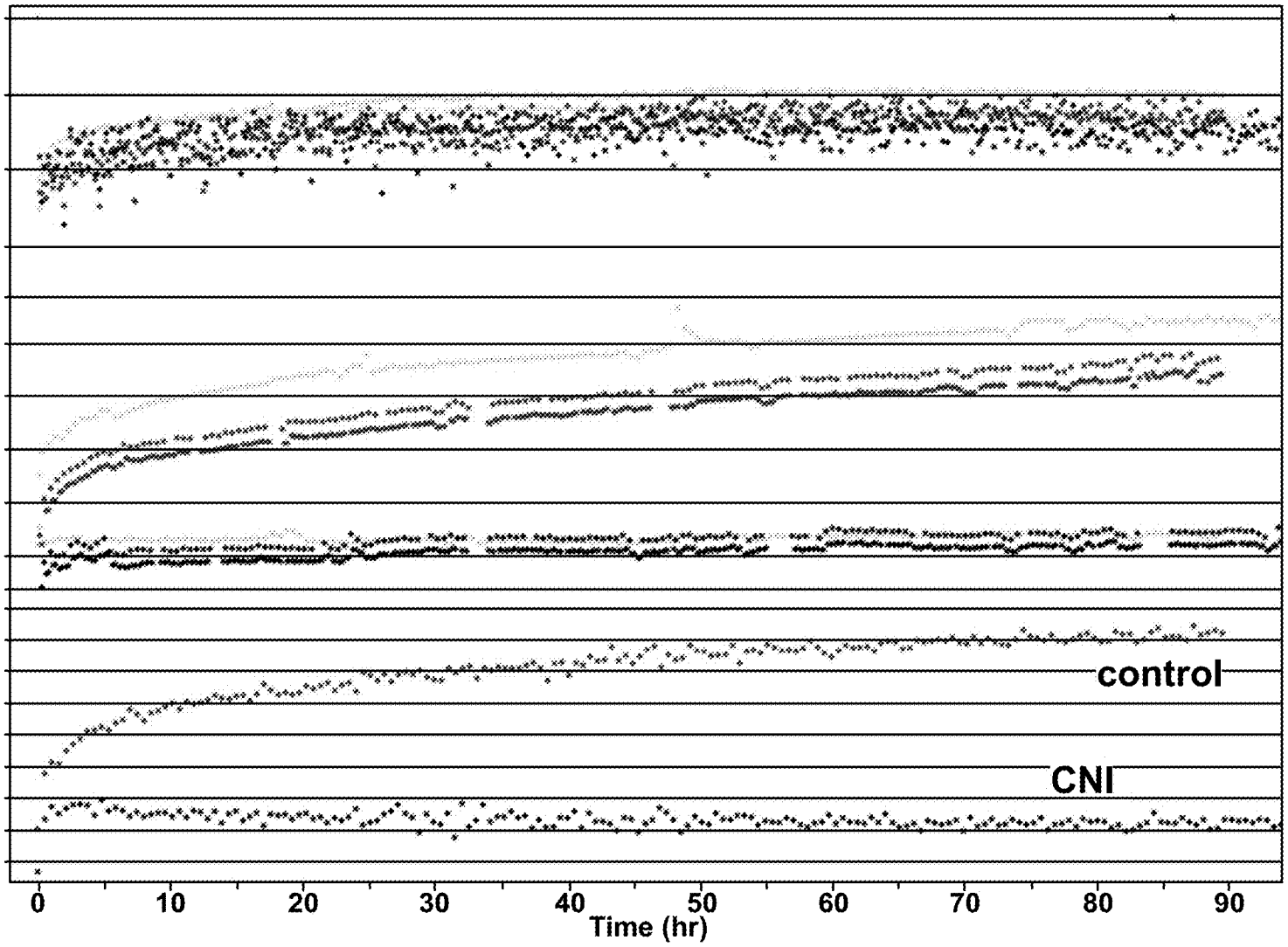
FIG. 6 is a graphical illustration of a study comparing a membrane electrode assembly without carbon nanoparticles (control) to a membrane electrode assembly with an interface of carbon nanoparticles and ion-conducting polymer (CNI) in the presence of an electrical current over time in accordance with certain disclosed embodiments.

The ability of interface components in accordance with certain embodiments of the invention to mitigate the effects of electrical interruptions is illustrated in FIG. 6. Each data point represents one turning on and turning off of the power to the cell (mimicking a power interruption). The data was measured under conditions of current oscillation of 20 minutes at 300 mA/cm$^2$ and 10 minutes at 0 mA/cm$^2$, where the transition period can include up to 30 seconds of reverse bias (current up to 50 mA/cm$^2$ in the reverse direction).

The top plot shows CO selectivity, the middle plot voltage, and the bottom plot resistance. Over the course of time, an electrochemical cell without an interface (control) of at least one porosity enhancing agent gradually records an increased resistance. However, when an interface composed of a carbon and Nafion mixture (CNI) is tested under the same conditions, it does not build up resistance. There is a clear mitigation of voltage decay.

In FIG. 6, the top graph is NFY_CO or CO selectivity where NFY is normalized faradaic yield. It is a measure of how much applied current goes toward converting $CO_2$ to CO, so 98% of the current is converting $CO_2$ into CO. The data is similar between CNI and control which is expected. The middle graph shows voltage (measure of energy efficiency). The bottom graph shows resistance. FIG. 6 shows a clear trend whereby the porous interface completely prevents any voltage increase associated with discharge.

The make-up of the interface was a 1:1 ratio by weight of carbon nanoparticles and Nafion, applied 3 um thick. The Nafion component was a 5% by weight polymer in solution. Without being bound to any particular mechanism, the increased resistance demonstrated by the cell without an interface may be due to decomposition of the AEM and PEM materials. Notably, the selectivity remains high throughout the process.

Other Embodiments and Conclusion

Although omitted for conciseness, embodiments of the system and/or method can include every combination and permutation of the various system components and the various method processes, wherein one or more instances of the method and/or processes described herein can be performed asynchronously (e.g., sequentially), concurrently (e.g., in parallel), or in any other suitable order by and/or using one or more instances of the systems, elements, and/or entities described herein.

Although the foregoing embodiments have been described in some detail for purposes of clarity of understanding, it will be apparent that certain changes and modifications may be practiced within the scope of the appended claims. It should be noted that there are many alternative ways of implementing the processes, systems and apparatus of the present embodiments. Accordingly, the present embodiments are to be considered as illustrative and not restrictive, and the embodiments are not to be limited to the details given herein.

What is claimed is:

1. A $CO_x$ reduction reactor comprising:

a membrane electrode assembly including a cathode catalyst layer comprising a catalyst configured for reduction of $CO_x$;

an anode catalyst layer; and a bipolar membrane disposed between the cathode catalyst layer and the anode catalyst layer, wherein the bipolar membrane comprises an anion-conducting polymer layer, a cation-conducting polymer layer, and an interface region between the anion-conducting polymer layer and the cation-conducting polymer layer, and wherein the interface region comprises nanoparticles, wherein the nanoparticles consist essentially of carbon nanoparticles; and wherein the interface region is from about 1 to about 10 micrometers thick.

2. The $CO_x$ reduction reactor of claim 1, wherein the carbon nanoparticles comprise functionalized carbon nanoparticles.

3. A membrane electrode assembly comprising:

a cathode catalyst layer comprising a catalyst configured for reduction of $CO_x$, wherein the catalyst of the cathode catalyst layer comprises Au, Ag, Cu, or a combination thereof;

an anode catalyst layer; and a bipolar membrane disposed between the cathode catalyst layer and the anode catalyst layer, wherein the bipolar membrane comprises an anion-conducting polymer layer, a cation-conducting polymer layer, and an interface region between the anion-conducting polymer layer and the cation-conducting polymer layer, and wherein the interface region comprises nanoparticles wherein the nanoparticles consist essentially of carbon nanoparticles, and wherein the interface region is from about 1 to about 10 micrometers thick.

4. The membrane electrode assembly of claim 3, wherein a ratio of a thickness of the anion-conducting polymer layer to the thickness of the interface region is at least 10:1.

5. The membrane electrode assembly of claim 3, wherein the interface region further comprises an ion-conducting polymer.

6. The membrane electrode assembly of claim 3, wherein the cation-conducting polymer layer is disposed between the anode catalyst layer and the anion-conducting polymer layer.

7. The membrane electrode assembly of claim 3, wherein the cathode catalyst layer comprises a reduction catalyst and an anion-conducting polymer.

8. The membrane electrode assembly of claim 3, wherein the anode catalyst layer comprises an oxidation catalyst and a cation-conducting polymer.

9. The membrane electrode assembly of claim 3, wherein the carbon nanoparticles comprise functionalized carbon nanoparticles.

10. A method of electrochemically reducing $CO_x$ comprising:

(a) providing a carbon oxide to a $CO_x$ reduction reactor, and (b) electrochemically reducing the carbon oxide at a cathode of a $CO_x$ electrolyzer to produce a carbon containing product, wherein the $CO_x$ reduction reactor comprises a membrane electrode assembly comprising:

a cathode catalyst layer;

an anode catalyst layer; and a bipolar membrane disposed between the cathode catalyst layer and the anode catalyst layer, wherein the bipolar membrane comprises an anion-conducting polymer layer, a cation-conducting polymer layer, and an interface region between the anion-conducting polymer layer and the cation-conducting polymer layer, and wherein the interface region comprises nanoparticles, wherein the nanoparticles consist essentially of carbon nanoparticles, and wherein the interface region is from about 1 to about 10 micrometers thick.

11. The method of claim 10, wherein the $CO_x$ reduction reactor is subjected to electrical current fluctuations.

12. The method of claim 11, wherein the electrical current fluctuations result from a recovery process, a power interruption, a current reversal, or a power outage.

13. The method of claim 10, wherein the carbon oxide is carbon dioxide.

14. The method of claim 10, wherein the carbon containing product comprises carbon monoxide, a hydrocarbon, formic acid, an alcohol, or a combination thereof.

15. The method of claim 10, wherein the interface region further comprises an ion-conducting polymer.

16. The method of claim 10, further comprising performing a recovery process, the recovery process comprising pausing electrical current supplied to the membrane electrode assembly.

17. The method of claim 16, wherein during the pausing of electrical current being supplied to the membrane electrode assembly, water splitting is facilitated at the carbon nanoparticles.

18. The method of claim 16, wherein the pausing electrical current supplied to the membrane electrode assembly comprises significantly reducing the electrical current or turning the electrical current off.

19. The method of claim 10, wherein the carbon nanoparticles comprise functionalized carbon nanoparticles.

* * * * *